US005296343A

United States Patent [19]

Hioki et al.

[11] Patent Number: 5,296,343

[45] Date of Patent: * Mar. 22, 1994

[54] SILVER HALIDE PHOTOGRAPHIC EMULSION AND FULL COLOR RECORDING MATERIAL CONTAINING THE SAME

[75] Inventors: Takanori Hioki; Takashi Kato; Tadashi Ikeda, all of Kanagawa, Japan

[73] Assignee: Fuji Photo Film Co., Ltd., Kanagawa, Japan

[ * ] Notice: The portion of the term of this patent subsequent to Dec. 29, 2009 has been disclaimed.

[21] Appl. No.: 772,744

[22] Filed: Oct. 7, 1991

[30] Foreign Application Priority Data

Oct. 8, 1990 [JP] Japan ..... 2-270163

[51] Int. Cl.[5] ..... G03C 1/005

[52] U.S. Cl. ..... 430/508; 430/584; 430/349; 430/944; 430/567; 430/503

[58] Field of Search ..... 430/588, 584, 349, 944, 430/567, 508, 503

[56] References Cited

U.S. PATENT DOCUMENTS

| | | | |
|---|---|---|---|
| 2,481,022 | 9/1949 | Kendall et al. | 430/594 |
| 4,619,892 | 10/1986 | Simpson et al. | 430/944 |
| 4,814,264 | 3/1989 | Kishida et al. | 430/567 |
| 4,939,080 | 7/1990 | Hioki et al. | 430/584 |
| 5,141,845 | 8/1992 | Brugger et al. | 430/584 |
| 5,175,080 | 12/1992 | Hioki et al. | 430/584 |

FOREIGN PATENT DOCUMENTS 0604217 6/1948 United Kingdom .

OTHER PUBLICATIONS

Tani, T., "Determination of Crystal Habit of Fine Silver Halide Grains in Photographic Emulsions through Their Adsorption of Dyes", The Chemical Society of Japan, (6), pp. 942-947 (1984).

Kampfer, H., "IR-Absorbing-J-Aggregates of Dicarbocyanine Dyes", Progress in Basic Principles of Imaging Systems, (Cologne 1986).

*Primary Examiner*—Richard L. Schilling
*Assistant Examiner*—Thomas R. Neville
*Attorney, Agent, or Firm*—Sughrue, Mion, Zinn, Macpeak & Seas

[57] ABSTRACT

Disclosed is a silver halide photographic emulsion spectrally sensitized in the wavelength range longer than 730 nm, and full-color recording materials containing such a photographic emulsion. The photographic emulsion has undergone J-band sensitization by containing at least one compound represented by the following general formula (I) in an amount of from 0.3 to 0.9 based on the specific addition amount defined in the disclosure, at a temperature ranging from 60° C. to 85° C. to gain a spectral sensitivity maximum at a wavelength from 730 nm to 900 nm:

(I)

wherein $Z_1$ and $Z_2$ each represents a sulfur or selenium atom; $Q_1$ and $Q_2$ each represents a methylene group; $R_1$ and $R_2$ each represents an alkyl group; $R_3$ represents an alkyl group, an aryl group or a heterocyclyl group; $L_1$, $L_2$ and $L_3$ each represents a methine group; $A_1$ and $A_2$ each represents the atoms necessary for completing a benzene ring; $R_1$ and $R_2$ may combine with $L_1$ and $L_3$, respectively, to form a ring; $M_1$ represents a counter ion for charge balance; and $m_1$ represents the numerical value required for neutralization of the electric charge.

17 Claims, 10 Drawing Sheets

SILVER HALIDE PHOTOGRAPHIC EMULSION AND FULL COLOR RECORDING MATERIAL CONTAINING THE SAME

FIELD OF THE INVENTION

This invention relates to a spectrally sensitized silver halide emulsion, particularly to a silver halide emulsion which has heightened spectral sensitivity to light of wavelengths longer than 730 nm and excellent preservation stability, and to a color recording material utilizing such an emulsion.

BACKGROUND OF THE INVENTION

Recently, new system arts using the arts of processing and storing information and processing images, in combination with communication circuits, have developed rapidly. Such new system arts are referred to as the arts of visualizing electric signals which carry image information, including photographs, letters, figures and the like, on photosensitive materials through a current to a light transference (that is, the arts of obtaining hard copies from soft information).

The fields in which these system arts are utilized include acsimile, computer photo-composing system, typographic printing system, halftone image formation using a scanner, holography, and IC photomask.

The light sources installed in instruments used for these rapid transfer systems of information include a xenon flash light, a glow discharge light, an arc light, a high pressure mercury lamp, a xenon lamp, flying spots of the phosphor in a cathode ray tube, a light-emitting diode (LED), laser beams and so on. The combination of a high intensity light source as cited above and a high-speed shutter constitutes a light source apparatus.

On the other hand, the progress of silver halide photographic materials and compact simple rapid developmental systems (e.g., a minilab system) makes it feasible to provide printed photographs of extremely high quality with comparative ease at a low price. Under these circumstances, there is a strong and growing demand for obtaining hard copies from a soft information source with ease at a low price in the form of printed photographs of high quality.

The means of obtaining hard copies from a soft information source include a means which does not use any photosensitive recording material but adopts a method using electric or electromagnetic signals or an ink jet system, and a means of using a photosensitive material such as a silver halide light-sensitive material, an electrophotographic material and so on. In the latter means, a photograph record is made by the use of an optical system which emits light under the control of image information. Since the optical system itself has high resolving power and enables not only binary recording but also variable contrast recording, the latter means has the advantage that it can ensure a high quality of the images recorded. In particular, the method involving a silver halide light-sensitive material has the advantage of chemical image formation, in contrast to the method involving an electrophotographic material. On the other hand, the method involving a silver halide light-sensitive material requires particular measures to provide color sensitivities suitable for the optical system to be used, stability of photographic sensitivity, stability of latent image, high resolving power, clear separation of three primary colors, rapid and simple of color development processing, and a reasonable priced silver halide light-sensitive material.

The arts of making color copies include electrophotography-utilized copying machines and laser printers, and pictrography (trade name, products of Fuji Photo Film Co., Ltd.) in which a process comprising heat development of silver halide and diffusion of dyes, and LED are used in combination.

More specifically, JP-A-61-137149 (the term "JP-A" as used herein means an "unexamined published Japanese patent application") discloses a color photographic material which does not undergo exposure to visible rays, and is designed so as to have on a support at least three silver halide emulsion layers into which conventional color couplers are incorporated respectively. At least two of the emulsions are sensitized to laser beams of wavelengths in the infrared region.

Further, JP-A-63-197947 and JP-A-02-157749 disclose color recording materials which have on a support at least three kinds of color coupler-containing light-sensitive layer units. At least one layer unit is spectrally sensitized so as to have its spectral sensitivity maximum at a wavelength longer than about 670 nm (that is, a sensitivity to LED and semiconductor laser beams) and to produce color images by light-scanning exposure and subsequent color development. In particular, those patent specifications disclose methods of ensuring high sensitivity and high stability to spectral sensitization and methods using dyes.

Furthermore, JP-A-55-13505 discloses a method of recording color images on a color photographic material by controlling the production of yellow, magenta and cyan colors by means of three kinds of luminous fluxes differing in wavelength, e.g., green, red and infrared fluxes.

In addition, there is a presentation of the control mechanism of semiconductor laser output for a continuous tone scanning printer and its basic features in Proceedings of "The 4th International Conference (SPSE) on Nonimpact Printing (NIP)", on pages 245 to 247, by S. H. Baek et al.

As described above, production of an apparatus utilizing laser beams (especially semiconductor laser beams) or light-emitting diodes (LED) as an exposure light source for photosensitive materials has increased in recent years. Consequently, spectral characteristics according to the wavelengths of the light emitted thereby, that is, the near infrared region, have been required of silver halide light-sensitive materials.

As for the spectral sensitizing dyes which can be used for filling such a requirement, a large number of compounds are known. Examples of such dyes include cyanine dyes, merocyanine dyes and xanthene dyes described, e.g., in T. H. James, *The Theory of the Photographic Processs*, 3rd Ed., pp. 198–228, Macmillan, New York (1966). They can be used alone, or in combination of two or more (e.g., for supersensitization).

Moreover, thiadicarbocyanine and selenadicarbocyanine dyes whose respective methine chains are cross-linked by a trimethylene group between the 2- and the 4-positions are known to be excellent in sensitivity, storage stability and so on, which is disclosed, e.g., in JP-A-60-202436, JP-A-60-220339, JP-A-60-225147, JP-A-61-123834, JP-A-62-87953, JP-A-63-264743, JP-A-01-155334, JP-A-01-177533, JP-A-01-198743, JP-A-01-216342 JP-A-02-42, JP-B-60-57583 (The term "JP-B" as used herein means an "examined Japanese patent publication"), U.S. Pat. 4,618,570, and so on. The dyes disclosed in those patent specifications are cross-linked by a 2,2'-dimethyltrimethylene group between the 2- and the 4-positions on the methine chain. A typical representative of such dyes is illustrated below as Dye A.

Dye A

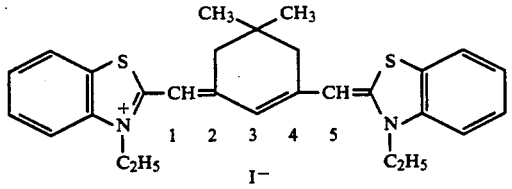

These dyes show their spectral sensitivity maxima in the vicinity of 700 nm, but have little or no useful function as spectral sensitizing dyes in the wavelength region longer than 730 nm.

In addition, it is reported by H. Kampfer in *Proceedings of the International Congress of Photographic Science, Koln (Cologne)*, p. 366 (1986) that Dye A and its derivatives form J-aggregates on the surfaces of AgBrI (iodide content: 4.5 mol. %) or AgBrCl (chloride content: 20 mol%) grains to impart spectral sensitivities to such grains at wavelengths longer than 750 nm. That report, however, contains no detailed account except a brief statement that the spectral sensitivity spectra of such grains in that region were very broad.

On the other hand, other types of thiadicarbocyanine and selenadicarbocyanine dyes, in which the 2- and the 4-positions of their respective methine chains are cross-linked by a trimethylene group substituted by only one alkyl or aryl group at the 2-position, are disclosed in British Patents 595,783, 595,784, 595,785 and 604,217, U.S. Pat. Nos. 2,481,022 and 2,756,227, *Photographic Science and Photochemistry*, p. 39 (1987), *Journal of Imaging Science*, vol. 32, p. 81 (1988), and so on.

As for their ability to spectrally sensitize a silver halide system, it is reported in U.S. Pat. No. 2,481,022 that silver iodobromide sensitized by the above-cited dyes has its spectral sensitivity maximum at a wavelength ranging from 695 to 710 nm.

In *Photographic Science and Photochemistry*, p. 39 (1987), a silver chlorobromide emulsion (Br content: 25 mol. %, Cl content: 75 mol. %) is spectrally sensitized by the above-cited dyes to show its spectral sensitivity maximum at a wavelength ranging from 695 to 720 nm. (Amounts added per 50 g of the emulsion: 0.5 and 1 ml portions of a solution containing a dye in a concentration of 1/2000 mol/l).

In *Journal of Imaging Science*, vol. 32, p. 81 (1988), on the other hand, there is no description of spectral sensitivity maxima although a silver bromide emulsion is spectrally sensitized by the above-cited dyes. In that literature reference, the dyes were examined for their effect in combination with supersensitizers of the triazinostilbene type, and presumed to bring about general M-band spectral sensitization. (After the dyes were added to the emulsion in the form of a methanol solution, the resulting emulsion was allowed to stand for 20 min. at 40° C.).

In general, it is difficult to achieve high sensitivity and high stability during storage in infrared sensitization, especially in sensitization at infrared wavelengths longer than 730 nm.

Also, the achievement of such characteristics is particularly difficult in the case of silver chlorobromide emulsions having a high chloride content, especially those of 95 mol. % or more. First, such emulsions suffer from lack of sensitivity, production stability and storage stability. In particular, it is hard for them to obtain a gradation which is excellent in linearity in a high sensitivity condition. Also, it is hard to get a sharp distribution of spectral sensitivities. Second, it is hard for them to obtain a high sensitivity after a short-time exposure, e.g., $10^{-6}$–$10^{-8}$ second's exposure. Third, conventional infrared-sensitizing dyes have a low adsorptivity to silver halide grains. Consequently, a lowering of sensitivity and a generation of fog tend to occur in dissolving emulsions and on standing, particularly when color couplers, a high concentration of surface active agent and organic solvents are present together. Therefore, there has been a need for the development of photosensitive materials having a high sensitivity and an excellent latent-image stability even when infrared-sensitized silver halide emulsions are used therein. Also, the development of photosensitive materials using high chloride-content silver halide emulsions which enable rapid processing has been desired in particular.

SUMMARY OF THE INVENTION

One object of this invention is to provide a silver halide emulsion which has a high sensitivity and an excellent storage stability even if it has undergone spectral sensitization selectively in the wavelength region suitable for light flux of wavelengths longer than 730 nm.

A second object of this invention is to provide a method of spectrally sensitizing a silver halide emulsion so as to correspond to light flux of wavelengths longer than 730 nm, wherein the art of J-band sensitization which can impart spectral sensitivity in a narrow wavelength region is used.

A third object of this invention is to provide a color recording material which is excellent in color separation.

Certain objects of this invention are attained with a silver halide photographic emulsion which is spectrally sensitized by including therein at least one compound represented by the following general formula (I), wherein the compound is added to the emulsion at a temperature ranging from 60° C. to 85° C. in a specific addition amount of from 0.3 to 0.9, which is defined hereinafter, to cause in the emulsion J-band sensitization to realize a spectral sensitivity maximum at wavelengths ranging from 730 nm to 900 nm.

Other objects of this invention are also attained by a method of spectrally sensitizing a silver halide photographic emulsion so that the emulsion can shows its spectral sensitivity maximum in the wavelength region from 730 nm to 900 nm by adding at least one compound of general formula (I) to the emulsion under a temperature ranging from 60° C. to 85° C. in a specific addition amount of from 0.3 to 0.9 based on the surface area of the silver halide grains of the emulsion.

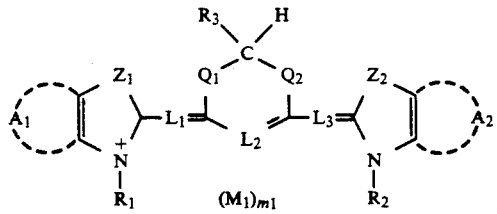

(I)

In the foregoing general formula (I), $Z_1$ and $Z_2$ each represents a sulfur or selenium atom; $Q_1$ and $Q_2$ each represents a methylene group; $R_1$ and $R_2$ each represents an alkyl group; $R_3$ represents an alkyl group, an aryl group or a heterocyclyl group; $L_1$, $L_2$ and $L_3$ each represents a methine group; $A_1$ and $A_2$ each represents the atoms necessary for completing a benzene ring; and further, $R_1$ and $R_2$ may combine with $L_1$ and $L_3$, respectively, to form a ring, $M_1$ represents a counter ion for charge balance, and $m_1$ represents a numerical value required for neutralization of the electric charge.

BRIEF DESCRIPTION OF DRAWINGS

FIGS. 1-2, 2-2, 3-2, 3-4, 4-2, 4-4, 4-6 and 4-8 each shows spectral sensitivity curves of samples of this invention and those of comparative samples.

FIGS. 5-1 and 5-2 show logarithmic spectral sensitivity curves of samples of this invention and of comparative samples.

DETAILED DESCRIPTION OF THE INVENTION

Figure 1:
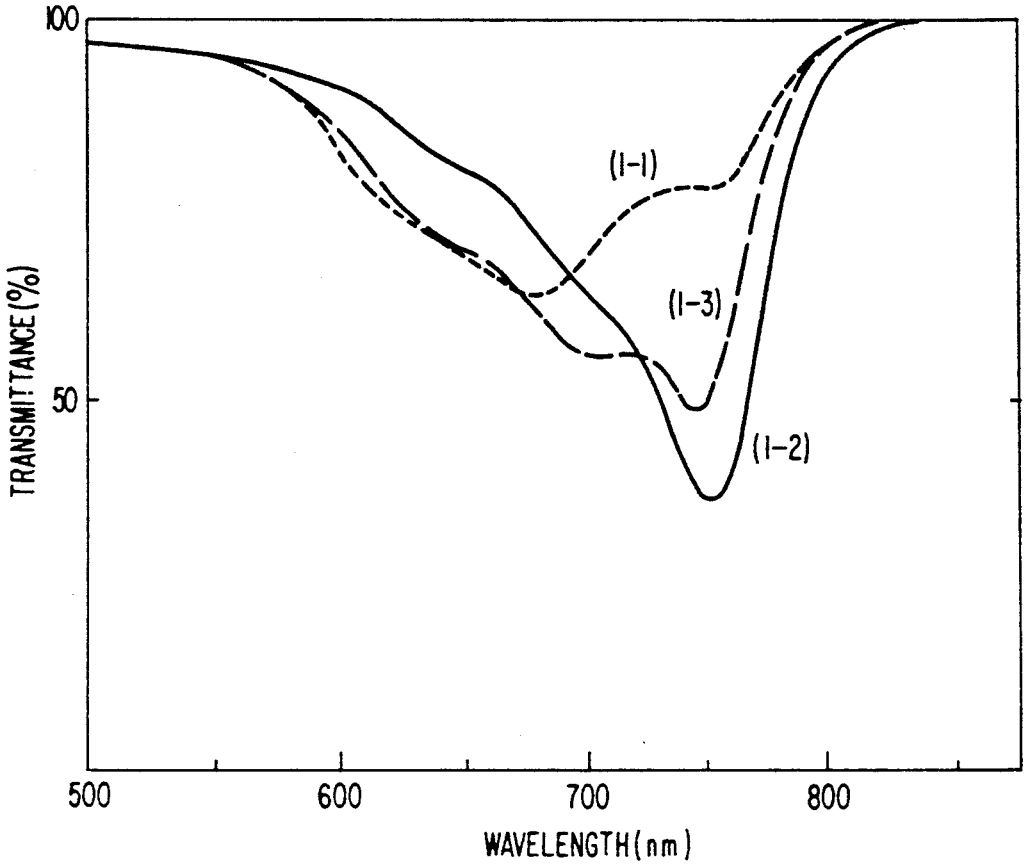
FIGS. 1-1, 2-1, 3-1, 3-3, 4-1, 4-3, 4-5 and 4-7 each shows spectral transmission curves of samples of this invention and of comparative samples.

The definition of "specific addition amount" is as follows:

$$\text{Specific addition amount} = 100 \cdot M \cdot R / S$$

Herein, M represents the number of moles of the compound added to an emulsion, R is Avogadro's number, and S represents the total surface area ($Å^2$) of the silver halide grains present in the emulsion.

A desirable range of the specific addition amount is from 0.3 to 0.9, preferably from 0.4 to 0.7.

A desirable temperature for the addition is from 60° C. to 85° C, preferably from 65° C. to 75° C.

The foregoing general formula (I) is described below in greater detail.

$R_1$ and $R_2$ each preferably represents an unsubstituted alkyl group containing 1 to 18 carbon atoms (e.g., methyl, ethyl, propyl, butyl, pentyl, octyl, decyl, dodecyl, octadecyl), or a substituted alkyl group which contains 1 to 18 carbon atoms in the alkyl moiety. Examples of suitable substituent groups include a carboxyl group, a sulfo group, a cyano group, a halogen atom (e.g., fluorine, chlorine, bromine), a hydroxyl group, an 2–18C alkoxycarbonyl group (e.g., methoxycarbonyl, ethoxycarbonyl, phenoxycarbonyl, benzyloxycarbonyl), a 1–8C alkoxy group (e.g., methoxy, ethoxy, benzyloxy, phenetyloxy), a 6–10C monocyclic aryloxy group (e.g., phenoxy, p-tolyloxy), an 1–3C acyloxy group (e.g., acetyloxy, propionyloxy), an 1–8C acyl group (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and a 6–10C aryl group (e.g., phenyl, 4-chlorophenyl, 4-methylphenyl, α-naphthyl).

Further, $R_1$ may combine with $L_1$ to form a ring, and $R_2$ may combine with $L_3$ to form a ring. Preferably, they each are carbon atoms forming an unsubstituted 5-, 6- or 7-membered ring, especially carbon atoms forming a 6-membered ring.

Groups preferred as $R_1$ and $R_2$ include unsubstituted alkyl groups (e.g., methyl, ethyl, n-propyl, n-butyl), carboxyalkyl groups (e.g., 2-carboxyethyl, carboxymethyl), and sulfoalkyl groups (e.g., 2-sulfoethyl, 3-sulfopropyl, 4-sulfobutyl, 3-sulfobutyl). In addition, a ring formation by combination of $R_1$ with $L_1$ or by combination of $R_2$ with $L_3$ is preferred.

In particular, desirable results are obtained when $R_1$ is the same as $R_2$. In those cases, unsubstituted alkyl groups (e.g., methyl, ethyl), atoms completing a 6-membered carbon ring together with $L_1$ or $L_3$, and sulfoalkyl groups (e.g., 3-sulfopropyl, 4-sulfobutyl) are favored as $R_1$ and $R_2$.

$(M_1)m_1$ is contained in the formula in order to indicate the presence or the absence of cation or anion when neutrality of ionic charge is required of the dye. Whether a dye is a cation or an anion, or whether it has a net ionic charge or not, depends on its auxochrome and substituent group(s). Typical cations include inorganic and organic ammonium ions, and alkali metal ions. On the other hand, anions may be either inorganic or organic ones. Specific examples of anions include halide anions (e.g., fluoride ion, chloride ion, bromide ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonateion, 2,6-naphthalenedisulfonate ion), alkylsulfate ions (e.g., methylsulfate ion), sulfate ion, thiocyanate ion, perchlorate ion, tetrafluoroborate ion, picrinate ion, acetate ion, and trifluoromethanesulfonate ion.

Among those ions, the ammonium ion, the iodide ion, the p-toluenesulfonate ion and the perchlorate ion are preferred over others.

$Q_1$ and $Q_2$ each represents an unsubstituted methylene group, or a substituted methylene group. Suitable examples of a substituent group thereof include a carboxyl group, a sulfo group, a cyano group, halogen atoms (e.g., fluorine, chlorine, bromine), a hydroxyl group, alkoxycarbonyl groups containing not more than 8 carbon atoms (e.g., methoxycarbonyl, ethoxycarbonyl, benzyloxycarbonyl), aryloxycarbonyl groups containing not more than 12 carbon atoms (e.g., phenoxycarbonyl), alkoxy groups containing not more than 8 carbon atoms (e.g., methoxy, ethoxy, benzyloxy, phenetyloxy), monocyclic aryloxy groups containing not more than 15 carbon atoms (e.g., phenoxy, p-olyloxy), acyloxy groups containing not more than 8 carbon atoms (e.g., acetyloxy, propionyloxy), acyl groups containing not more than 8 carbon atoms (e.g., acetyl, propionyl, benzoyl), carbamoyl groups (e.g., carbamoyl, N,N-dimethylcarbamoyl, morpholinocarbonyl, piperidinocarbonyl), sulfamoyl groups (e.g., sulfamoyl, N,N-dimethylsulfamoyl, morpholinosulfonyl, piperidinosulfonyl), aryl groups containing not more than 15 carbon atoms (e.g., phenyl, 4-chlorophenyl, 4-methylphenyl, α-naphthyl), and so on.

However, an unsubstituted methylene group is preferred for both $Q_1$ and $Q_2$.

A benzene ring completed by $A_1$ and $A_2$ each may be substituted by one or more atoms or groups as described below. Specifically, such substituents include halogen atoms (e.g., fluorine, chlorine, bromine), unsubstituted alkyl groups containing not more than 10 carbon atoms (e.g., methyl, ethyl), substituted alkyl groups containing not more than 18 carbon atoms (e.g., benzyl, α-naphthylmethyl, 2-phenylethyl, trifluoromethyl), acyl groups containing not more than 8 carbon atoms (e.g., acetyl, benzoyl), acyloxy groups containing not more than 8 carbon atoms (e.g., acetyloxy), alkoxycarbonyl groups containing not more than 8 carbon atoms (e.g., methoxycarbonyl, ethoxycarbonyl, benzyloxycarbonyl), carbamoyl groups (e.g., carbamoyl, N,N-dimethylcarbamoyl, morpholinocarbonyl, piepridinocarbonyl), sulfamoyl groups (e.g., sulfamoyl, N,N-dimethylsulfamoyl, morpholinosulfonyl, piperidinosulfonyl), a carboxyl group, a cyano group, a hydroxy group, an amino group, acylamino groups containing not more than 8 carbon atoms (e.g., acetylamino), sulfonamido groups containing not more than 8 carbon atoms (e.g., benzenesulfonamido), alkoxy groups containing not more than 10 carbon atoms (e.g., methoxy, ethoxy, benzyloxy), alkylthio groups containing not more than 10 carbon atoms (e.g., ethylthio), alkylsulfonyl groups containing not more than 5 carbon atoms (e.g., methylsulfonyl), a sulfonic acid group, and aryl groups containing not more than 15 carbon atoms (e.g., phenyl, tolyl).

Also, two substituents attached to adjacent carbon atoms in the benzene ring completed by $A_1$ and $A_2$ may combine with each other to complete a benzene ring or a hetero ring (e.g., pyrrole, thiophene, furan, pyridine, imidazole, triazole, thiazole).

Cases in which $A_1$ is the same as $A_2$ are more preferred. Therein, especially favorable cases are those in which the benzene ring is substituted by the following $V_1$, $V_2$ and $V_3$:

$A_1 = A_2 =$ 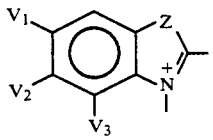

(The nitrogen-containing five-member heterocyclic ring is not part of $A_1$ or $A_2$.)

1) $V_1=V_3=H$, and $V_2=Cl$, OR (R=methyl, ethyl or n-propyl), methyl, ethyl, or phenyl.

2) $V_1=H$, and $(V_2, V_3)$=atoms completing a benzene ring.

3) $V_3=H$, and $(V_1, V_2)=-O-(CH_2)_2-O-$.

$L_1$, $L_2$ and $L_3$ each represents a methine group, or a substituted methine group {e.g., one which is substituted by a substituted or unsubstituted alkyl group (e.g., methyl, ethyl, 2-carboxyethyl), a substituted or unsubstituted aryl group (e.g., phenyl, o-carboxyphenyl), a halogen atom (e.g., chlorine, bromine), an alkoxy group (e.g., methoxy, ethoxy) or so on}. In addition, $L_1$ and $L_3$ each may form a ring together with the auxochrome.

Herein, $L_2$ is preferably an unsubstituted methine group, whereas $L_1$ and $L_3$ are each preferably an unsubstituted methine group or the atoms necessary to form a 6-membered carbon ring together with the auxochrome.

The group represented by $R_3$ is preferably an alkyl group containing 1 to 18, preferably 1 to 7, particularly preferably 1 to 4, carbon atoms (e.g., methyl, ethyl, propyl, isopropyl, butyl, isobutyl, hexyl, octyl, dodecyl, octadecyl), a substituted alkyl group {e.g., an aralkyl group (e.g., benzyl, 2-phenylethyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (e.g., 3-sulfatopropyl, 4-sulfatobutyl), a hetero ring-substituted alkyl group (e.g., 2-(pyrrolidine-2-one-1-yl)ethyl, tetrahydrofurfuryl, 2-morpholinoethyl), 2-acetoxethyl, carbomethoxymethyl, 2-methanesulfonylaminoethyl}, an allyl group, an aryl group (e.g., phenyl, 2-naphthyl, 1-naphthyl), a substituted aryl group (e.g., 4-carboxyphenyl, 4-sulfophenyl, 3-chlorophenyl, 3-methylphenyl), a heterocyclyl group (e.g., 2-pyridyl, 2-thiazolyl, 2-furyl, 2-thiophenyl), and a substituted heterocyclyl group (e.g., 4-methyl-2-pyridyl, 4-phenyl-2-thiazolyl).

Those groups more preferred as $R_3$ include an alkyl group containing not more than 6 carbon atoms (e.g., methyl, ethyl, propyl, butyl, pentyl, hexyl) and an unsubstituted aryl group containing not more than 10 carbon atoms (e.g., 1-naphthyl, 2-naphthyl, phenyl).

In particular, the methyl group, the ethyl group and the phenyl group are preferred over others.

Typical examples of the compounds represented by general formula (I) are illustrated below. However, the invention should not be construed as being limited to these examples.

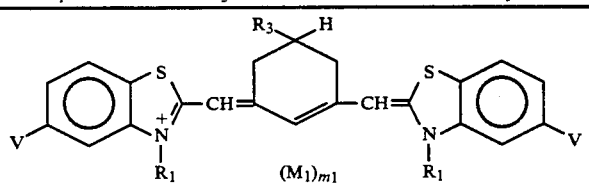

| No. | $R_1$ | $R_3$ | V | $M_1$ | $m_1$ |
|---|---|---|---|---|---|
| (1) | $C_2H_5$ | $CH_3$ | H | $I^-$ | 1 |
| (2) | " | " | $OCH_3$ | $ClO_4^-$ | 1 |
| (3) | " | " | $OC_2H_5$ | $Br^-$ | 1 |
| (4) | " | " | Cl | $ClO_4^-$ | 1 |
| (5) | " | " | $CH_3$ | $ClO_4^-$ | 1 |
| (6) | $(CH_2)_3SO_3^-$ | " | H | $HN(C_2H_5)_3^+$ | 1 |
| (7) | $CH_3$ | " | $O^nC_3H_7$ | $I^-$ | 1 |
| (8) | $CH_2CO_2H$ | " | $OC_2H_5$ | $Cl^-$ | 1 |

-continued
| No. | $R_1$ | $R_3$ | V | $M_1$ | $m_1$ |
|---|---|---|---|---|---|
| (9) | $(CH_2)_3SO_3^-$ | $C_2H_5$ | $OC_2H_5$ | $K^+$ | 1 |
| (10) | $C_2H_5$ | $^nC_3H_7$ | Cl | $I^-$ | 1 |
| (11) | $C_2H_5$ | 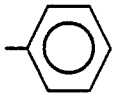 | H | $I^-$ | 1 |
| (12) | " | " | Cl | $Br^-$ | 1 |
| (13) | " | " | $OCH_3$ | $I^-$ | 1 |
| (14) | " | " | $OC_2H_5$ | $ClO_4^-$ | 1 |
| (15) | " | " | $O^nC_3H_7$ | $ClO_4^-$ | 1 |
| (16) | " | " | $CH_3$ | $ClO_4^-$ | 1 |
| (17) | $(CH_2)_2CO_2H$ | " | $OCH_3$ | $I^-$ | 1 |
| (18) | $(CH_2)_3SO_3^-$ | " | " | $Na^+$ | 1 |
| (19) | $(CH_2)_4SO_3^-$ | " | $CH_3$ | 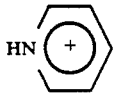 | 1 |
| (20) | $(CH_2)_2-\underset{\underset{CH_3}{\vert}}{CH_2}-SO_3^-$ | " | $OC_2H_5$ | $K^+$ | 1 |
(21)
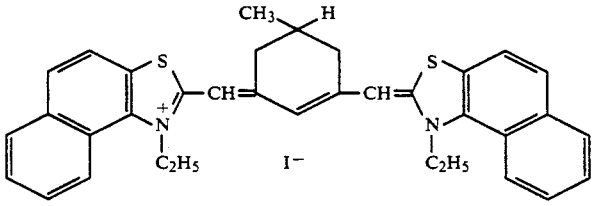
(22)
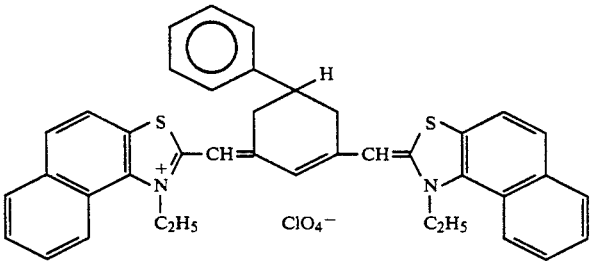
(23)
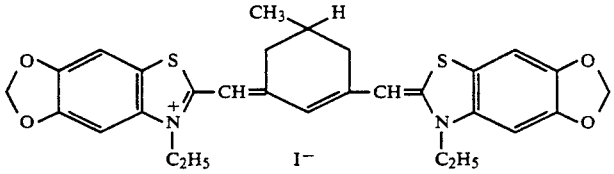
(24)
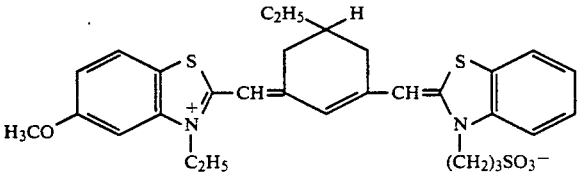
(25)
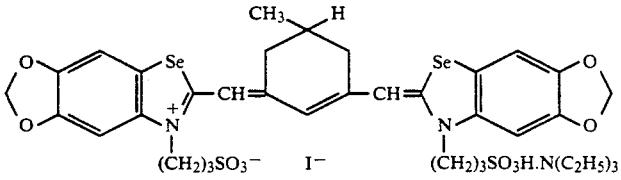

-continued
| No. | $R_1$ | $R_3$ | V | $M_1$ | $m_1$ |
|---|---|---|---|---|---|
| (26) | 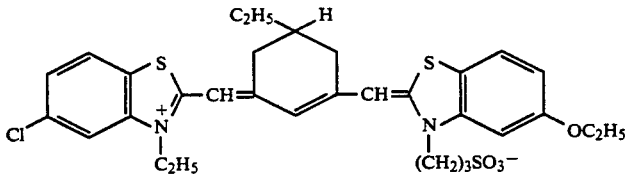 | | | | |
| (27) | 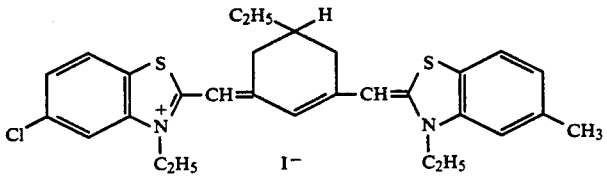 | | | | |
| | 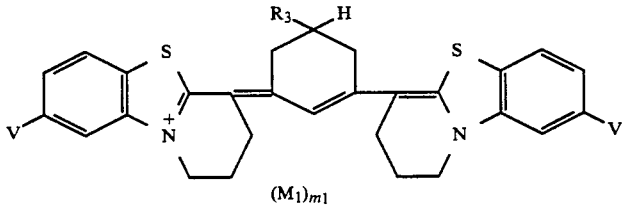 | | | | |
| (28) | | $CH_3$ | H | $I^-$ | 1 |
| (29) | | " | $OCH_3$ | $Cl^-$ | 1 |
| (30) | | " | $OC_2H_5$ | $ClO_4^-$ | 1 |
| (31) | | " | Cl | $Br^-$ | 1 |
| (32) | | " | $CH_3$ | $I^-$ | 1 |
| (33) | | $C_2H_5$ | $OCH_3$ | $I^-$ | 1 |
| (34) | | $^nCH_3$ | $OC_2H_5$ | $I^-$ | 1 |
| (35) | | Ph | H | $ClO_4^-$ | 1 |
| (36) | | " | $OCH_3$ | $ClO_4^-$ | 1 |
| (37) | | " | $OC_2H_5$ | 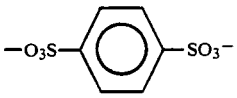 | 1 |
| (38) | | " | Cl | $Br^-$ | 1 |
| (39) | | " | $CH_3$ | $I^-$ | 1 |
| (40) | 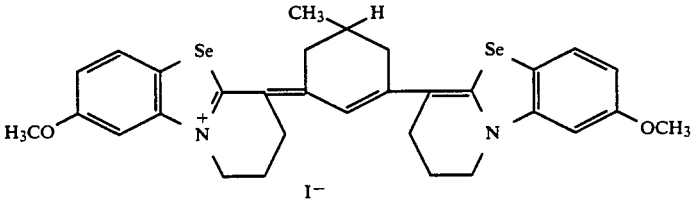 | | | | |
| (41) | 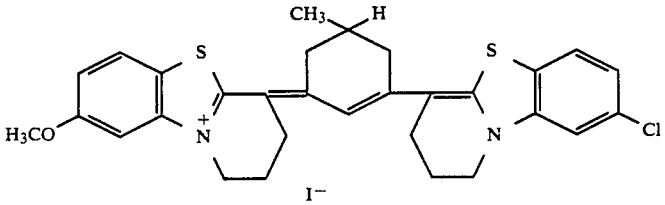 | | | | |

-continued

| No. | $R_1$ | $R_3$ | V | $M_1$ | $m_1$ |
|---|---|---|---|---|---|
| (42) | 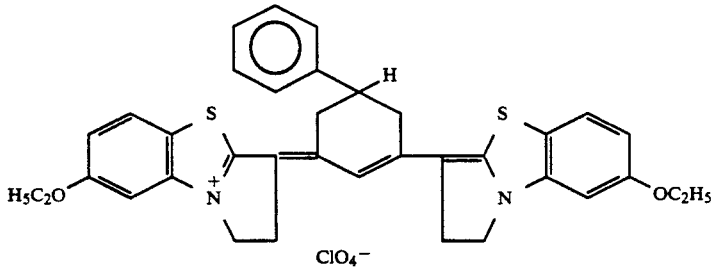 | | | | |
| (43) | 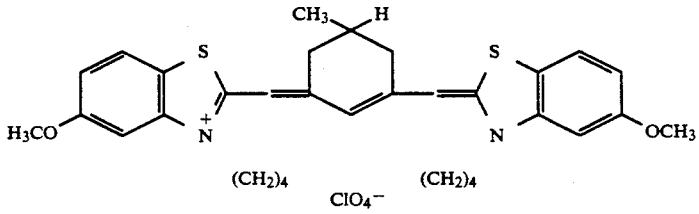 | | | | |
| (44) | 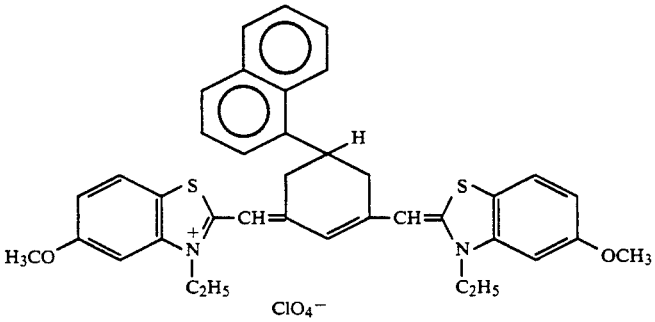 | | | | |
| (45) | 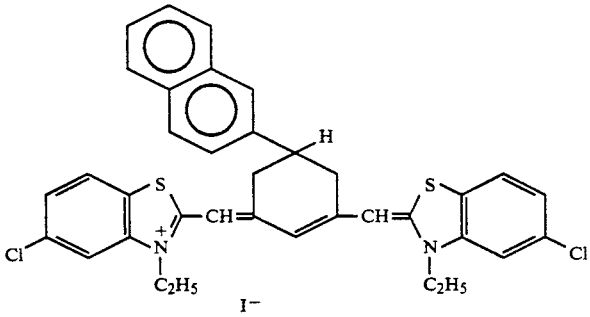 | | | | |

Dyes represented by the general formula (I) can be synthesized by the techniques of the following literatures:

a) F. M. Hamer, *Heterocyclic Compounds-Cyanine Dyes and Related Compounds*, John Wiley & Sons, New York and London (1964); and b) D. M. Sturmer, *Heterocyclic Compounds-Special Topics in Heterocyclic Chemistry*, chapter 8, paragraph 4, pages 482–515, John & Wiley, New York and London (1977).

In addition to the dyes of general formula (I), spectral sensitizing dyes which can be used in this invention include cyanine dyes, merocyanine dyes, complex merocyanine dyes, and so on. Further, complex cyanine dyes, holopolar cyanine dyes, hemicyanine dyes, styryl dyes and hemioxonol dyes may be used. The cyanine dyes include simple cyanine dyes, carbocyanine dyes, dicarbocyanine dyes and tricarbocyanine dyes.

The silver halide light-sensitive layers of this invention, preferably at least one among three kinds of light-sensitive layers, are each subjected to selective spectral sensitization so as to correspond to light flux of wavelengths longer than 730 nm by using at least one sensitizing dye selected from among the compounds represented by general formula (I).

The expression "selective spectral sensitization" as used in this invention means that when spectral sensitization is carried out so that the material is suited to a light flux having a main wavelength longer than 730 nm, the sensitivities at the main wavelength of the light flux which are gained by the light-sensitive layers other than the main object of the spectral sensitization are lower by at least 0.8 (expressed in logarithm) than the sensitivity at the main wavelength which is gained by the light-sensitive layer primarily intended to undergo the spectral sensitization. In order to meet this requirement, the main sensitivity wavelength (spectral sensitivity maximum wavelength) of each light-sensitive layer should be set so as to be separate by at least 40 nm, although it depends on the main wavelengths of light fluxes used, from neighboring main sensitivity wavelength(s). Therein, sensitizing dyes which each impart high sensitivity at the main wavelength of the light flux to be used and show a sharp spectral sensitivity distribution curve are adopted. The reason for using the term "main wavelength" is that it is necessary to allow some latitude in the wavelength of the light flux used since laser beams and LED light show fluctuations in wavelengths.

In addition, it is desirable that the spectral sensitivity distribution should be corrected by providing a colloid layer colored by including therein a proper dye on the upper side of the light-sensitive layer in question. This colored layer is effective in prevention of color stain through filter effect.

Sensitizing dyes, other than those of general formula (I), are contained in the silver halide photographic emulsions used in this invention in amounts of from $5\times10^{-7}$ to $5\times10^{-3}$ mole, preferably from $1\times10^{-6}$ to $1\times10^{-3}$ mole, particularly preferably from $2\times10^{-6}$ to $5\times10^{-4}$ mole, per mole of silver halide.

Sensitizing dyes used in this invention (including those of general formula (I)) can be dispersed directly into an emulsion. Also, they can be first dissolved in an appropriate solvent, such as methyl alcohol, ethyl alcohol, methyl cellosolve, acetone, water, pyridine or a mixture of two or more thereof, and then added to an emulsion. To dissolve sensitizing dyes, ultrasonic waves can be used. Further, there are many other processes which can be adopted for adding sensitizing dyes. Examples thereof include one process disclosed, e.g., in U.S. Pat. No. 3,469,987, which comprises dissolving a sensitizing dye in a volatile organic solvent, dispersing the resulting solution into a hydrophilic colloid, and adding the thus obtained dispersion to an emulsion; another process disclosed in J-B-46-24185 which comprises dispersing a water-insoluble dye into an aqueous solvent without dissolving it, and adding the resulting dispersion to an emulsion; a further process disclosed in U.S. Pat. No. 3,822,135 which comprises dissolving a sensitizing dye in a surface active agent, and adding the resulting solution to an emulsion; still another process disclosed in JP-A-51-74624 which comprises dissolving a sensitizing dye with the aid of a red shift compound, and adding the resulting solution to an emulsion; and another process disclosed in JP-A-50-80826 which comprises dissolving a sensitizing dye into a substantially water-free acid, and adding the resulting solution to an emulsion. Furthermore, processes disclosed in U.S. Pat. Nos. 2,912,343, 3,342,605, 2,996,287 and 3,429,835 can be also employed for the addition of a sensitizing dye to an emulsion.

As for the addition time of the above-described sensitizing dyes, they may be dispersed homogeneously into a silver halide emulsion anytime before the emulsion is coated on an appropriate support. Preferably, they are added to a silver halide emulsion before the emulsion undergoes chemical sensitization, or during the latter half of the grain formation.

Silver halide emulsions which can be used in this invention may be those containing any of silver bromide, silver iodobromide, silver chlorobromide and silver chloride.

Silver halide grains contained therein may have a regular crystal form, such as that of a cube, an octahedron, a tetradecahedron or a rhombic dodecahedron; an irregular crystal form, such as that of a sphere, a tablet or so on; or a composite form thereof. Also, they may be a mixture of silver halide grains having various crystal forms.

As for the tabular grains cited above, it is desirable in this invention that a proportion of grains having a thickness of below 0.5 micron, preferably below 0.3 micron, a diameter of preferably at least 0.5 micron, and an average aspect ratio of at least 5 should be at least 50%, based on the projected area, of the whole grains present in an emulsion.

The interior and the surface of the silver halide grains may differ or the silver halide grains may be uniform throughout. Further, either silver halide grains of the kind which form latent images predominantly at the surface of the grains (e.g., negative emulsions), or grains of the kind which mainly form latent image inside the grains (e.g., internal latent-image type emulsions) can be used.

Now, silver halide emulsions which are favored in this invention are described in detail.

Silver halide emulsions according to this invention can gain a high sensitivity and an excellent keeping quality thereof, especially a high stability of the latent image, by spectral sensitization, particularly when the silver halide grains therein assume a certain structure, especially such a structure as to have a localized phase at the surface. Even in an emulsion which has a high chloride content and is spectrally sensitized in combination with a supersensitizer, the latent image formed can be stabilized to an allowable extent. It can be said that these effects are a surprising feature of this invention.

The favored halide compositions of the silver halide grains of this invention are substantially iodide-free silver chlorobromides in which at least 95 mol. % of the whole halide constituting the grains is chloride. The expression "substantially iodide-free" as used herein means that the iodide content is below 1.0 mol. %. More preferred silver halide emulsion grains are substantially iodide-free silver chlorobromides in which from 95 mol. % to 99.9 mol. % of the whole halide constituting the grains is chloride.

Further, it is desirable that the silver halide grains of this invention should have a localized phase which differs in bromide content from the substrate at least either inside or surface of each grain. More specifically, it is to be desired that the localized phase formed in the silver halide grains of this invention should have a bromide content of more than 15 mol. %. The localized phase higher in bromide content than its surroundings can be disposed freely provided that the purpose in forming such a phase can be accomplished. That is, it may be disposed on the inside or on the surface or subsurface of the silver halide grains, or it may be shared by the interior and the surface or subsurface of the grains. On the inside or on the surface or subsurface of the grains, the localized phase may form a layer covering concentrically the core of the grains, or may be subdivided so as to form an isolated island structure. A favorable example of the disposition of a localized phase having a higher bromide content than its surroundings is a localized phase which has a bromide content more than 15 mol. %, formed locally on the surface of the silver halide grains through epitaxial growth.

Though it is desirable that a bromide content of said localized phase should exceed 15 mol. %, too high a bromide content is occasionally responsible for desensitization when pressure is applied to the sensitive materials and sometimes imparts undesirable characteristics to the photographic materials. For instance, when a photographic material has a too high a bromide content, the sensitivity and the gradation thereof become highly susceptible to a change in the composition of the processing solution used. Taking into account these factors, a particularly favorable bromide content in the localized phase is from 20 to 60 mol. %. The optimal halide composition in the localized phase is 30–50 mol. % bromide and the remainder chloride.

The bromide content in the localized phase can be analyzed, e.g., by X-ray diffraction (as described, e.g., in *Shin-Jikken Kaqaku Koza* 6, *Kozo Kaiseki* (which means "New Course in Experimental Chemistry, the lecture 6, Structural analyses"), compiled by the Japanese Chemical Society, published by Maruzen) or by the XPS method (X-ray Photoelectron Spectroscopy) (as described, e.g., in *Hyomen Bunseki —IMA, Auqer denshi, kodenshi bunko no oyo*—(which means "Surface Analyses—Application of IMA, Auger Electron and Photoelectron Spectroscopies—"), published by Kodansha). The silver ions in the localized phase comprises 0.1–20%, preferably 0.5–7%, of all the silver ions constituting the silver halide grains of this invention.

The interface between the localized phase higher in bromide content and an adjacent phase may have a clear phase boundary, or a short dislocation range in which the halide composition varies gradually.

Various methods can be used for the formation of such localized phase as described above. Specifically, a water-soluble silver salt is made to react with a water-soluble halide using a single jet method or a double jet method to form a localized phase. Also, a localized phase can be formed by a so-called conversion process involving the step of converting the previously formed silver halide to a different silver halide having a smaller solubility product. Moreover, the localized phase can be formed by adding fine grains of silver bromide and recrystallizing them on the surface of silver chloride grains, too.

When silver halide grains have localized phases isolated from one another at the grain surface, the grain substrate and the localized phases are present on the same surface in a substantial sense, so that they can function simultaneously in each process, including the exposure and development steps. Consequently, such a disposition of the localized phases is advantageous to this invention for increasing sensitivity, forming a latent image, performing rapid processing, adjusting gradation balance, and raising the efficiency of silver halide. The points in question arising in sensitizing a silver halide emulsion having a high chloride content in the infrared region, as the objects of this invention, which include the acquisition of high sensitivity, stabilization of sensitivity and improvement in the stability of latent image, can be totally improved to a remarkable extent by providing silver halide grains with the foregoing localized phase. In addition, the characteristics of silver chloride emulsion which are exhibited in rapid processing can be ensured.

Moreover, the substrate and the localized phase of each grain can be absorbed by an antifoggant, a sensitizing dye or the like so that they respectively perform functions of these additives and, moreover, can undergo chemical sensitization so as to suppress the generation of fog, whereby rapid development can be facilitated.

It is desirable that the silver halide grains of this invention should have a hexahedral, tetradecahedral or like crystal shape having (100) surfaces, and the localized phases should be located on the corners of a hexahedron or in the vicinity thereof, or on the surface part of (111) faces. Such localized phases present in isolation on the surface of each silver halide grain can be formed by supplying a bromine ion to the emulsion containing substrate grains while controlling pAg, pH, temperature and time to bring about halogen conversion. Therein, it is desirable that the halogen ion should be supplied in a very low concen-tration. For instance, the halogen ion can be supplied using an organohalogen compound and a halogen compound encapsulated in a semi-permeable film.

Also, "the localized phases" can be formed by supplying both silver ion and halogen ion to an emulsion containing substrate grains while controlling the pAg in the emulsion to make silver halide crystal grow locally, or by mixing an emulsion containing substrate grains with silver halide grains smaller in size than the substrate grains, e.g., fine grains of silver iodobromide, silver bromide, silver chlorobromide or silver iodochlorobromide to cause recrystallization. In this case, a small amount of silver halide solvent can be added to the emulsion, if desired.

In addition, CR compounds disclosed in European Patents 273,430 and 273,429, JP-A-1-6941, and Japanese Patent Application Nos. 62-86163, 62-86165, and 62-152330 can be present in the emulsion. The end point of formation of the localized phases can be judged easily by observing the shape of silver halide grains during the course of ripening in comparison with the shape of substrate grains. The composition of silver halides which constitute such localized phases can be determined by the XPS method (X-ray Photoelectron Spectroscopy) using, e.g., an ESCA spectrometer Model 750, made by Shimazu-Du Pont Co. The details of the XPS method appear in a book written by Someno et al, entitled Hyomen Bunseki (which means "Surface Analysis") and published by Kodansha in 1977. Of course, it can also be estimated by calculations based on the production formula. The composition of silver halides which constitute the localized phases present at the grain surface in accordance with this invention, e.g., the bromide content therein can be determined to a precision of about 5 mol. % by the EDX method (Energy Dispersive X-ray Analysis) using an EDX spectrometer mounted in a transmission electron microscope with an aperture having a diameter of about 0.1 to 0.2 μm. The details of the EDX method appear in a book written by Hiroyoshi Soezima, entitled Denshisen Maikuroanalisisu (which means "Electron-Beam Microanalyses") and published by Nippon Kogyo Shinbunsha in 1987.

The average size of the silver halide grains contained in the silver halide emulsions to be used in this invention (the average grain size herein refers to the average diameter of the spheres having the same volume as the grains) ranges preferably from 0.1 to 2 μ, and particularly preferably from 0.15 to 0.4 μ.

As for the distribution of sizes among grains, a so-called monodisperse emulsion, especially a monodisperse emulsion whose grains have a regular crystal form, is favored in this invention. More specifically, emulsions in which at least 85%, particularly at least 90%, of the whole grains have their individual sizes within the range of ±20% of the number or weight average grain size are preferred.

The silver chlorobromide emulsions to be used in this invention can be prepared using methods described in, for example, P. Glafkides, *Chemie et Phisique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964). Specifically, any processes including an acid process, a neutral process, an ammoniacal process and so on may be employed.

Suitable methods for reacting a water-soluble silver salt with a water-soluble halide include, e.g., a single jet method, a double jet method, or a combination thereof. In order to obtain monodisperse emulsion grains preferred in this invention, a double jet method is used to advantage. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes, which is a monodisperse emulsion well-suited for this invention, can be obtained. Therefore, it is desired that the foregoing grains used favorably in this invention should be prepared by a controlled double jet method.

Further, physical ripening carried out in the presence of a known silver halide solvent (e.g., ammonia, potassium thiocyanate, and thioethers or thione compounds as disclosed in U.S. Pat. No. 3,271,157, JP-A-51-12360, JP-A-53-82408, JP-A-53-144319, JP-A-54-100717 or JP-A-54-155828) is effective in preparing a monodisperse silver halide emulsion having a regular crystal form and a narrow distribution of grain sizes.

In order to remove soluble silver salts from the physically ripened emulsion, a noodle washing method, a floccule sedimentation method, a ultrafiltration method or so on can be used.

The silver halide emulsions to be used in this invention can be chemically sensitized using a sulfur or selenium sensitization process, a reduction sensitization process and a sensitization process utilizing a noble metal compound, individually or in a combination thereof.

The photographic emulsion of this invention can contain a wide variety of compounds for the purpose of preventing fog or stabilizing photographic functions during production, storage, or photographic processing. Specifically, a great number of compounds known as antifoggants or stabilizers, including azoles such as the benzothiazolium salts disclosed in U.S. Pat. Nos. 3,954,478 and 4,942,721, JP-B-59-191032 and so on, ring cleavage products of azoles disclosed in JP-B-59-26731, nitroindazoles, triazoles, benzotriazoles and benzimidazoles (especially nitro- or halogen-substituted azoles); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; the above-cited heterocyclic mercapto compounds containing a water-soluble group such as a carboxyl group, a sulfo group or the like; thioketone compounds such as oxazolinethione; azaindenes such as tetraazaindenes (especially 4-hydroxy substituted 1,3,3a,7-tetraazaindene); benzenethiosulfonic acids; benzenesulfinic acid; and so on, can be added for the foregoing purpose.

Output mechanisms of luminous flux which can be used in this invention are described below in detail.

As for the laser which can be used in this invention, a semiconductor laser is preferred. Specific examples of the semiconductor laser include those utilizing such materials as $In_{1-x}Ga_xP$ (shorter than 700 nm), $GaAs_{1-x}Px$ (610–900 nm), $Ga_{1-x}Al_xAS$ (690–900 nm), InGaAsP (1100–1670 nm), AlGaAsSb (1250–1400 nm) and the like. In addition to the various kinds of the semiconductor laser cited above, a YAG laser (1064 nm) which consists of excitation of Nb:YAG crystal with a $GaAs_xP_{1-x}$ light emission diode may be used for the infrared irradiation of color photographic materials of this invention. Luminous flux with which the color photographic materials according to this invention can be preferably irradiated may be selected from among semiconductor laser beams having wavelengths of 670 nm. 680 nm. 750 nm, 780 nm, 810 nm, 830 nm and 880 nm, respectively.

Additionally, a second harmonic wave generating element (abbreviated as a SHG element)" which can be used in this invention includes elements capable of converting the wavelength of a laser beam to one-half of it by application of a nonlinear optical effect. Specific examples include those utilizing as a nonlinear optical crystal CD*A and KD*P, respectively (see descriptions on pages 122–139 in Laser Handbook, compiled by Laser Society, published on the 15th of December in 1982). Moreover, a $LiNbO_3$ light wave guide element in which a light wave guide is formed inside the $LiNbO_3$ crystal by exchanging $Li^+$ for $H^+$ (*NIKKEI ELECTRONICS*, No. 399, pages 89–90 (14.7.'86) can be used.

Also, the output apparatus disclosed in JP-A-02-74942 can be used in this invention.

In the photographic processing of photographic materials prepared in accordance with this invention, known processes (for color photographic processing) and processing solutions for forming dye images, as described in *Research Disclosure*, No. 176, pages 28–30 (RD-17643), can be adopted.

Now, color photographic processing steps which can be preferably applied to the photographic materials of this invention and suitable examples of processing solutions used therein are described below in detail.

The color photographic light-sensitive material of this invention is preferably subjected to color development, bleach-fix and washing (or stabilization) processing steps. However, bleach and fixation steps may not be carried out with a monobath, but may be carried out separately.

A color developer which can be used in this invention contains a known aromatic primary amine color developing agent. Those preferred as such a color developing agent include p-phenylenediamine derivatives. Typical representatives of p-phenylenediamine derivatives are described below. However, the invention should not be construed as being limited to these compounds:

(D-1) N,N-diethyl-p-phenylenediamine,
(D-2) 2-amino-5-diethylaminotoluene,
(D-3) 2-amino-5-(N-ethyl-N-laurylamino)toluene, (D-4) 4-[N-ethyl-N-(β-hydroxyethyl)amino]aniline,
(D-5) 2-methyl-4-[N-ethyl-N-(β-hydroxyethyl-)amino]aniline,
(D-6) 4-amino-3-methyl-N-ethyl-N-[β-(methanesulfonamido)ethyl]aniline,
(D-7) N-(2-amino-5-diethylaminophenylethyl)methanesulfonamide,
(D-8) N,N-dimethyl-p-phenylenediamine,
(D-9) 4-amino-3-methyl-N-ethyl-N-methoxyethylaniline,
(D-10) 4-amino-3-methyl-N-ethyl-N-β-ethoxyethylaniline,
(D-11) 4-amino-3-methyl-N-ethyl-N-β-butoxyethylaniline.

Among the above-cited p-phenylenediamine derivatives, 4-amino-3-methyl-N-ethyl-N-[β-(methanesulfonamido)ethyl]aniline (D-6) is particularly favored over the others.

These p-phenylenediamine derivatives may assume the form of salt, such as a sulfate, hydrochloride, sulfite or p-toluenesulfonate. The suitable addition amount of the aromatic primary amine developing agent is from about 0.1 g to about 20 g, preferably from about 0.5 g to about 10 g, per 1 l of developer.

In embodying this invention, it is desired that the developer to be used not contain benzyl alcohol in a substantial sense. The expression "not contain benzyl alcohol in a substantial sense" used herein is intended to include the cases where benzyl alcohol is contained in a concentration of 2 ml/l or less, more preferably 0.5 ml/l or less. In the most preferred case, benzyl alcohol is not present at all.

It is more desirable that the developer to be used in this invention should not contain, in a substantial sense, sulfite ion. The sulfite ion has not only a function as a preservative for a developing agent, but also dissolves silver halides and lowers dye-forming efficiency by reaction with an oxidized developing agent. These functions are presumed to be one of causes for an increase in fluctuation of photographic characteristics, which accompanies continuous processing. The expression "not contain in substantial sense" as used herein means that sulfite ion may be present in a concentration of $3.0\times10^{-3}$ mol/l or less and, most preferably, the sulfite ion is not present at all. In this invention, however, the slight quantity of sulfite ion which is used for preventing the oxidation of a processing kit which contains a developing agent in a concentrated condition before practical use is ruled out.

It is to be desired, as described above, that the developer to be used in this invention should not contain, in a substantial sense, sulfite ion, and it is more desirable that the developer not contain, in a substantial sense, hydroxylamine also. This is true because a variation in hydroxylamine concentration is supposed to produce a great influence upon photographic characteristics since hydroxylamine itself has an activity in silver development, as well as functioning as a preservative. The expression "not contain hydroxylamine in a substantial sense" as used herein is intended to include cases where the hydroxylamine is in a concentration of $5.0\times10^{-3}$ mol/l or less. In particular, the case where hydroxylamine is not present at all is preferred over others.

It is much more desired that the developer to be used in this invention should contain organic preservatives in place of the above-described hydroxylamine and sulfite ion.

The term organic preservatives refers to all organic compounds which can decrease deterioration speed of aromatic primary amine color developing agents by addition to a processing solution for color photographic materials. More specifically, such compounds include those which prevent color developing agents from suffering aerial oxidation or the like. Examples of especially effective organic preservatives include hydroxylamine derivatives (excluding hydroxylamine), hydroxamic acids, hydrazines, hydrazides, phenols, α-hydroxyketones, α-aminoketones, sugars, monoamides, diamines, polyamines, quaternary ammonium salts, nitroxyl radicals, alcohols, oximes, diamide compounds, condensed ring type amines and the like. Specific examples of these preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, JP-B-48-30496, and so on.

As other preservatives, various metals disclosed in JP-A-57-44148 and JP-A-57-53749, salicylic acids disclosed in JP-A-59-180588, alkanolamines disclosed in JP-A-54-3532, polyethyleneimines disclosed in JP-A-56-94349, aromatic polyhydroxy compounds disclosed in U.S. Pat. No. 3,746,544, and so on may be added, if needed. In particular, the addition of alkanolamines such as triethanolamine, dialkylhydroxylamines such as diethylhydroxylamine, hydrazine derivatives or aromatic polyhydroxy compounds is favored.

Among the above-cited organic preservatives, hydroxylamine derivatives and hydrazine derivatives (including hydrazines and hydrazides) are particularly preferred over others, and the details of these derivatives are described in JP-A-1-97953, JP-A-1-186939, JP-A-1-186940 and JP-A-1-187557, and so on.

Further, the combined use of the above-described hydroxylamine or hydrazine derivatives and amines offers a greater advantage in view of the enhancement of stability of a color developer and the enhancement of steadiness upon continuous processing.

Examples of amines to be used for the foregoing purpose include the cyclic amines disclosed in JP-A-63-239447, amines disclosed in JP-A-63-128340, and other amines disclosed in JP-A-01-186939 and JP-A-01-187557.

It is desirable in this invention that the color developer should contain chlorine ion in a concentration of from $3.5\times10^{-2}$ to $1.5\times10^{-1}$ mol/l, particularly preferably from $4\times10^{-2}$ to $1\times10^{-1}$ mol/l. When the chlorine ion concentration is increased beyond $1.5\times10^{-1}$ mol/l, the chlorine ion retards development. Therefore, such a high chlorine ion concentration is undesirable with respect to rapid attainment of high maximum density, which is one of the objects of this invention. On the other hand, chlorine ion concentrations less than $3.5\times10^{-2}$ mol/l are undesirable from the viewpoint of prevention of fog.

It is also desirable in this invention that the color developer should contain bromine ion in a concentration of from $3.0\times10^{-5}$ to $1.0\times10^{-3}$ mol/l, preferably from $5.0\times10^{-5}$ to $5\times10^{-4}$ mol/l. When the bromine ion concentration is higher than $1.0\times10^{-3}$ mol/l, development is retarded, and further the maximum density and the sensitivity are lowered, whereas when it is lower than $3.0\times10^{-5}$ mol/l, generation of fog cannot be prevented satisfactorily.

Herein, chlorine ion and bromine ion may be added directly to a developer, or eluted from light-sensitive materials with a developer during development-processing.

In case of direct addition to a color developer, substances which can be used for supplying chlorine ion include sodium chloride, potassium chloride, ammonium chloride, lithium chloride, nickel chloride, magnesium chloride, manganese chloride, calcium chloride, and cadmium chloride. Among these salts, sodium chloride and potassium chloride are preferred over the others.

Also, chlorine ion may be supplied from a brightening agent added to a developer.

Substances which can be used for supplying bromine ion include sodium bromide, potassium bromide, ammonium bromide, lithium bromide, calcium bromide, magnesium bromide, manganese bromide, nickel bromide, cadmium bromide, cerium bromide and thallium bromide. Among these salts, potassium bromide and sodium bromide are preferred over the others.

In case of the elution from light-sensitive materials during development, both chlorine and bromine ions may be supplied from silver halide emulsions, or others.

A color developer which can be used in this invention is preferably adjusted to a pH of 9–12, particularly a pH of 9–11.0. To the color developer can be added other compounds known as developer components.

In order to maintain the pH of the color developer constant in the above-described range, it is desired that various pH buffers be used. Suitable examples of pH buffers which can be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, and so on. Among these salts, carbonates, phosphates, tetraborates and hydroxybenzoates are particularly favored over the others because they are excellent in solubility and buffer capacity in such a high pH region above 9.0, do not have any adverse effect on photographic properties (e.g., causing fog) when added to a color developer, and are not expensive.

Specific examples of these buffers include sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate, (sodium 5-sulfosalicylate), potassium 5-sulfo-2-hydroxybenzoate (potassium 5-sulfosalicylate), and so on. However, buffers which can be used in this invention should not be construed as being limited to these compounds.

It is desirable that the foregoing buffers should be added to a color developer in a concentration of 0.1 mol/l or above, particularly from 0.1 to 0.4 mol/l.

In addition, various kinds of chelating agents can be used in the color developer as a suspending agent for calcium and magnesium ions, or for the purpose of heightening the stability of the color developer. Examples of a chelating agent used for such purposes include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycoletherdiaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and so on.

Two or more of these chelating agents may be used together, if desired.

These chelating agents are added in an amount enough to block metal ions in the color developer. For example, the addition thereof in an amount of from about 0.1 to about 10 g per liter of the color developer will suffice for blocking metal ions.

To the color developer, any development accelerator can be added, if needed.

The development accelerators include thioether compounds disclosed in JP-B-37-16088, JP-B-37-5987, JP-B-38-7826, JP-B-44-12380, JP-B-45-9019 and U.S. Pat. No. 3,813,247, p-phenylenediamine compounds disclosed in JP-A-52-49829 and JP-A-50-15554, quaternary ammonium salts disclosed in JP-A-50-137726, JP-B-44-30074, JP-A-56-156826 and JP-A-52-43429, amine compounds disclosed in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides disclosed in JP-B-37-16088, JP-B-42-25201, U.S. Pat. Nos. 3,128,183, JP-B-41-11431, JP-B-42-23883 and U.S. Pat. No. 3,532,501, 1-phenyl-3-pyrazolidones, imidazoles and so on.

Any antifoggant can be used in this invention. Suitable antifoggants include alkali metal halides such as sodium chloride, potassium bromide, potassium iodide and the like, and organic antifoggants. Typical representatives of organic antifoggants which can be used are nitrogen-containing heterocyclic compounds, with specific examples including benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

In the color developers suitable for this invention, a brightening agent can be preferably included. As the brightening agent, 4,4'-diamino-2,2'-disulfostilbene compounds are used to advantage. These compounds are added in an amount of from 0 to 5 g, preferably from 0.1 to 4 g, per liter of the color developer.

Further, various kinds of surfactants, such as alkylsulfonic acids, arylsulfonic acids, aliphatic carboxylic acids and aromatic carboxylic acids, may be added, if desired.

The processing temperature of the color developer applicable to this invention ranges from 20° to 50° C., preferably from 30° to 40° C. The processing time is within the range of 20 sec. to 5 min., preferably 30 sec. to 2 min. Though it is desirable to use a replenisher in the possible least amount, the amount to be used is appropriately in the range of 20 to 600 ml, preferably 50 to 300 ml, more preferably 60 to 200 ml, and most preferably 60 to 150 ml, per $m^2$ of the light-sensitive material processed.

Then, a desilvering processing applicable to this invention is described below. In general, the desilvering processing may consist of any steps, e.g., the combination of bleach and fixation steps, that of fixation and bleach-fix steps, that of bleach and bleach-fix steps, a bleach-fix step alone, or so on.

A bleaching bath, a bleach-fix bath and a fixer which are applicable to this invention are described below.

Any bleaching agent can be used in a bleaching or bleach-fix bath. In particular, complex salts of Fe(III) and organic acids (e.g., aminopolycarboxylic acids, such as ethylenediaminetetraacetic acid, diethylenetriaminepentaacetic acid, etc., aminopolyphsophonic acids, phosphonocarboxylic acids, organic phosphonic acids, and other organic acids such as citric acid, tartaric acid, malic acid, etc.); persulfates; hydrogen peroxide; and so on can be preferably used.

Among these bleaching agents, organic complex salts of Fe(III) are particularly favored for rapid processing and preventing environmental pollution. Examples of aminopolycarboxylic acids, aminopolyphosphonic acids, organic phosphonic acids, and salts thereof, which are useful for forming organic complex salts of Fe(III), include ethylenediaminetetraacetic acid, diethylenetriaminepentaacetic acid, 1,3-diaminopropanetetraacetic acid, prolylenediaminetetraacetic acid, nitrilotriacetic acid, cyclohexanediaminetetraacetic acid, methyliminodiacetic acid, iminodiacetic acid, glycoletherdiaminetetraacetic acid, and so on. These acids may assume any salt form including those of sodium salt, potassium salt, lithium salt and ammonium salt. Of these compounds, Fe(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred over others because of their high bleaching power. These ferric ion complexes may be used in the form of the complex salt itself, or may be formed in a processing bath by adding thereto both ferric salt, e.g., ferric sulfate, ferric chloride, ferric nitrate, ammonium ferric sulfate, ferric phosphate or the like, and chelating agent, such as an aminopolycarboxylic acid, an aminopolyphosphonic acid, a phosphonocarboxylic acid, etc. Moreover, such chelating agents may be used in excess of the amount required for formation of their ferric ion complex salts. Among the ferric ion complexes, aminopolycarboxylic acid-Fe(III) complex salts are preferred, and they are added in an amount of from 0.01 to 1.0 mole, particularly from 0.05 to 0.50 mole, per liter of the processing bath.

In a bleaching bath, a bleach-fix bath and/or a prebath thereof, various compounds can be used as the bleach accelerator. For example, the compounds containing a mercapto group or a disulfido linkage, as disclosed in U.S. Pat. No. 3,893,858, German Patent 1,290,812, JP-A-53-95630 and Research Disclosure, No. 17129 (July, 1978), thiourea compounds as disclosed in JP-B-45-8506, JP-A-52-20832, JP-A-53-32735 and U.S. Pat. No. 3,706,561, or halides such as iodine ion, bromine ion, and the like are favored for superiority in bleaching power.

In addition, rehalogenating agents, such as bromides (e.g., potassium bromide, sodium bromide, ammonium bromide), chlorides (e.g., potassium chloride, sodium chloride, ammonium chloride), iodides (e.g., ammonium iodide) or the like, can be contained in a bleaching or bleach-fix bath applicable to this invention. Moreover, a pH buffering combination constituted by one or more of an inorganic or organic acid, and an alkali metal or ammonium salt thereof, with specific examples including borax, sodium metaborate, acetic acid, sodium acetate, sodium carbonate, potassium carbonate, phosphorous acid, phosphoric acid, sodium phosphate, citric acid, sodium citrate, tartaric acid and so on; a corrosion inhibitor such as ammonium nitrate, guanidine, etc.; and so on can be added, if desired.

A fixing agent used in a bleach-fix bath or a fixer includes the known agents, or water-soluble silver halide solvents such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol) and thioureas. These compounds can be used alone or as a mixture of two or more thereof. Also, a special bleach-fix bath comprising a combination of the fixing agent disclosed in JP-A-55-155354 and a large quantity of halide such as potassium iodide can be employed. In this invention, the use of a thiosulfate, especially ammonium thiosulfate, as a fixing agent is favored. The amount of the fixing agent used per liter of processing bath ranges preferably from 0.3 to 2 moles, and more preferably from 0.5 to 1.0 mole. The suitable pH region of the bleach-fix bath or of the fixer is from 3 to 10, particularly from 5 to 9.

In the bleach-fix bath, various kinds of brightening agents, defoaming agents or surfactants, polyvinyl pyrrolidone and organic solvents such as methanol, and so on can further be included.

It is desired that the bleach-fix bath and the fixer should contain as preservatives, sulfite ion-releasing compounds such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite) and so on. These compounds are added in a concentration of from about 0.02 to about 0.05 mol/l, preferably from 0.04 to 0.40 mol/l, based on the sulfite ion.

As the preservatives, sulfites are generally used, but ascorbic acid, carbonyl-bisulfite adducts, carbonyl compounds, and others may also be added.

Further, buffers, brightening agents, chelating agents, defoaming agents, antimolds and so on may be added, if desired.

After the desilvering processing, which includes fixation, bleach-fix and like steps, washing and/or stabilization processing is, in general, carried out.

The volume of washing water required in the washing step can be set depending on the characteristics of light-sensitive materials to be processed (e.g., on what kinds of couplers are incorporated therein), end-use purposes of the light-sensitive materials to be processed, the temperature of washing water, the number of washing tanks (the number of stages), the direction of the replenishing washing water (as to, e.g., whether the current of water flows in the counter direction, or not), and other various conditions. Of these conditions, the relation between the number of washing tanks and the volume of washing water in the multistage counter current process can be determined according to the methods described in *Journal of the Society of Motion Picture and Television Engineers*, volume 64, pages 248–253 (May 1955). In general, the desirable number of stages in the multistage counter current process is from 2 to 6, especially from 2 to 4.

According to the multistage counter current process, the volume of washing water can be sharply decreased. Specifically, it can be reduced to from 0.5 to less than 1 liter per $m^2$ of the light-sensitive materials processed. Under these circumstances, the effects of this invention are produced remarkably. However, the process has a disadvantage, e.g., in that bacteria which have propagated in the tanks because of an increase in staying time of water in the tanks produce a suspended matter, and the resulting suspending matter sticks to light-sensitive materials processed therein. As a means of solving this problem, the method of lowering calcium and magnesium ion concentrations, as disclosed in JP-A-62-288838, can be employed to great advantage. Further, bactericides such as isothiazolone compounds and thiabendazole compounds disclosed in JP-A-57-8542; chlorine-containing germicides such as sodium salt of chlorinated isocyanuric acid disclosed in JP-A-61-120145; and germicides such as benzotriazoles disclosed in JP-A-61-267761, copper ion, and those described in Hiroshi Horiguchi, *Bohkin Bohbai no Kagaku* (which meas "Antibacterial and Moldproof Chemistry"), Sankyo Shuppan (1986); *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982; and *Bohkin-Bohbazai Jiten* (which means "Thesaurus of Antibacteria and Antimolds"), compiled by Nippon Bohkin Bohbai Gakkai.

In the washing water, surfactants as a draining agent and chelating agents represented by EDTA as a water softener can additionally be used.

Subsequent to the above-described washing step, or directly after the desilvering processing without undergoing any washing step, light-sensitive materials can be processed with a stabilizer. To the stabilizer, compounds having an image stabilizing function, e.g., aldehyde series compounds represented by formaldehyde, buffers for adjusting the processed films to a pH value suitable for stabilization of dyes, and ammonium compounds, are added. Further, the foregoing various germicides and antimolds can be added thereto in order to prevent bacteria from propagating in the stabilizer and to keep the processed light-sensitive materials from getting moldy.

Furthermore, a surfactant, a brightening agent and a hardener can be added, too. In subjecting the light-sensitive material of this invention directly to a stabilization processing without carrying out any washing step, all of known methods as disclosed in JP-A-57-8543, JP-A-58-14834, JP-A-60-220345, and so on can be adopted.

Moreover, chelating agents such as 1-hydroxyethylidene-1,1-diphosphonic acid, ethylenediaminetetramethylenephosphonic acid and the like, and magnesium and bismuth compounds can be used to advantage in the stabilizing bath.

A so-called rinsing solution can likewise be used as washing water or a stabilizing solution to be used after the desilvering processing.

The suitable pH for the washing or stabilization step ranges from 4 to 10, more preferably from 5 to 8. The temperature, though it can be chosen depending on the characteristics and the intended use of the light-sensitive materials to be processed, ranges from 15° C. to 45° C., preferably from 20° C. to 40° C. Though the time can be also arbitrarily chosen, it is more advantageous to finish the washing or stabilization step in a short time from the standpoint of saving processing time. A suitable time ranges from 15 seconds to 1 minute and 45 seconds, more preferably from 30 seconds to 1 minute and 30 seconds. From the standpoint of running cost, reduction of wastes, handling facility, etc., it is more desirable that the washing or stabilization bath should be replenished in a smaller amount.

The desirable amount for the replenishment ranges from 0.5 to 50 times, preferably from 3 to 40 times, the quantity of the processing solution brought from the prebath per unit area of the light-sensitive material. In other words, it is below 1 liter, preferably below 500 ml, per $m^2$ of the light-sensitive material. The replenishment may be carried out either continuously or intermittently.

The solution used in the washing and/or stabilization step can further be used in the prior step. For instance, the overflow of washing water, which is reduced in quantity by adopting a multistage counter current process, is made to flow into a bleach-fix bath arranged as the prebath, and the bleach-fix bath is replenished by a concentrated solution, resulting in the reduction in the quantity of the waste solution.

Cyan, magenta and yellow couplers which can be preferably used in this invention are those represented by the following general formulae (C-I), (C-II), (M-I), (M-II) and (Y):

Formula (C-I)

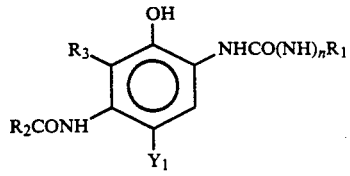

Formula (C-II)

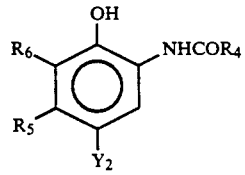

Formula (M-I)

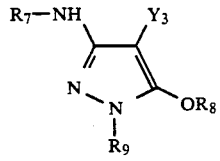

Formula (M-II)

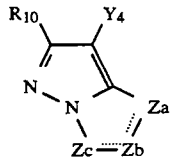

Formula (Y)

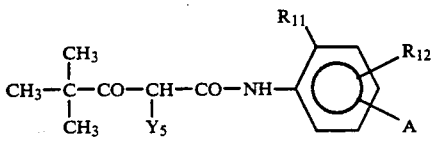

In the above formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group, or an acylamino group; and further, $R_3$ may represent nonmetal atoms to complete a nitrogen-containing 5- or 6-membered ring by combining with $R_2$. The carbon number of $R_1$, $R_2$ and $R_4$ is up to 50. The carbon number of $R_3$ is up to 10. $Y_1$ and $Y_2$ each represents a hydrogen atom, or a group capable of splitting off upon the coupling reaction with the oxidation product of a developing agent. n represents 0 or 1.

$R_5$ in general formula (C-II) is preferably an aliphatic group, with specific examples including methyl, ethyl, propyl, butyl, pentadecyl, tert-butyl, cyclohexyl, cyclohexylmethyl, phenylthiomethyl, dodecyloxyphenylthiomethyl, butanamidomethyl, methoxymethyl, and so on.

Preferred cyan couplers among those represented by the foregoing general formulae (C-I) and (C-II) are described in more detail below.

$R_1$ in general formula (C-I) is preferably an aryl or heterocyclyl group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or/and a cyano group.

When $R_3$ and $R_2$ do not combine with each other for ring formation in the general formula (C-I), $R_2$ is preferably a substituted or unsubstituted alkyl or aryl group, and more preferably a substituted aryloxy-substituted alkyl group, and $R_3$ is preferably a hydrogen atom.

$R_4$ in general formula (C-II) is preferably a substituted or unsubstituted alkyl or aryl group, and particularly preferably a substituted aryloxy-substituted alkyl group.

$R_5$ in general formula (C-II) is preferably an alkyl group containing from 2 to 15 carbon atoms, or a methyl group substituted by a group containing at least one carbon atom, with suitable examples including an arylthio group, an alkylthio group, an acylamino group, an aryloxy group and an alkyloxy group.

In general formula (C-II), $R_5$ is more preferably an alkyl group containing 2 to 15 carbon atoms, especially 2 to 4 carbon atoms.

$R_6$ in general formula (C-II) is preferably a hydrogen atom or a halogen atom, and particularly preferably a chlorine atom or a fluorine atom.

$Y_1$ and $Y_2$ in general formulae (C-I) and (C-II) respectively are preferably a hydrogen atom, a halogen atom, an alkoxy group, an aryloxy group, an acyloxy group or a sulfonamido group.

$R_7$ and $R_9$ in general formula (M-I) are each an aryl group, and $R_8$ therein is a hydrogen atom, an aliphatic or aromatic acyl group, or an aliphatic or aromatic sulfonyl group. $Y_3$ represents a hydrogen atom or a splitting-off group. Substituent groups suitable for the aryl groups represented by $R_7$ and $R_9$ (preferably for phenyl group) include the same ones suitable for $R_1$ When the aryl group has two or more substituent groups, they may be the same or different. $R_8$ is preferably a hydrogen atom, or an aliphatic acyl or sulfonyl group, and particularly preferably a hydrogen atom. In particular, it is desirable that $Y_3$ should be a splitting-off group of the type which contains a sulfur, oxygen or nitrogen atom at the splitting-off site, especially one which contains a sulfur atom at the splitting-off site, as disclosed in U.S. Pat. No. 4,351,897 and WO 88/04795.

In the general formula (M-II), $R_{10}$ represents a hydrogen atom or a substituent group. $Y_4$ represents a hydrogen atom or a splitting-off group, and particularly preferably a halogen atom or an arylthio group. Za, Zb and Zc each represents an unsubstituted or substituted methine group, =N— or —NH—, provided that either the Za—Zb bond or the Zb—Zc bond is a double bond, and the other is a single bond. When the Zb—Zc bond is a C—C double bond, it may constitute a part of the aromatic ring. The compound represented by the general formula (M-II) may form a dimer or a higher polymer via $R_{10}$ or $Y_4$, or a substituted methine group when Za, Zb or Zc represents such a group.

Among the pyrazoloazole type couplers represented by the general formula (M-II), the imidazo[1,2-bypyrazoles disclosed in U.S. Pat. No. 4,500,630 are preferred in view of the low yellow side-absorption of the developed dyes and light fastness thereof, and the pyrazolo[1-5b][1,2,4]triazoles disclosed in U.S. Pat. No. 4,540,654 are especially favored for those reasons.

In addition, there can be preferably employed pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfonamido group in a molecule, as disclosed in JP-A-61-65246; pyrazoloazole type couplers which contain an alkoxyphenylsulfonamido group as a ballast group, as disclosed in JP-A-61-147254; and pyrazolotriazole type couplers in which the 6-position is substituted by an alkoxy or aryloxy group, as disclosed in European Patents (laid open) 226,849 and 294,785.

In general formula (Y), $R_{11}$ represents a halogen atom, an alkoxy group, a trifluoromethyl group, or an aryl group; $R_{12}$ represents a hydrogen atom, a halogen atom, or an alkoxy group; A represents $—NHCOR_{13}$, $—NHSO_2—$ $R_{13}$, $—SO_2NHR_{13}$, $—COOR_{13}$, or $—SO_2NR_{13}R_{14}$ (wherein $R_{13}$ and $R_{14}$ each represents an alkyl group, an aryl group, or an acyl group); and $Y_5$ represents a splitting-off group. Substituent groups by which the groups represented by $R_{12}$, $R_{13}$ and $R_{14}$ may be substituted include the same ones as are suitable for the groups represented by $R_1$. A splitting-off group represented by $Y_5$ is preferably one which contains an oxygen or nitrogen atom, especially a nitrogen atom, at the splitting-off site.

Specific examples of the couplers represented by the general formulae (C-I), (C-II), (M-I), (M-II) or (Y) are illustrated below:

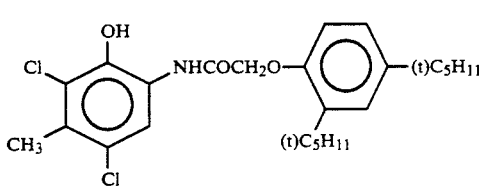

(C-1)

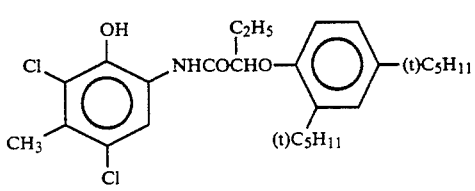

(C-2)

-continued
(C-3)
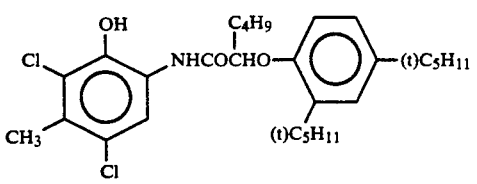
(C-4)
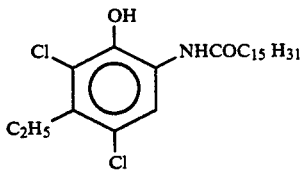
(C-5)
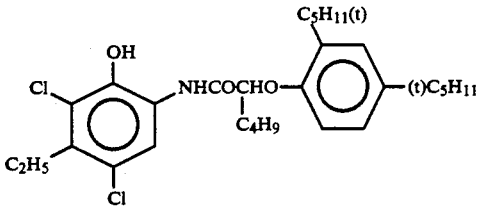
(C-6)
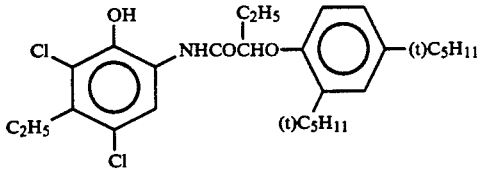
(C-7)
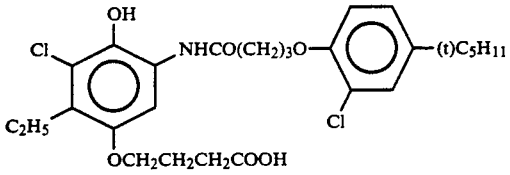
(C-8)
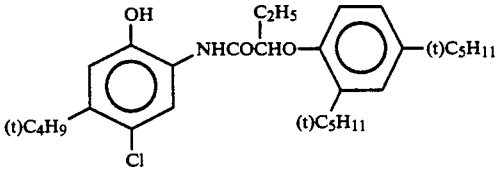
(C-9)
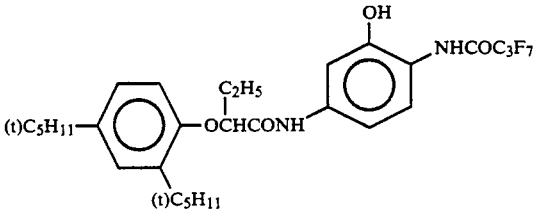
(C-10)
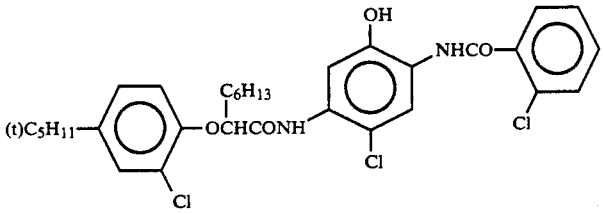
(C-11)
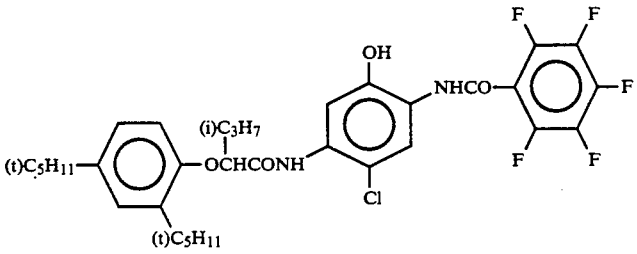
(C-12)
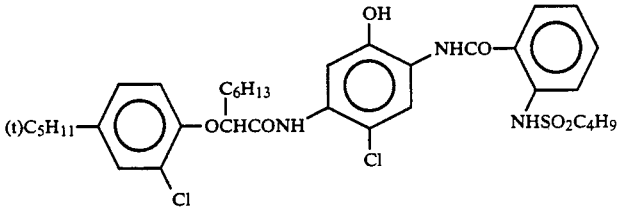

-continued
(C-13)
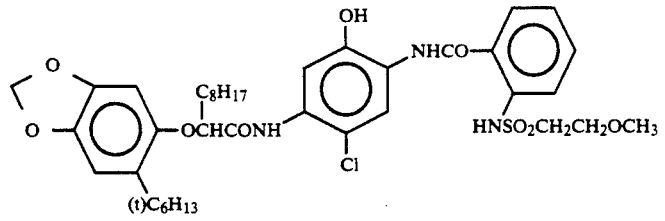
(C-14)
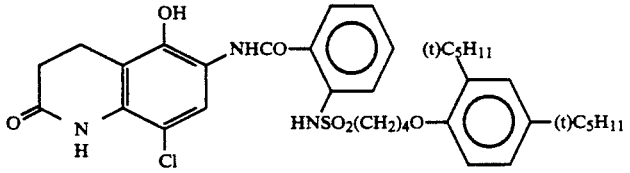
(C-15)
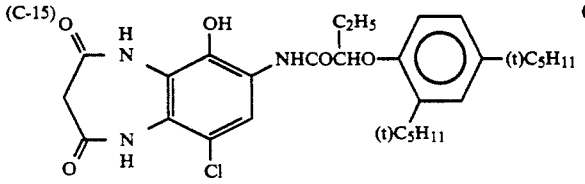
(C-16)
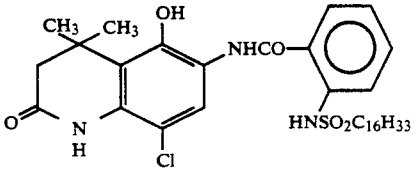
(C-17)
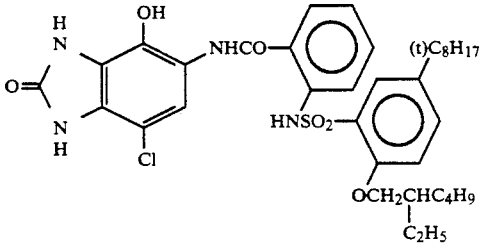
(C-18)
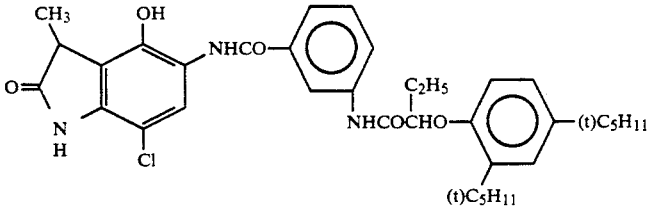
(C-19)
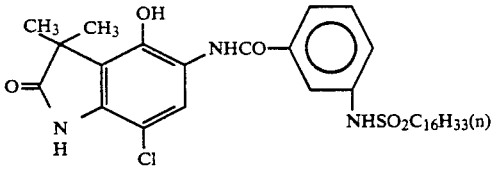
(C-20)
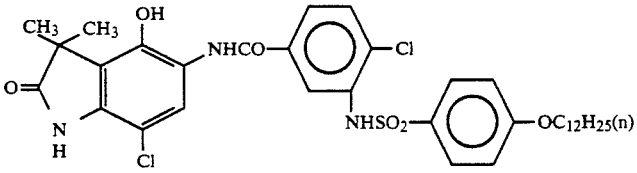
(C-21)
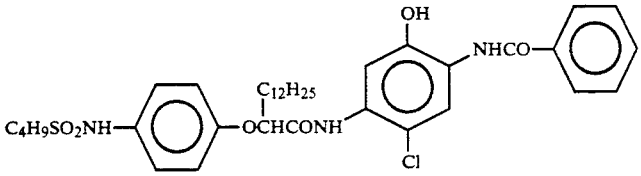

-continued
(C-22)
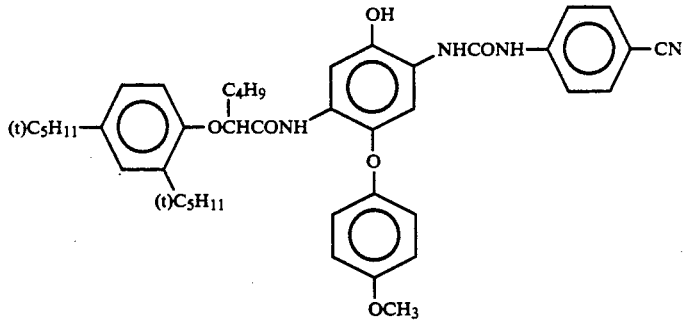
(M-1)
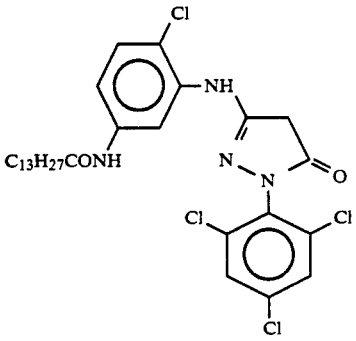
(M-2)
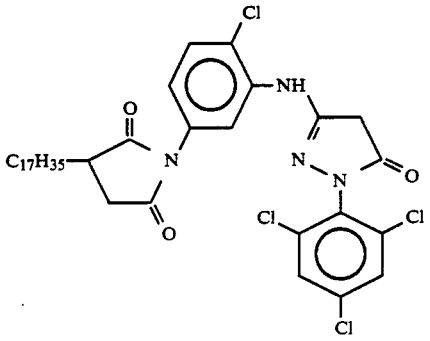
(M-3)
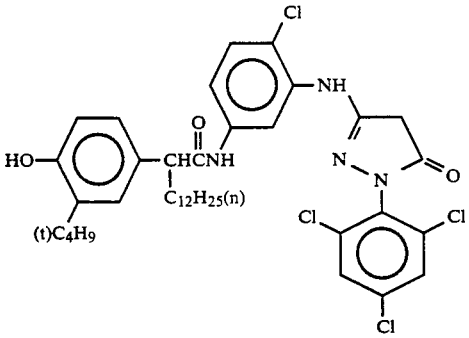
(M-4)
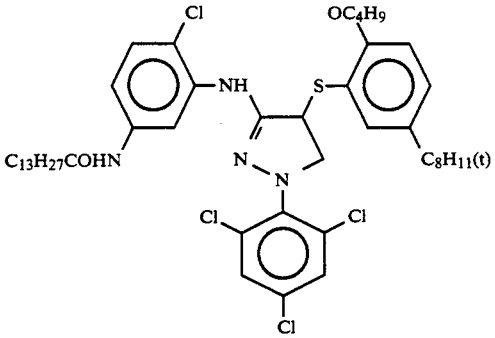
(M-5)
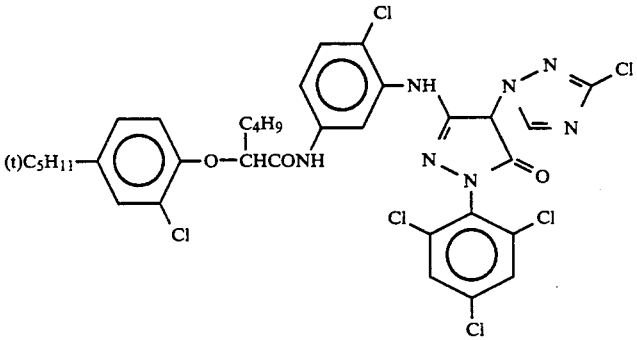

-continued
(M-6)
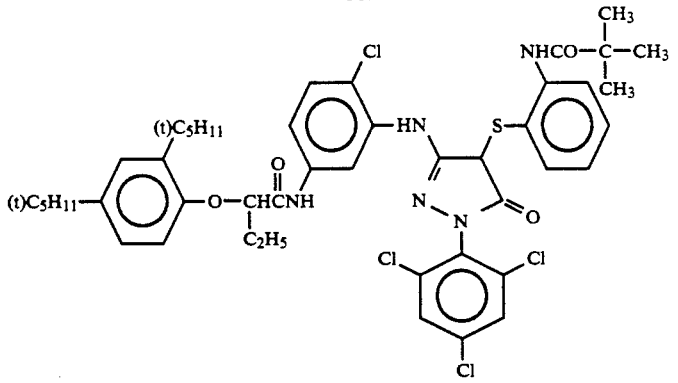
(M-7)
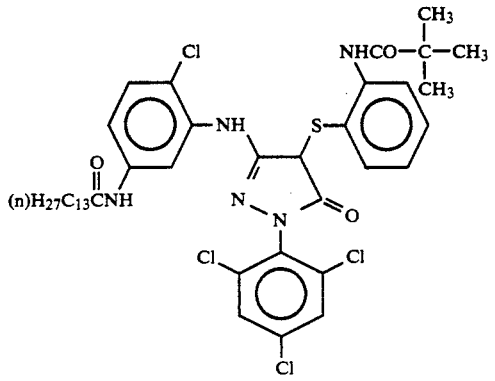
(M-8)
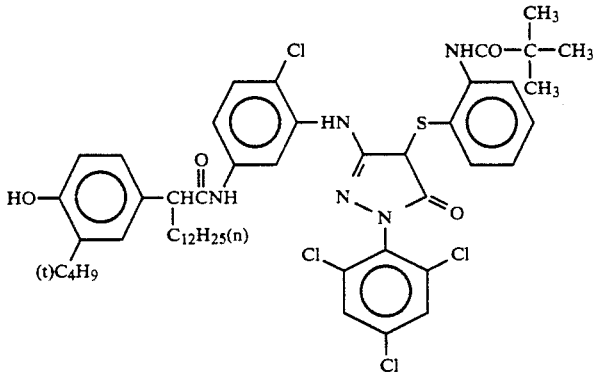

| Compound | $R_{10}$ | $R_{15}$ | $Y_4$ |
|---|---|---|---|
| | | 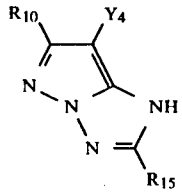 | |
| M-9 | $CH_3$— | 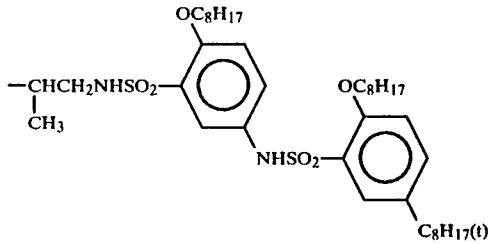 | Cl |
| M-10 | " | 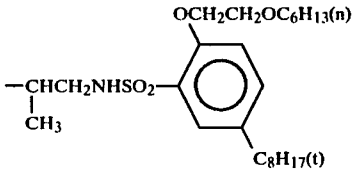 | " |
| M-11 | $(CH_3)_3C$— | 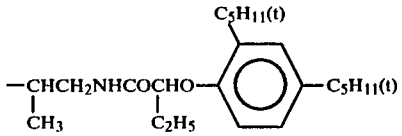 | 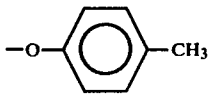 |
| M-12 | 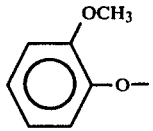 | 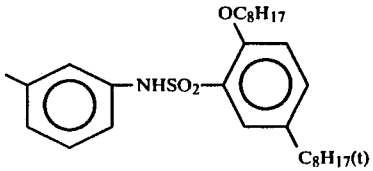 | 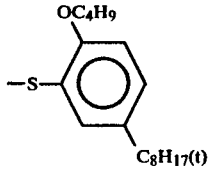 |

-continued
| Compound | $R_{10}$ | $R_{15}$ | $Y_4$ |
|---|---|---|---|
| M-13 | $CH_3$— | 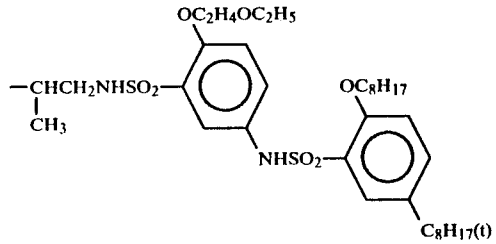 | Cl |
| M-14 | " | 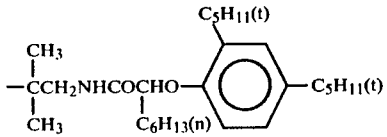 | " |
| M-15 | $CH_3$— | 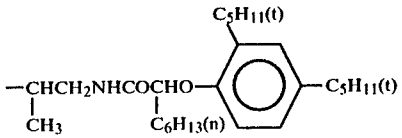 | Cl |
| M-16 | " | 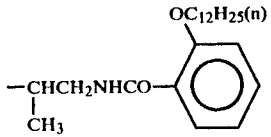 | " |
| M-17 | " | 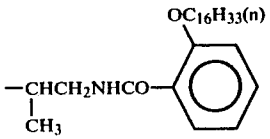 | " |

-continued
| Compound | $R_{10}$ | $R_{15}$ | $Y_4$ |
|---|---|---|---|
| M-18 | 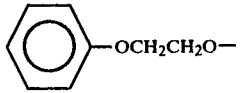 | 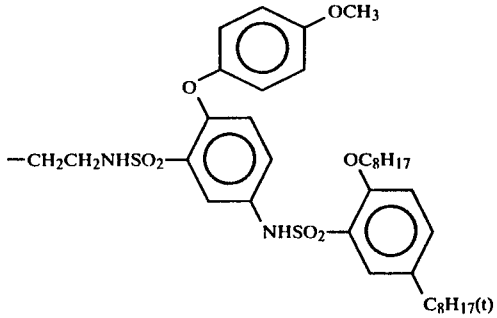 | 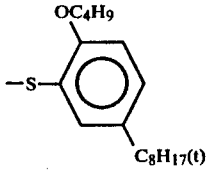 |
| M-19 | $CH_3CH_2O-$ | " | " |
| M-20 | 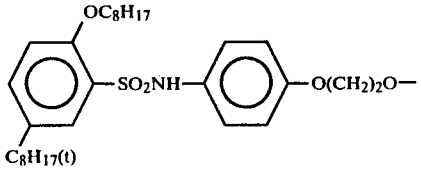 | 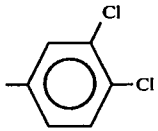 | 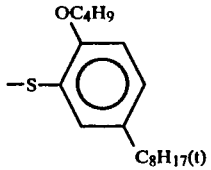 |
| M-21 | 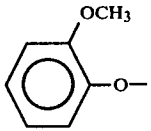 | 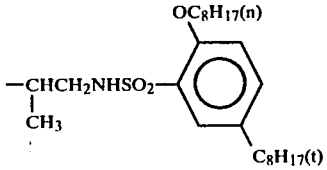 | Cl |
| M-22 | $CH_3-$ | 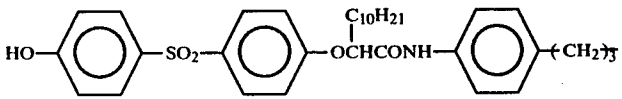 | Cl |

-continued

| Compound | $R_{10}$ | $R_{15}$ | $Y_4$ |
|---|---|---|---|
| M-23 | " | $(n)C_6H_{13}$ \ $CHCH_2SO_2\text{-}(CH_2)_2\text{-}$ / $(n)C_8H_{17}$ | " |
| M-24 | $CH_3$ \ $CH-$ / $CH_3$ | $OC_4H_9$; $-SO_2\text{-}(CH_2)_3\text{-}$; $C_8H_{17}(t)$ | " |
| M-25 | $\text{-}(CH-CH_2)_{50}\text{-}(CH_2-C(CH_3))_{50}\text{-}$; $COOCH_2CH_2OCH_3$; $CONH-$ | $CH_3-CH-$; $CH_2NHSO_2CH_3$ | " |
| M-26 | $-O-$ | $OC_8H_{17}$; $\text{-}(CH_2)_2NHSO_2-$; $C_8H_{17}(t)$ | Cl |
| M-27 | $CH_3-$ | $CH_3$; $CH_3$; $CH_3$; $NHCOCHO-$; $(n)C_{10}H_{21}$; $-SO_2-$; $-OCH_2-$ | " |
| M-28 | $(CH_3)_3C-$ | $CH_3$; $CH_3$; $CH_3$; $C_5H_{11}(t)$; $NHCOCHO-$; $C_4H_9(n)$; $C_5H_{11}(t)$ | " |

-continued
| Compound | $R_{10}$ | $R_{15}$ | $Y_4$ |
|---|---|---|---|
| M-29 | 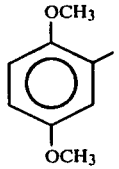 | 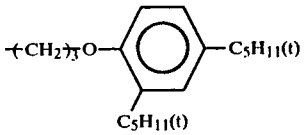 | Cl |
| M-30 | $CH_3-$ | $-CH(C_2H_5)-N(n\text{-}C_{18}H_{37})COCH_2CH_2COOH$ | " |

(Y-1)
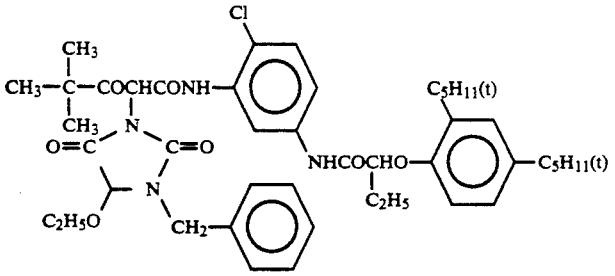
(Y-2)
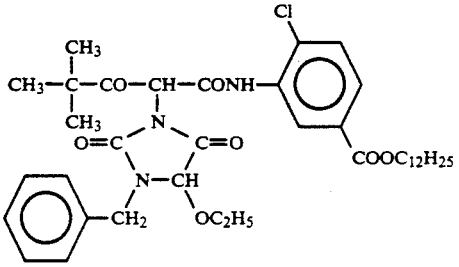
(Y-3)
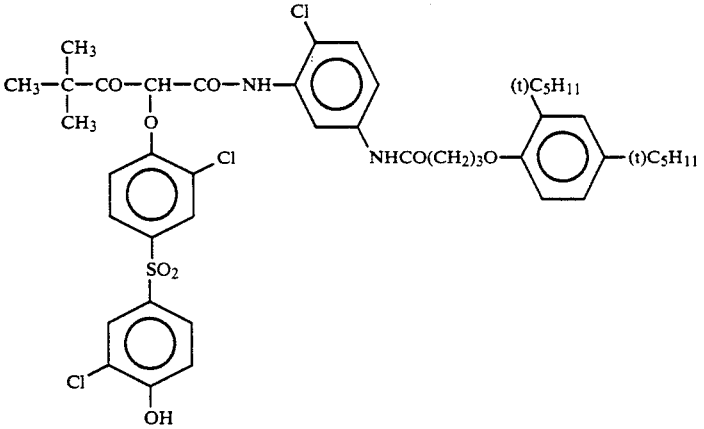
(Y-4)
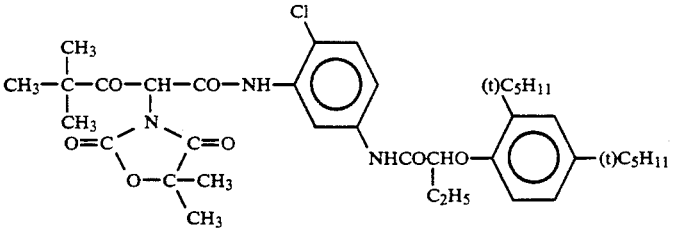
(Y-5)
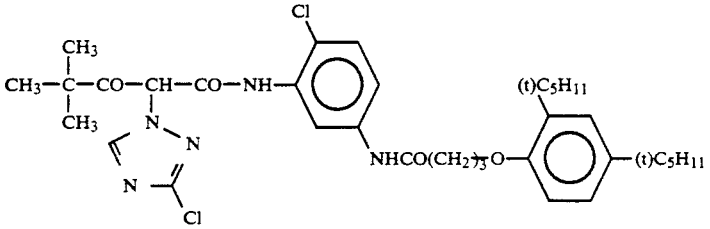

-continued (Y-6)

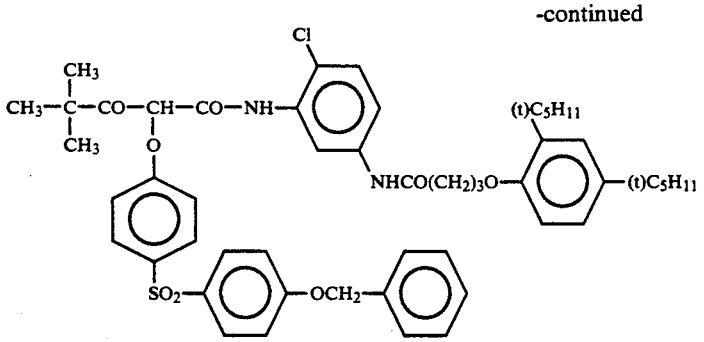

(Y-7)

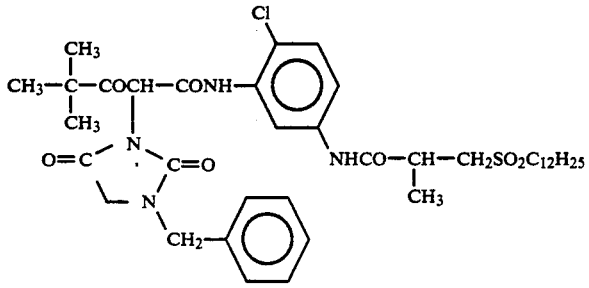

(Y-8)

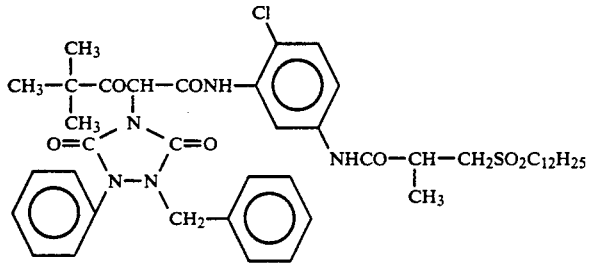

(Y-9)

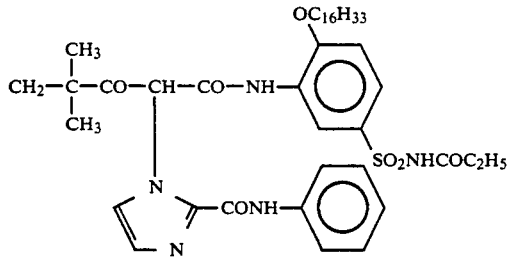

Each of the couplers represented by the foregoing general formulae (C-I), (C-II), (M-I), (M-II) or (Y) is incorporated into a silver halide emulsion layer, which is a constituent of the light-sensitive layer, in an amount of generally from 0.1 to 1.0 mole, preferably from 0.1 to 0.5 mole, per mole of the silver halide present therein.

To incorporate the above-described couplers into light-sensitive layers, various known arts can be applied. In general, the incorporation can be carried out using an oil-in-water dispersion method known as an oil-protected method, which comprises dissolving a coupler in a solvent, and dispersing the dissolved coupler into a surfactant-containing aqueous gelatin solution in the form of emulsion; or adding water or an aqueous gelatin solution to a surfactant-containing coupler solution, and causing phase inversion therein to make the mixture into an oil-in-water dispersion. In the case of alkali-soluble couplers, on the other hand, the so-called Fischer's dispersion method can be adopted. After a low boiling organic solvent is removed from a coupler dispersion by distillation, noodle washing, ultrafiltration or so on, the resulting dispersion may be mixed with a photographic emulsion.

As the dispersion medium for the couplers as cited above, high boiling organic solvents having a dielectric constant of 2–20 (at 25° C.) and a refractive index of 1.5–1.7 (at 25° C.) and/or water-insoluble high molecular compounds are used to advantage.

High boiling organic solvents which can be preferably used include those represented by the following general formulae (A), (B), (C), (D) or (E).

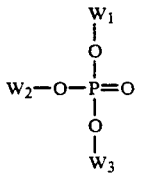

(A)

$W_1-COO-W_2$ (B)

-continued

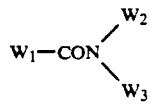

(C)

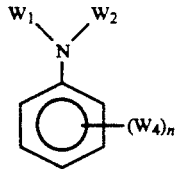

(D)

$W_1—O—W_2$ (E)

In the above formulae, $W_1$, $W_2$ and $W_3$ each represents a substituted or unsubstituted alkyl, cycloalkyl, alkenyl, aryl or heterocyclyl group; $W_4$ represents $W_1$, $—OW_1$, or $—SW_1$; n represents an integer from 1 to 5, and when n is 2 or above the $nW_4$'s may be the same or different; and further, $W_1$ and $W_2$ in (E) may combine with each other to complete a condensed ring.

In addition to those represented by the general formulae (A) to (E), compounds of the kind which have a melting point of 100° C. or below and a boiling point of 140° C. or above, and are immiscible with water and good solvents for couplers can be also adopted as high boiling organic solvents to be used in this invention. It is desirable that the high boiling organic solvents to be used in this invention have a melting point of 80° C. or below, and a boiling point of 160° C. or above, particularly 170° C. or above.

Details of these high boiling organic solvents are described in JP-A-62-215272, from the right lower column on page 137 to the right upper column on page 144.

Another technique for incorporating the couplers mentioned above into emulsion layers comprises impregnating a loadable latex polymer (as disclosed, e.g., in U.S. Pat. No. 4,203,716) with couplers in the presence or the absence of such a high boiling organic solvent as described above, or dissolving the couplers in a polymer insoluble in water but soluble in an organic solvent, and then dispersing the resulting polymer into an aqueous solution of a hydrophilic colloid in an emulsified condition.

Polymers which can be preferably used in the foregoing techniques include the homo- and copolymers disclosed in WO 88/00723, on pages 12–30. In particular, acrylamide type polymers are favored over others for stabilization of color images.

The light-sensitive material prepared in accordance with this invention may contain as color-fog inhibitors hydroquinone derivatives, aminophenol derivatives, gallic acid derivatives, ascorbic acid derivatives and the like.

In the light-sensitive material of this invention, various kinds of discoloration inhibitors can be used. Typical examples of organic discoloration inhibitors suitable for cyan, magenta and/or yellow images include hindered phenols represented by hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ether or ester derivatives obtained by silylating or alkylating the phenolic OH groups contained in the above-cited compounds, respectively. In addition, metal complexes represented by (bissalicylaldoxmato)nickel complex and (bis-N,N-dialkyldithiocarbamato)nickel complexes can be used for the above-described purpose.

Specific examples of organic discoloration inhibitors are described in the following patent specifications.

That is, hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. No. 4,360,589; p-alkoxyphenols are described, e.g., in U.S. Pat. No. 2,735,765, British Patent 2,066,975, JP-A-59-10539 and JP-B-57-19765; hindered phenols are described, e.g., in U.S. Pat. No. 3,700,455, JP-A-52-72224, U.S. Pat. No. 4,228,235, and JP-B-52-6623; gallic acid derivatives, methylenedioxybenzenes and aminophenols are described, e.g., in U.S. Pat. No. 3,457,079, U.S. Pat. No. 4,332,886 and JP-B-56-21144, respectively; hindered amines are described, e.g., in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes are described, e.g., in U.S. Pat. Nos. 4,050,938 and 4,241,155, and British Patent 2,027,731 (A). These compounds can accomplish their purpose when used in a proportion of, in general, from 5 to 100 wt% to the couplers corresponding thereto, respectively, and emulsified together therewith, followed by incorporation into the light-sensitive layers. In order to prevent cyan dye images from deteriorating due to heat, and light in particular, it is more effective to introduce an ultraviolet absorbent into a cyan color-forming layer and both layers adjacent thereto.

Examples of the ultraviolet absorbents which can be used include aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., U.S. Pat. Nos. 3,705,805 and 3,707,395), butadiene compounds (as disclosed, e.g., in U.S. Pat. No. 4,045,229), and benzoxidol compounds (as disclosed, e.g., in U.S. Pat. Nos. 3,700,455). Also, ultraviolet-absorbing couplers (e.g., α-naphthol type cyan dye-forming couplers) and ultraviolet-absorbing polymers may be employed. These ultraviolet absorbents may be mordanted to be fixed to a particular layer.

Among these ultraviolet absorbents, the foregoing aryl-substituted benzotriazole compounds are preferred over others.

In particular, it is desired that the compounds described below should be used together with the foregoing couplers, especially the pyrazoloazole type couplers.

That is, compounds of the kind which can produce chemically inert, substantially colorless compounds by combining chemically with an aromatic amine developing agent remaining after the color development-processing (Compounds F), and/or compounds of the kind which can produce chemically inert, substantially colorless compounds by combining chemically with an oxidized aromatic amine developing agent remaining after the color development-processing (Compounds G), are used individually or in combination to prevent effectively the generation of stains during storage after photographic processing (which is due to the formation of dyes through a reaction between couplers and an unoxidized or oxidized color developing agent remaining in the photographic film after the photographic processing) and the occurrence of other side reactions.

Those compounds which are preferred as Compound F are the compounds capable of undergoing a reaction with p-anisidine wherein a kinetic constant of the second order reaction, $k_2$ (in 80° C. trioctyl phosphate) ranges from 1.0 l/mol.sec to $1\times10^{-5}$ l/mol.sec. The measurement of a kinetic constant of the second order reaction can be performed according to the method described in JP-A-63-158545.

When $k_2$ is greater than the upper limit of the foregoing range, the compound itself becomes unstable, so that it is sometimes decomposed through a reaction with gelatin or water. On the other hand, when $k_2$ is smaller than the lower limit of the foregoing range, the reaction with the residual aromatic amine developing agent becomes slow, so it is often impossible to prevent the undesirable side effects of the residual aromatic amine developing agent.

More preferable examples of these compounds (F) can be represented by the following general formula (FI) or (FII):

$$R_1-(A)_n-X \quad \text{(FI)}$$

$$R_2-\underset{\underset{B}{|}}{C}=Y \quad \text{(FII)}$$

In the above formulae, $R_1$ and $R_2$ each represents an aliphatic, aromatic or heterocyclic group; n represents 1 or 0; A represents a group capable of forming a chemical bond by a reaction with an aromatic amine developing agent; X represents a group capable of being eliminated by a reaction with an aromatic amine developing agent; B represents a hydrogen atom, an aliphatic group, an aromatic group, a heterocyclic group, an acyl group, or a sulfonyl group; and Y represents a group capable of accelerating the addition of an aromatic amine developing agent to the compound of the general formula (FII). Therein, $R_1$ and X in the formula (FI), and Y and Rz or B in the formula (FII) may combine with each other to complete a cyclic structure.

The typical ways in which the foregoing compounds combine chemically with residual aromatic amine developing agents are through substitution and addition reactions.

Specific examples of the compounds represented by the general formulae (FI) and (FII) respectively include those disclosed in JP-A-63-158545, JP-A-63-283338, JP-A-64-2042, European Patents (laid-open) 277,589 and 298,321, and so on.

On the other hand, those which are more preferred as Compound (G), which can combine chemically with an oxidized aromatic amine developing agent remaining after color development to produce a chemically inert, colorless compound, can be represented by the following general formula (GI):

$$R-Z \quad \text{(GI)}$$

(wherein R represents an aliphatic group, an aromatic group, or a heterocyclic group; and Z represents a nucleophilic group or a group capable of releasing a nucleophilic group through decomposition in the light-sensitive material). In the compounds represented by the general formula (GI), it is desirable that Z should be a group having a Pearson's nucleophilic "$CH_3I$" value (R. G. Pearson, et al., *J. Am. Chem. Soc.*, 90, 319 (1968)) of 5 or more, or a group derived therefrom.

Examples of the preferred compounds represented by general formula (GI) include the compounds disclosed in European Patent (laid-open) 255,722, JP-A-62-143048, JP-A-62-229145, JP-A-1-230039, JP-A-1-57259, JP-A-64-2042, European Patents (laid-open) 277,589 and 298,321, and so on.

In addition, details of the combination of the foregoing compounds (G) with the foregoing compounds (F) are described in European Patent (laid-open) 277589.

Light-sensitive materials prepared in accordance with this invention may contain ultraviolet absorbents in a hydrophilic colloid layer. Examples of such ultraviolet absorbents include aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., U.S. Pat. Nos. 3,705,805 and 3,707,395), butadiene compounds (as disclosed, e.g., in U.S. Pat. No. 4,045,229), and benzoxidol compounds (as disclosed, e.g., in U.S. Pat. No. 3,700,455). Also, ultraviolet-absorbing couplers (e.g., o-naphthol type cyan dye-forming couplers) and ultraviolet-absorbing polymers may be employed. These ultraviolet absorbents may be mordanted to be fixed to a particular layer.

In full-color recording materials according to this invention, colloidal silver and dyes are used for the prevention of irradiation and halation, and particularly for the purposes of separation of spectral sensitivity distribution of each light-sensitive layer from those of other light-sensitive layers and security against the safelight for visible wavelength region. Dyes used for such purposes include oxonol dyes, hemioxonol dyes, styryl dyes, merocyanine dyes, cyanine dyes and azo dyes. In particular, oxonol dyes, hemioxonol dyes and merocyanine dyes are favored over the others.

Specific examples of such dyes include oxonol dyes having a pyrazolone or barbituric acid nucleus as disclosed in British Patents 506,385, 1,177,429, 1,311,884, 1,338,799, 1,385,371, 1,467,214, 1,433,102 and 1,553,513, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,985 and 4,078,933; other oxonol dyes as disclosed in U.S. Pat. Nos. 2,533,427 and 3,379,533, British Patent 1,278,621, JP-A-01-134447 and JP-A-01-183652; azo dyes as disclosed in British Patents 575,691, 680,631, 599,623, 786,907, 907,125 and 1,045,609, U.S. Pat. No. 4,255,326, and JP-A-59-211043; azomethine dyes as disclosed in JP-A-50-100116, JPA-54-118247, and British Patents 2,014,598 and 750,031; anthraquinone dyes disclosed in U.S. Pat. No. 2,865,752; arylidene dyes as disclosed in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286, and JP-B-59-37303; styryl dyes as disclosed in JP-B-28-3082, JP-B-44-16594, and JP-B-59-28898; triarylmethane dyes as disclosed in British Patents 446,583 and 1,335,422, and JP-A-59-228250; merocyanine dyes as disclosed in British Patents 1,075,653, 1,153,341, 1,284,730, 1,475,228 and 1,542,807;

cyanine dyes as disclosed in U.S. Pat. Nos. 2,843,486 and 3,294,539, and JP-A-01-291247; and so on.

In particular, to terminal red or infrared dyes can be applied decolorizable dyes as disclosed in JP-A-62-3250, JP-A-62-181381, JP-A-62-123454 and JP-A-63-197947, dyes for a backing layer and dyes as disclosed in JP-A-62-39682, JP-A-62-123192, JP-A-62-158779 and JP-A-62-174741, and those dyes prepared by introducing water-soluble groups into the above-cited dyes to make them effusible upon photographic processing. Infrared dyes which can be used in this invention may be colorless, that is, substantially free from absorption of light in the visible region.

Dyes represented by the following general formula (A) are particularly preferred as infrared dyes:

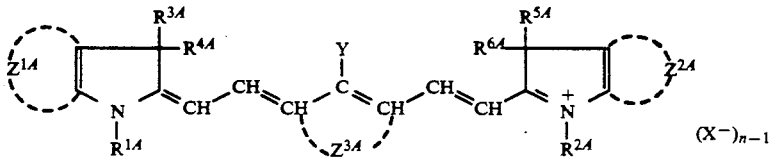

(A)

(wherein $R^{1A}$, $R^{2A}$, $R^{3A}$, $R^{4A}$, $R^{5A}$ and $R^{6A}$ may be the same or different from one another, and each represents a substituted or unsubstituted alkyl group; $Z^{1A}$ and $Z^{2A}$ each represents the nonmetal atoms necessary to complete a naphtho condensed ring containing at least two sulfo groups or a benzo condensed ring containing at least one sulfo group; $Z^{3A}$ represents the nonmetal atoms necessary to complete a 5- or 6-membered ring; Y represents a hydrogen atom or a monovalent group; X represents an anion; and n represents 1 or 2, but n is 1 only when the dye molecule forms an inner salt).

Infrared dyes as illustrated above have the problem that when they are mixed with silver halides spectrally sensitized in terminal red or/and infrared regions they sometimes cause desensitization and generate fog. In some cases they themselves adsorb to silver halide grains to confer thereon weak, broad spectral sensitization. Therefore, it is desirable that they should be incorporated, in a substantial sense, only in a colloid layer excluding light-sensitive layers. In order to satisfy such a requirement, these dyes should be introduced into the layer intended for coloring in a nondiffusible condition. In one means, a ballast group is introduced into such a dye to impart diffusion resistance thereto. Therein, however, color stain and processing stain tend to generate. In another means, dyes of the anionic type are mordanted by the combined use with a polymer or polymer latex capable of presenting cation sites, as disclosed in U.S. Pat. Nos. 2,548,564, 4,124,386 and 3,625,694. In still another means, dyes are used in the form of a fine-grain dispersion, provided that they are insoluble in acidic water (pH below 7) and can be decolored and eluted in the course of processing. More specifically, the dyes of the above-described kind are disolved in a low boiling organic solvent or solubilized with a surface active agent, and then dispersed into an aqueous solution of a hydrophilic colloid. Preferably, the solid state of such dyes are kneaded with an aqueous solution containing a surface active agent, mechanically made into fine particles with a mill, and then dispersed into an aqueous solution of a hydrophilic colloid. The means for this process are disclosed, e.g., JP-A-56-2639, JP-A-55-155350, JP-A-55-155351, JP-A-63-27838, JP-A-63-197943 and European Patent 15,601. In a further means, fine particles of a metal salt to which the dyes illustrated above are adsorbed are used for dyeing a particular layer, as disclosed in U.S. Pat. Nos. 2,719,088, 2,496,841 and 2,496,843, JP-A-60-45237, and so on.

As the binder or the protective colloid which can be used for the light-sensitive emulsion layers relating to this invention, gelatin is of great advantage. Of course, other hydrophilic colloids can be employed independently or together with gelatin.

Gelatin which can be used in this invention includes not only lime-processed gelatin, but also acid-processed gelatin. Details of the methods for preparing these gelatins are described in Arthur Weiss, *The Macro-molecular Chemistry of Gelatin*, Academic Press (1964).

Color photosensitive materials of this invention comprise a support having thereon a yellow coupler-containing light-sensitive layer (YL), a magenta coupler-containing light-sensitive layer (ML), a cyan coupler-containing light-sensitive layer (CL), a protective layer (PL), interlayers (IL), and optionally colored layers of the kind which can be decolored during development, especially an antihalation layer (AH). YL, ML and CL have spectral sensitivities corresponding to at least three kinds of luminous flux, respectively, which differ in main wavelength from one another. YL, ML and CL have their respective main sensitivities at wavelengths separated from one another by at least 30 nm, preferably from 50 to 100 nm. In addition, every light-sensitive layer has a sensitivity difference of at least 0.8 LogE, preferably at least 1.0 LogE (E=quantity of light) at the wavelength corresponding to its main sensitivity, compared with the sensitivities which any other light-sensitive layers have at that wavelength. Further, it is desirable that at least one light-sensitive layer should have its main sensitivity in the wavelength region longer than 670 nm, preferably another light-sensitive layer also should have its main sensitivity in the wavelength region longer than 750 nm.

For instance, three kinds of light-sensitive layers may have any of the layer structures set forth in the following table. Therein, R signifies that the corresponding layer is spectrally sensitized in red region, and IR-1 and IR-2 signify that their corresponding layers are spectrally sensitized in different infrared regions.

| Layer Arrangement | (1) | (2) | (3) | (4) | (5) | (6) | (7) | (8) | (9) |
|---|---|---|---|---|---|---|---|---|---|
| Protective Layer | PL | PL | PL | PL | PL | PL | PL | PL | PL |
| Light-sensitive Layer Unit | YL = R | YL = IR − 2 | YL = R | ML = R | CL = R | CL = R | CL = IR − 2 | ML = IR − 2 | ML = R |
| | ML = IR − 1 | ML = IR − 1 | CL = IR − 1 | YL = IR − 1 | YL = IR − 1 | ML = IR − 1 | ML = IR − 1 | CL = IR − 1 | CL = IR − 1 |
| | CL = | CL = R | ML = | CL = | ML = | YL = | YL = R | YL = R | YL = |

-continued

| Layer Arrangement | (1) | (2) | (3) | (4) | (5) | (6) | (7) | (8) | (9) |
|---|---|---|---|---|---|---|---|---|---|
| | IR − 2 (AH) | | IR − 2 (AH) | IR − 2 (AH) | IR − 2 (AH) | IR − 2 (AH) | | IR − 2 (AH) | |
| Support | | (AH) | | | | | (AH) | | (AH) |

In this invention, the light-sensitive layers spectrally sensitized in the wavelength region longer than 670 nm are each imagewise exposed to laser beams. Accordingly, spectral sensitivities of such a layer may be distributed within the range of its main sensitivity wavelength ±25 nm, preferably ±15 nm. However, the distribution of spectral sensitivities of the photographic emulsion of this invention in the wavelength region longer than 670 nm, especially in the infrared region, tends to be rather broad. Therefore, it is preferable to modify the spectral sensitivity distribution of each light-sensitive layer relating to this invention by using dyes, especially when they are fixed to a specified layer. In order to achieve such a modification, dyes are incorporated into a colloid layer in a nondiffusible form, and in a condition they can be decolored in the course of development processing. More specifically, dyes of the kind which are substantially insoluble in water of pH 7 but soluble in alkaline water of pH above 7 are used in the form of fine-grain dispersion. On the other hand, acidic dyes are used together with a polymer or polymer latex which can present cation sites. In both former and latter approaches, the dyes represented by general formulae (VI) and (VII) in JP-A-63-197947 are used to advantage. Particularly in the former approach, dyes containing carboxyl group(s) are preferred.

As the support, both the transparent films used in conventional photographic light-sensitive materials, such as cellulose nitrate film, polyethylene terephthalate film and the like, and the reflective supports can be used in this invention. However, a reflective support is preferred.

The term "reflective support" as used herein describes a material which can make the dye images formed in silver halide emulsion layers clear owing to its high reflectivity. Such a reflective support includes a support covered with a hydrophobic resin in which a light-reflecting substance, such as titanium oxide, zinc oxide, calcium carbonate, calcium sulfate or the like, is dispersed, and a support made from a hydrophilic resin in which a light-reflecting substance is contained in a dispersed condition. Examples thereof include baryta paper, polyethylene-coated paper, polypropylene type synthetic paper, and transparent supports provided with a reflective layer or containing reflective substances. Transparent supports usable therein include a glass plate, polyester films such as a polyethylene terephthalate film, a cellulose triacetate film, cellulose nitrate film and so on, polyamide films, polycarbonate films, polystyrene films, vinyl chloride resin, and so on. Therefrom, the support to be used in this invention can be chosen properly depending on the end-use purpose of the photographic material.

As the light-reflecting substance, a white pigment which has been thoroughly kneaded in the presence of a surfactant is preferably used. Further, it is desirable that individual surfaces of the pigment grains should be treated with a di- to tetrahydric alcohol.

Regarding the proportions (%) of the areas occupied by the fine grains of the white pigment per specified unit area, the most typical determination method thereof comprises subdividing the observed area into adjacent unit areas measuring 6 μm by 6 μm, and measuring the proportion of the area occupied by the projected fine grains in each unit area (Ri%). The variation coefficient of the proportions of the occupied areas can be determined as the ratio of the standard deviation of Ri (represented by s) to the mean of Ri's (represented by R), that is, s/R. The number of unit areas to be examined as subjects is preferably at least 6.

That is to say, the variation coefficient, s/R, can be determined according to the following representation:

$$\sqrt{\frac{\sum_{i=1}^{n}(Ri-R)^2}{n-1}} \Big/ \frac{\sum_{i=1}^{n} Ri}{n}$$

The variation coefficient of the proportions of the occupied areas of the pigment fine grains is preferably 0.15 or less, particularly 0.12 or less.

Other reflective supports include thin films of metals, such as aluminum, its alloys and metals whose surfaces have specular reflectivity or diffusional reflectivity of the second kind, as disclosed JP-A-63-118154, JP-A-63-24247, JP-A-63-24251, JP-A-63-24253, JP-A-63-24255 and so on.

Since the photographic material of this invention is used as a hard copy after image formation, a support preferred therein is light in weight and flexible. In addition, an inexpensive one is favored. Therefore, polyethylene-coated paper and synthetic paper having a thickness of from 10 to 250 μm, preferably from 30 to 180 μm, are advantageously used as the reflective support.

Color photographic materials according to this invention can be applied, e.g., to photograph-taking color negative films (for amateur use, motion picture use, etc.), color reversal films (for slide use, motion picture use, etc.), color photographic paper, color positive films (for motion picture use, etc.), color reversal photographic paper, heat developable color photosensitive paper, color photographic materials for graphic arts (e.g., lith film, scanner film, etc.), X-ray color films (for medical radiography and fluorography, industrial radiography, etc.), color diffusion transfer photosensitive materials (DTR), and so on.

This invention will now be illustrated in more detail by reference to the following examples. However, the invention should not be construed as being limited to these examples.

EXAMPLE 1

To a mixture of 1,000 ml of water, 40 g of deionized ossein gelatin and 0.20 g of potassium bromide (which was placed in a reaction vessel maintained at 75° C. and stirred thoroughly), both a 0.0412 normal water solution of silver nitrate and a water solution adjusted so as to contain 0.0412 normal potassium bromide and $8.26\times10^{-4}$ normal potassium iodide were added simultaneously at flow rates of 4.01 ml/min over a period of 10 minutes. Then, each flow rate was increased to 24.07 ml/min, and both solutions were further added simultaneously over a period of 7 minutes and 25 seconds. Two minutes after the conclusion of the addition, a 1.18 normal water solution of silver nitrate and a water solution adjusted so as to contain 1.18 normal potassium bromide and 0.0241 normal potassium iodide were added simultaneously to the reaction vessel at a flow rate which was changed continuously from an initial value of 1.50 ml/min to a final value of 13.54 ml/min over a period of 80 minutes as the silver potential in the reaction vessel was kept at 0 mV with reference to the saturated calomel electrode.

Subsequently, the thus prepared silver iodobromide emulsion was sedimented by adding a copolymer of isobutene and monosodium maleate as a polymeric flocculant. The sedimented emulsion was desalted by washing with water. Thereto, 80 g of deionized ossein gelatin and 328 ml of water were further added, and the resulting emulsion was adjusted to pH 6.5 and pAg 8.9 at 40° C. The silver iodobromide grains of the thus obtained emulsion had a crystal form of octahedron, a monodisperse distribution (variation coefficient: 10.8%), an average iodide content of 2.0 mol. % and an average grain size of 0.88 μm. This emulsion was divided into two portions. To one portion of the emulsion, a water solution of sodium thiosulfate and a water solution of potassium chloroaurate-potassium thiocyanate mixture were added successively at 60° C. in their optimal amounts, thereby ripening the emulsion so as to impart to it an optimal sensitivity. The thus ripened emulsion was further divided, and to one part was added at 40° C. $2.05\times10^{-4}$ mol/mol Ag of Sensitizing Dye (18) relating to this invention (specific addition amount: 0.55). After a lapse of 30 minutes, to each part were added 4-hydroxy-6-methyl-1,3,3a,7-tetrazaindene, 10% gel of deionized gelatin and water in amounts of 0.18 g, 280 g and 1.04 l, respectively, per 1 Kg of each emulsion. Each of these parts was coated on a polyethylene terephtalate film base under the following system.

The amount of emulsion to be coated was set so as to have a silver coverage of 2.5 g/m$^2$ and a gelatin coverage of 3.8 g/m$^2$. The upper layer was formed on the emulsion coat so as to have a gelatin coverage of 1.0 g/m$^2$ by simultaneous coating of a water solution containing as main components 0.1 g/l of sodium dodecylbenzenesulfonate, 0.22 g/l of sodium sulfostyrene homopolymer, 4.0 g/l of 1,3-bis(vinylsulfonyl)-2-propanol and 50 g/l of gelatin.

Separately, the other portion of the emulsion was further divided, and to the parts were added at 60° C. Sensitizing Dye (18) of this invention and Dye (A) for comparison, respectively, in the same amount of $2.05\times10^{-4}$ mole. To each part, a water solution of sodium thiosulfate and a water solution of potassium chloroaurate-potassium thiocyanate mixture were added successively at 60° C. in their optimal amounts, thereby ripening the emulsion so as to confer the optimal sensitivity. The resulting emulsion parts were each coated on a polyethylene terephthalate film base in the same manner as the foregoing emulsion parts.

These sample coats were exposed to a tungsten light source (color temperature: 2854° K.) through the combination of a 750 nm interference filter (transmittance at 750 nm: 30.1%, half width: about 9.7 nm) with a continuous wedge.

The exposed samples were each developed for 4 min. at a temperature below 20° C. with a developer having the composition described below, and subjected successively to stop, fixation and washing steps. Density measurements of the thus processed samples were performed using a P-type densitometer made by Fuji Photo Film Co., Ltd. to determine sensitivity and fog density. The results obtained are shown in Table 1.

Figures 1, 2:
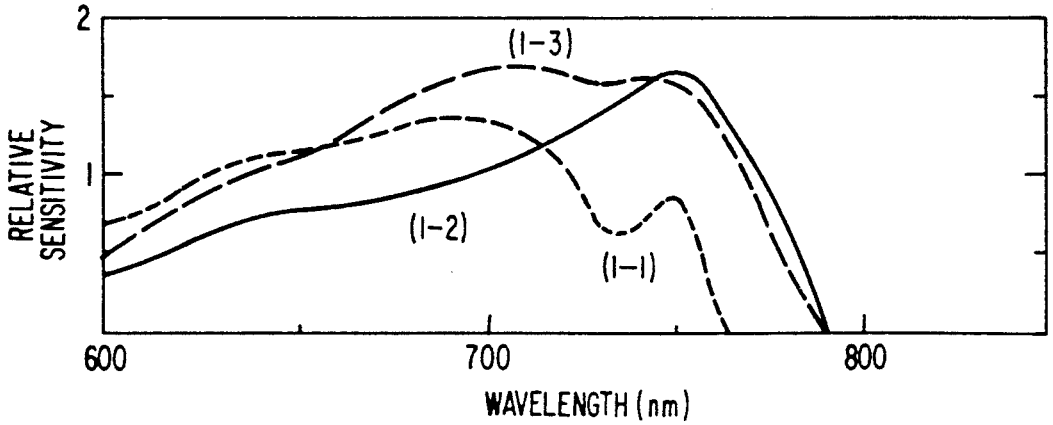
Figures 1, 2:
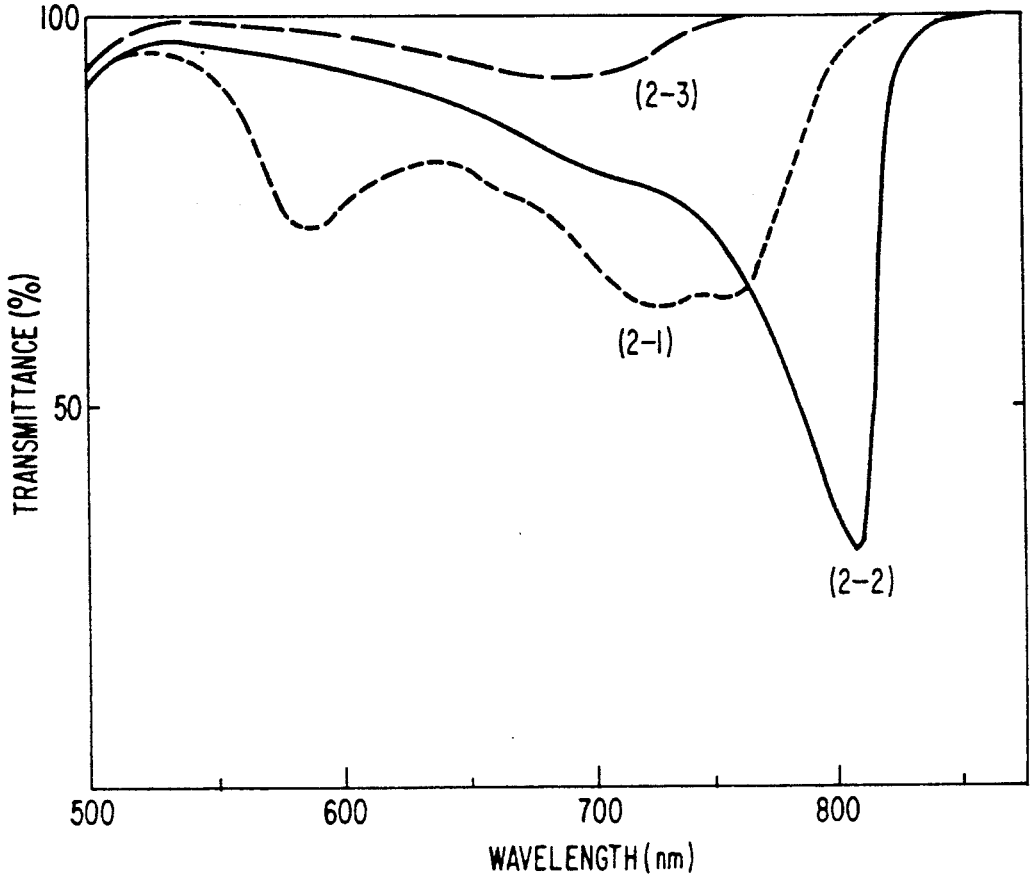
Figure 2:
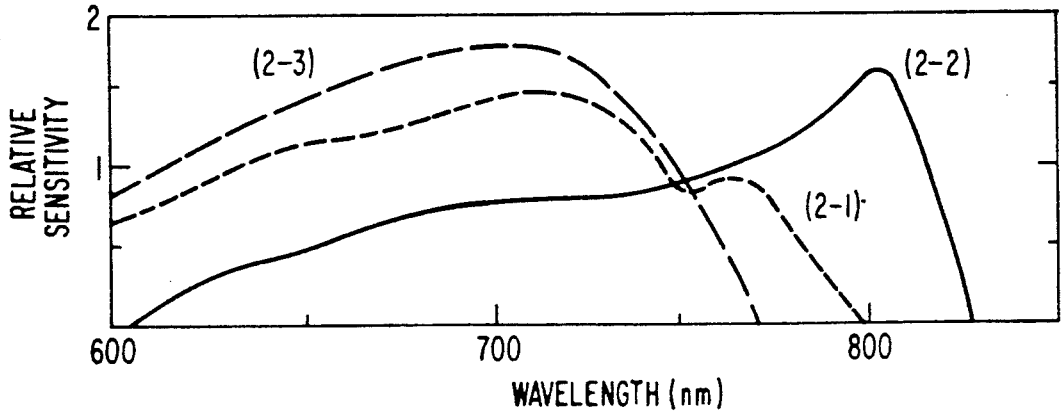

Further, reflection-absorbency spectra of the sample coats obtained in the above-described manner were each taken with a Hitachi Model U-3400 automatic recording spectrophotometer according to such a form as to set each sample inside an Ulbricht sphere. The obtained spectra are shown in FIG. 1-1. Furthermore, the samples each were exposed by means of a spectroscope Model GR-2, made by Narumi Shokai, and subjected to the same photographic processing as described above, thereby determining the relative logarithmic spectral sensitivity curves. These curves are shown in FIG. 1-2.

| Composition of Developer: | |
|---|---|
| Water | 700 ml |
| Metol | 3.1 g |
| Anhydrous sodium sulfite | 45.0 g |
| Hydroquinone | 12.0 g |
| Sodium carbonate (monohydrate) | 79.0 g |
| Potassium bromide | 1.0 g |
| Water to make | 2,000 ml |
| pH (20° C.) | 10.33 |

The standard point of the optical density to determine the sensitivity was fog+0.2, and the sensitivity was expressed in terms of the reciprocal of exposure required for achieving that optical density. The sensitivities shown in Table 1 are relative values, with Sample No. 1-2, which received the addition of Sensitizing Dye (18) at 60° C. prior to chemical ripening, being taken as 100. Therein, the samples, which were exposed through the same interference filter, are compared.

TABLE 1

| Sample No. | Sensitizing Dye | Addition Temperature and Time | Photographic Characteristics Fog | Photographic Characteristics Sensitivity | Interference Filter used |
|---|---|---|---|---|---|
| 1-1 (comparison) | (18) | 40° C., after chemical ripening | 0.03 | 8.9 | 750 nm |
| 1-2 (invention) | (18) | 60° C., before chemical ripening | 0.04 | 100 (standard) | 750 nm |
| 1-3 (comparison) | (A) | 60° C. before chemical ripening | 0.04 | 60 | 750 nm |

Dye (A) for comparison:

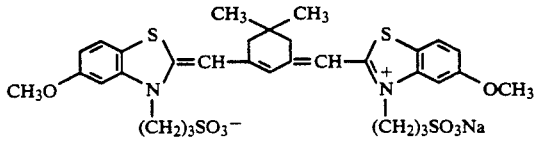

As the data in Table 1 indicate, the sample prepared in accordance with an embodiment of this invention was clearly sensitized when exposed to light of wavelengths corresponding to J-band absorption, and the sensitivity brought about was very high, even in comparison with the dye used for comparison. The origin of this phenomenon is apparent from the experimental results shown in FIG. 1-1 and FIG. 1-2. That is, the sample prepared in accordance with an embodiment of this invention had a clear J-band absorption at 752 nm and, what is more, showed little absorption due to the dye being adsorbed to silver halide grains in a molecular condition. Consequently, the spectral sensitivity curve based on such an absorption feature was obtained. If the art of bringing about such a spectral sensitivity distribution as to be realized by this invention is utilized, a photographic material can be obtained which is endowed with high sensitivity in a desired wavelength region alone, but is reduced in sensitivities at unnecessary wavelengths. In addition, this invention can offer a multi-layer color photographic material which has a wide exposure latitude and excellent color separation.

On the other hand, although the addition of a sensitizing dye at 40° C., which had so far been adopted frequently, was able to bring about slight absorption and sensitivity due to J-aggregates when Sensitizing Dye (18) was used, most of the absorption was governed by what had generally been accepted to be brought about by a molecular-state sensitizing dye. This was reflected in the broadness of the spectral sensitivity distribution. In the case of the 60° C. addition of the dye for comparison, although the absorption and spectral sensitivities due to J-aggregates were observed, the absorption and the spectral sensitivities due to the molecular-state dye were predominant, so that it was difficult to say that such a case came under the so-called J-band sensitization. Therefore, the dye used for comparison cannot be adopted in designing a photosensitive material utilizing the above-described J-band sensitization. Dye A was introduced as a J-aggregates forming dye by H. Kampfer in The International Congress of Photographic Science (1986). It was reported that when it was added to an AgBrI emulsion (iodide content: 4.5 mol. %, grain size: 0.66 μm) in an amount of $2.26\times10^{-4}$ mole per mole of Ag, the dye brought about a very broad spectral sensitivity distribution having a maximum sensitivity at 770 nm (in *Proceedings of the International Congress of Photographic Science*, Köln, E. Granzer & E. Moisar Eds., pp. 366–369 (1986)).

EXAMPLE 2

To a mixture of 2.5 of water, 125 g of deionized ossein gelatin, 25.7 g of potassium bromide and a 5% water solution of 3,6-dithiaoctane-1,8-diol, which was placed in a reaction vessel maintained at 75° C. and stirred thoroughly, both 65 ml of a 17.22% water solution of silver nitrate, to which 0.4 g of ammonium nitrate had been added, and 65 ml of a 12.77% water solution of potassium bromide were added simultaneously at a constant flow rate over a period of 15 seconds according to a double jet method. Then, the reaction mixture was stirred for an additional 20 minutes. Thereafter, 1.44 l of a 20.90% water solution of silver nitrate to which 9.0 g of ammonium nitrate had been added and 1.44 l of a water solution containing 246.2 g of potassium bromide, 10.5 g of potassium iodide and 1.7 g of 3,6-dithiaoctane-1,8-diol were added simultaneously over a period of 90 minutes according to the double jet method (wherein the total amount of silver nitrate added was 375.5 g).

Subsequently, the thus prepared silver iodobromide emulsion was cooled to 35° C., adjusted to pH 4.10, and sedimented by adding a copolymer of isobutene and monosodium maleate as a polymeric flocculant. The sedimented emulsion was desalted by washing with water. Thereto, 100 g of deionized ossein gelatin, 150 ml of a 5% water solution of phenol and 1.4 of water were further added at 40° C., and the resulting emulsion was adjusted to pH 6.8 and pAg 8.8. The thus obtained silver halide grains had an average diameter of 1.78 μm and an average thickness of 0.12 μm (an average aspect ratio: 14.8), wherein tabular grains having an aspect ratio of 12 or above were contained in a proportion of at least 97.8%, based on projected area, to the whole grains.

Further, the emulsion was subjected to chemical sensitization by adding sodium thiosulfate pentahydrate and potassium tetrachloroaurate at 60° C. To the chemically sensitized emulsion, Sensitizing Dye (23) of this invention was added in an amount of $5.0\times10^{-4}$ mole per mole of silver (specific addition amount: 0.56). After a lapse of 30 minutes, the following magenta coupler emulsion was further added, and coated on a polyethylene terephthalate film base under the coating conditions described below:

| | |
|---|---|
| Emulsion Layer: | |
| Silver coverage | 1.20 g/m² |
| Coupler coverage | $2.4\times10^{-3}$ mole/m² |
| Formula of Magenta Coupler: | |

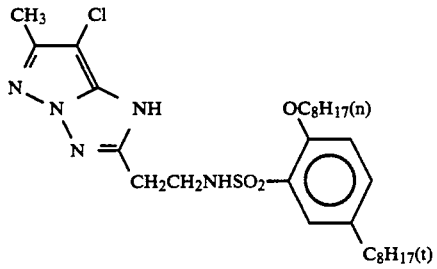

| | |
|---|---|
| Coverage of tricresyl phosphate used for emulsifying the foregoing coupler | 0.42 g/m² |
| Gelatin coverage | 3.8 g/m² |
| Protective Layer: | |
| Gelatin coverage | 1.2 g/m² |
| Coverage of sodium 1,2-bis(2-ethylhexyloxycarbonyl)ethanesulfonate | 0.0025 g/m² |
| Coverage of sodium p-sulfostyrene homopolymer | 0.0053 g/m² |
| Coverage of sodium 2-hydroxy-4,6-dichloro-1,3,5-triazine | 0.075 g/m² |

In the course of the preparation of the above-described emulsion, more specifically 20 minutes before the conclusion of the silver nitrate addition, the emulsion under preparation was divided into three portions. To two portions thereof, Sensitizing Dye (23) of the invention and Dye (B) for comparison were further added respectively in the same amount of $5.0\times10^{4}$ mole/per mole of Ag over a period of 20 minutes. Then, the thus prepared emulsion was cooled to 35° C., adjusted to pH 4.10, and sedimented by adding a copolymer of isobutene and monosodium maleate as a polymeric flocculant. The sedimented emulsion was desalted by washing with water. Thereto, 100 g of deionized ossein gelatin for dispersion, 150 ml of a 5% water solution of phenol and 1.4 l of water were further added at 40° C., and the resulting emulsion was adjusted to pH 6.8 and pAg 8.8. Further, the emulsion was chemically sensitized by adding sodium thiosulfate pentahydrate and potassium tetrachloroaurate and ripening at 60° C. To the chemically sensitized emulsion, the coupler emulsion, gelatin, water and so on were further added, and coated on a polyethylene terephthalate film base under the coating conditions described above.

These sample coats were exposed to a tungsten light source (color temperature: 2854° K.) through the combination of a 803 nm interference filter (transmittance at 803 nm: 11%, half width: about 13 nm) with a continuous wedge.

The exposed samples were each subjected to the following photographic processing.

| Photographic Processing: | | |
|---|---|---|
| Step | Processing Time | Processing Temperature |
| Color Development | 2 min. 00 sec. | 40° C. |
| Bleach-Fixation | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

In the above-described processing, the washing steps (1) and (2) were carried out according to the counter-current process from step (2) to step (1).

The composition of each processing solution used is described below.

| Color Developer: | |
|---|---|
| Diethylenetriaminepentaacetic acid | 2.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-methyl-N-β-hydroxyethylamino]-2-methylaniline sulfate | 4.5 g |
| Water to make | 1 l |
| pH adjusted to | 10.05 |
| Bleach-fix Bath: | |
| Ammonium ethylenediaminetetra-acetonato-ferrate(III) | 90.0 g |
| Disodium ethylenediaminetetraacetate | 5.0 g |
| Sodium sulfite | 12.0 g |
| Aqueous solution of ammonium thiosulfate (70%) | 260.0 ml |
| Acetic acid (98%) | 5.0 ml |
| 3-Mercapto-1,2,4-triazole (bleach accelerator) | 0.01 mol |
| Water to make | 1.0 l |
| pH adjusted to | 7.2 |

The pH was adjusted by using acetic acid or aqueous ammonia.

Washing Water:

Tap water was passed through a column of a mixed-bed system in which H-type strong acid cation-exchange resin (Amberlite IR-120B, produced by Rhom & Haas Co.) and OH-type anion-exchange resin (Amberlite IR-400, produced by Rhom & Haas Co.) were charged, resulting in reduction of calcium and magnesium ion concentrations to 3 mg/l or less. To the thus purified water were added 20 mg/l of sodium dichloroisocyanurate and 1.5 g/l of sodium sulfate. The pH of this solution was within the range of 6.5 to 7.5.

| Stabilizing Bath: | |
|---|---|
| Formaldehyde (37% W/V) | 2.0 ml |
| Polyoxyethylene-p-monononylphenylether (average polymerization degree: 10) | 0.3 g |
| Disodium ethylenediaminetetraacetate | 0.05 g |
| Water to make | 1.0 l |
| pH adjusted to | 5.0–8.0 |

The processed samples were each examined for density of developed magenta color using a P-type densitometer, made by Fuji Photo Film Co., Ltd. to determine sensitivity and fog density. The standard point of the optical density to determine the sensitivity was fog +0.2, and the sensitivity was expressed in terms of the reciprocal of exposure required for achieving said optical density. The sensitivities shown in Table 2 are relative values, with Sample 2-2, which received the addition of Sensitizing Dye (23) during the grain formation, being taken as 100.

In addition, the reflection-absorbency spectra and relative logarithmic spectral sensitivity curves of the sample coats formed in the above-described manner were measured with the same instruments as used in Example 1. The results obtained are shown FIG. 2-1 and FIG. 2-2.

TABLE 2

| Sample No. | Sensitizing Dye | Addition Temperature and Time | Photographic Characteristics Fog | Photographic Characteristics Sensitivity | Interference Filter used |
|---|---|---|---|---|---|
| 2-1 (comparison) | (23) | 40° C., after chemical ripening | 0.08 | below 0.1 | 803 nm |
| 2-2 (invention) | (18) | 75° C., during grain formation | 0.12 | 100 (standard) | 803 nm |
| 2-3 (comparison) | (B) | 75° C., during grain formation ripening | 0.15 | 5.3 | 803 nm |

Dye (B) for comparison:

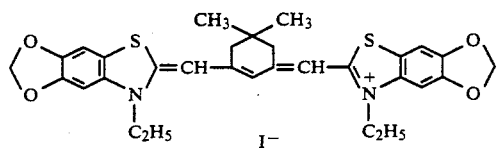

As clearly seen from the experimental results shown in FIG. 2-1 and FIG. 2-2, the sample prepared in accordance with an embodiment of this invention showed a sharp absorption due to the J-aggregates at 803 nm, and little showed the absorption at wavelengths of from 705 to 720 nm due to the dye being absorbed to silver halide grains in a molecular condition. One the other hand, only slight absorption was brought about due to the J-aggregates in the addition according to a conventional method. Even when the addition method of this invention was adopted, the dye used for comparison did not form any J-aggregates, so only the general sensitization known to be brought about by a molecular-state sensitizing dye was obtained. This was reflected in the data set forth in Table 2. That is, only the embodiment according to this invention enabled the attainment of a very high sensitivity.

EXAMPLE 3

To a mixture of 1 l of water, 30 g of deionized ossein gelatin, 10.3 g of potassium bromide and 10 ml of a 0.5% water solution of 3,6-dithiaoctane-1,8-diol (pAg 9.1, pH 6.5), which was placed in a reaction vessel maintained at 70° C. and stirred, both 21.5 g of a 20.9% water solution of silver nitrate and an aqueous solution containing 3.15 g of potassium bromide and 5 ml of a 5% 3,6-dithiaoctane-1,8-diol in 16.7 ml of water were added simultaneously over a 15-second period according to a double jet method. Thereafter, 956.5 g of a 14.55% water solution of silver nitrate and 621.2 g of a water solution containing 69.6 g of potassium bromide and 9.6 ml of a 5% 3,6-dithiaoctane-1,8-diol were added simultaneously over a 65-minute period according to the double jet method.

The thus prepared tabular silver halide grains had an average diameter of 0.83 μm and an average aspect ratio of 11.9, wherein the tabular grains having an aspect ratio of 10 or above were present in a proportion of at least 95%, based on projected area, to the whole grains.

Subsequently, this emulsion was cooled to 35° C., and sedimented by adding a copolymer of isobutene and monosodium maleate as a polymeric flocculant. The sedimented emulsion was washed with water, and thereto were added water and deionized ossein gelatin for dispersion. The resulting emulsion was adjusted to pH 6.5 and pAg 8.2, and divided into five portions.

One portion of the emulsion was subjected to chemical sensitization by adding sodium thiosulfate pentahydrate and potassium tetrachloroaurate at 60° C., and thereto was further added phenol as an antiseptic. The thus chemically sensitized emulsion was subdivided into two fractions, and thereto were added the Sensitizing Dyes (21) and (14) respectively in the same amount of $8.5\times10^{-4}$ mole (specific addition amount: 0.53). The stirring was continued for 30 minutes. Thereafter, 4-hydroxy-6-methyl-1,3,3a,7-tetraazaindene, a 10% gel of deionized gelatin and 1.04 l of water were added to each emulsion fraction in amounts of 18.0 g, 280 g and 1.04 l respectively per 1 Kg of emulsion. The thus prepared emulsion fractions each were coated on a polyethylene terephthalate film base according to the prescription described below. The sample characterized by the addition of Sensitizing Dye (21) was called Sample 3-1, while the sample characterized by the addition of the Sensitizing Dye (14) was called Sample 3-4.

The emulsion coat was designed so as to have a silver coverage of 2.0 g/m$^2$ and a gelatin coverage of 3.8 g/m$^2$. The emulsion coat was formed simultaneously with an upper layer. The upper layer was formed so as to have a gelatin coverage of 1.0 g/m$^2$ using a water solution containing 0.1 g/l of sodium dodecylbenzenesulfonate, 0.22 g/l of sodium p-sulfostyrene homopolymer, 3.1 g/l of sodium 2-hydroxy-4,6-dichloro-1,3,5-triazine and 50 g/l of gelatin.

Separately, Sensitizing Dyes (21) and (14) of this invention and Dyes (C) and (D) for comparison were added at 70° C. to the remaining four portions of the emulsion, respectively, in the same amount of $8.5\times10^{-4}$ mole. The resulting emulsion portions was allowed to stand for 30 minutes, and admixed at 60° C. with successive application of a water solution of sodium thiosulfate and a water solution of the mixture of potassium chloroaurate and potassium thiocyanate in their respectively optimal amounts, followed by ripening so as to attain the optimal sensitivity. The thus prepared emulsion portions each were coated on a polyethylene terephthalate film base in the same manner as the foregoing ones. The Sensitizing Dye (21)-containing sample was called Sample 3-2, the Sensitizing Dye (14)-containing sample was called Sample 3-5, the Dye (C)-containing sample was called Sample 3-3, and the Dye (D)-containing sample was called Sample 3-6.

The reflection-absorbency spectra and the relative logarithmic spectral sensitivity curves of the foregoing samples were measured with the same instruments as in Example 1. The experimental results obtained therein are shown in FIG. 3-1, FIG. 3-2, FIG. 3-3 and FIG. 3-4. The samples examined for logarithmic spectral sensitivity curve were each developed for 10 minutes at 20° C. using the developer described below.

Dye (C) for Comparison:

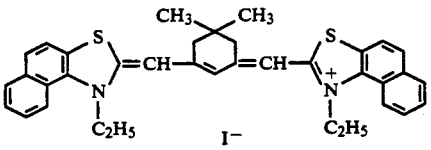

Dye (D) for Comparison:

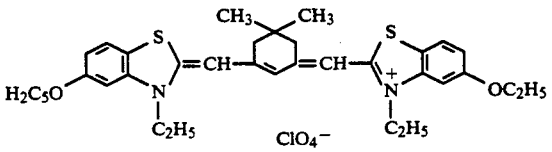

| (Composition of Developer) | |
|---|---|
| Metal | 2.5 g |
| L-ascorbic acid | 10.0 g |
| Potassium bromide | 1.0 g |
| Nabox | 35.0 g |
| Water to make | 1,000 ml |
| pH (20° C.) | 9.8 |

Figures 1, 3:
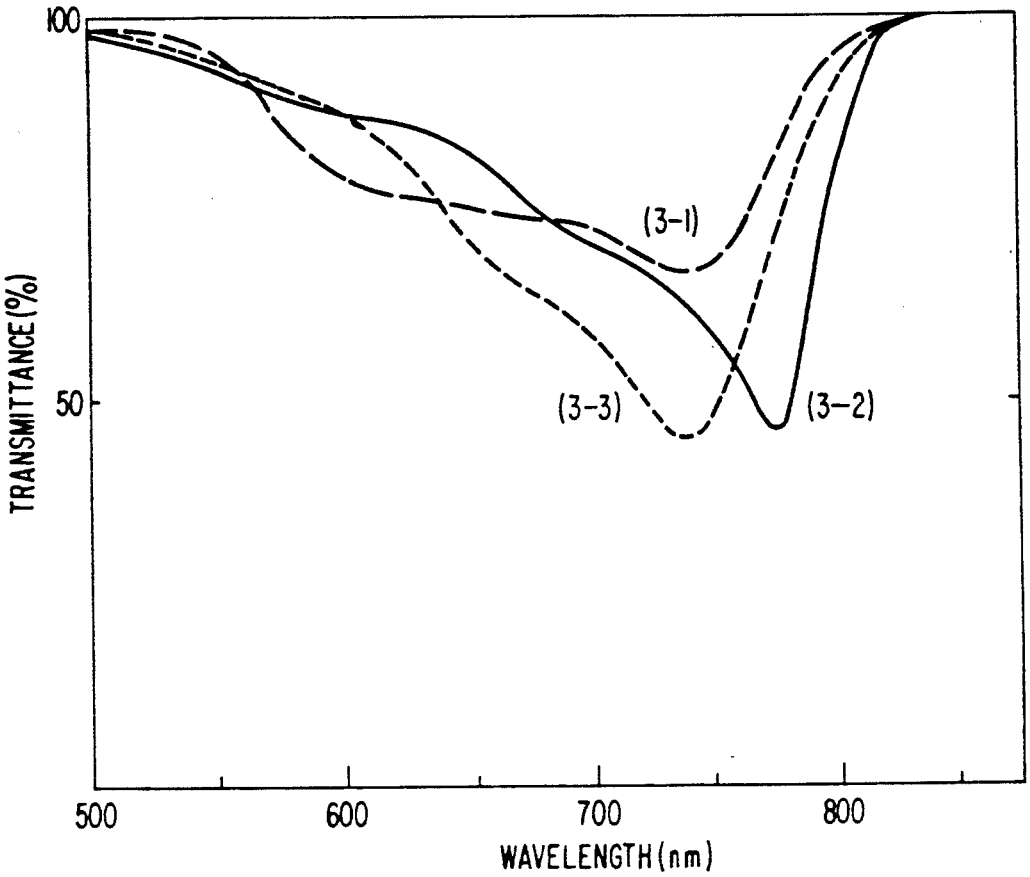
Figures 2, 3:
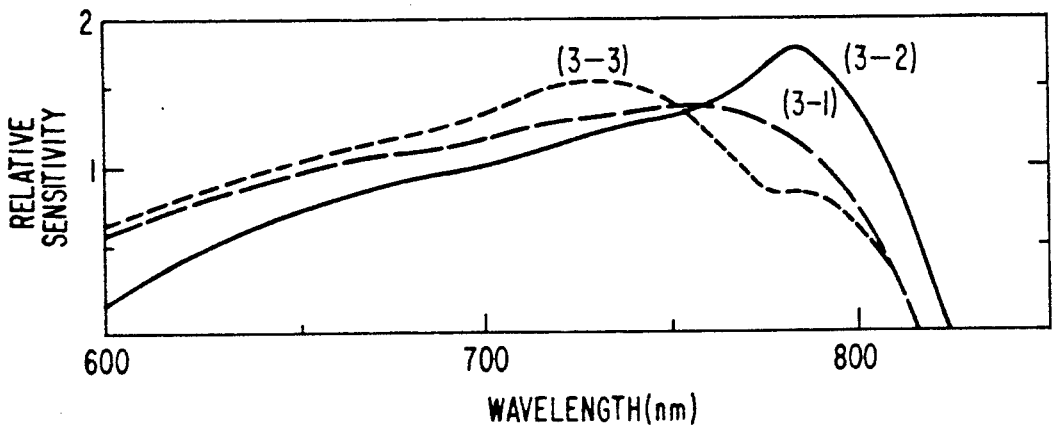
Figure 3:
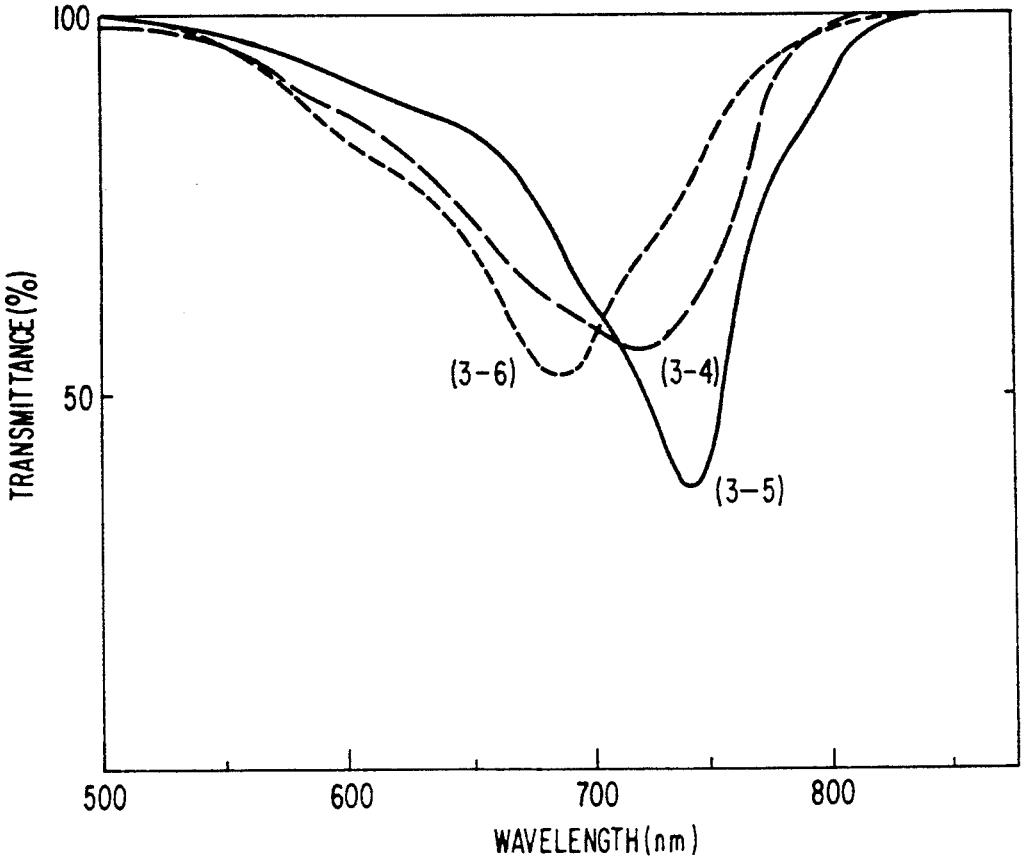
Figures 3, 4:
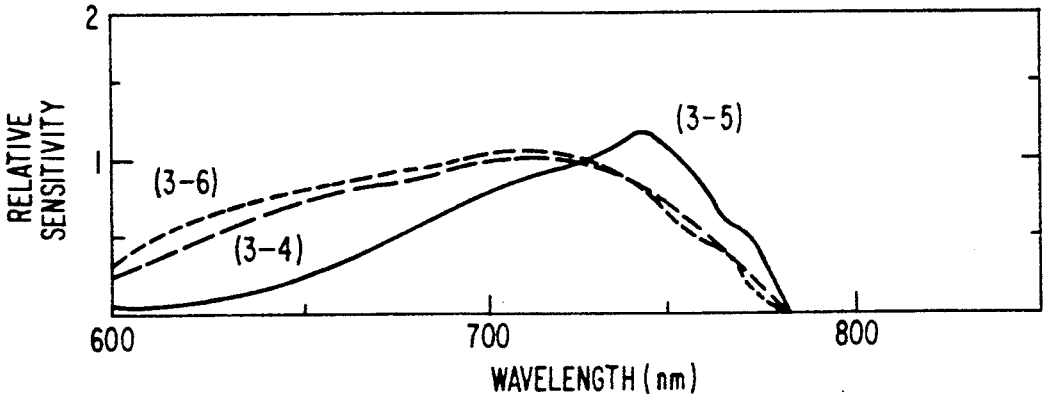

As can be seen from the results shown in from FIGS. 3-1 to 3-4, in analogy to Example 1 and Example 2, only the embodiments according to this invention were able to realize such an absorption spectrum as to be composed of a small absorption due to the molecular-state dye and a predominant absorption due to the J-aggregates, and consequently, to provide the spectral sensitivity distribution originated from the J-aggregates.

EXAMPLE 4

To a mixture of 1,000 ml of water, 30 g of deionized ossein gelatin and 2.81 g of sodium chloride, which was placed in a reaction vessel maintained at 60° C., 23.5 ml of 1 normal sulfuric acid was added with stirring. Thereto, both a 0.210 normal water solution of silver nitrate and a 0.210 normal water solution of sodium chloride were added at a constant flow rate of 4.38 ml/min over a 40-minute period. After a lapse of 10 minutes from the conclusion of the addition, both the 2.206 normal of water solution of silver nitrate and the 2.206 normal of water solution of sodium chloride were further added at a constant flow rate of 5.00 ml/min over a 80-minute period. The thus prepared silver chloride emulsion was sedimented by adding a copolymer of isobutene and monosodium maleate as a polymeric flocculant. The sedimented emulsion was desalted by washing with water. Thereto, deionized ossein gelatin and water were further added, and the resulting emulsion was adjusted to pH 6.3 and pAg 7.4 at 40° C. Silver chloride grains of the thus obtained emulsion had a crystal form of cube having an average edge length of 0.73 μm and a monodisperse distribution having a variation coefficient of 6.5% (the quotient of the standard deviation divided by the average edge length of grains; s/d).

This emulsion was divided into two portions. One portion of the emulsion received sulfur sensitization by adding thereto a water solution of sodium thiosulfate at 50° C. and ripening so as to impart to it the optimal sensitivity. Further, the ripened emulsion was parted into four subdivisions. To these subdivisions were added at 40° C. the Sensitizing Dyes (4), (5), (18) and (35) of this invention respectively in the same amount of $2.25\times10^{-4}$ mol/mol Ag (specific addition amount: 0.55). After 45 minutes' stirring, each subdivision was admixed with an emulsified dispersion of 1-(2,4,6-trichlorophenyl)-3-(2-chloro-5-tetradecanoylaminoanilino)-5-pyrazolone (magenta coupler) (in an amount of 18 g per 1 Kg of emulsion), 4-hydroxy-6-methyl-1,3,3a,7-tetrazaindene (in an amount of 0.18 g per 1 Kg of emulsion), 10% gel of deionized gelatin and water, and coated on a paper support laminated by polyethylene on both sides under the coating conditions described below.

50° C., and admixed with an optimal amount of a water solution of sodium thiosulfate, followed by ripening so as to confer the optimal sensitivity. Then, in the similar manner as described above, the same magenta coupler-emulsified dispersion and other ingredients as used above were added at 40° C. to each of the chemically sensitized subdivisions and coated on a paper support laminated by polyethylene on both sides. Simultaneously with the emulsion coat was provided an upper layer as a protective layer. The Sensitizing Dye (4)-containing sample was called Sample 4-5, the Sensitizing Dye (5)-containing sample was called Sample 4-6, the Sensitizing Dye (18)-containing sample was called Sample 4-7, the Sensitizing Dye (35)-containing sample was called Sample 4-8, the Dye (E)-containing sample was called Sample 4-9, the Dye (F)-containing sample was called Sample 4-10, the Dye (A)-containing sample was called Sample 4-11, and the Dye (G)-containing sample was called Sample 4-12.

Dye (E) for Comparison:

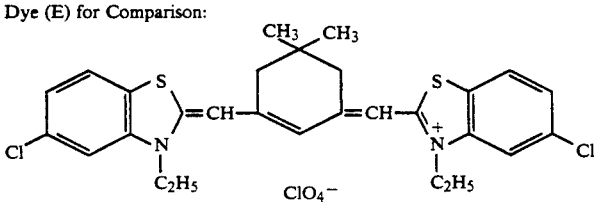

Dye (F) for Comparison:

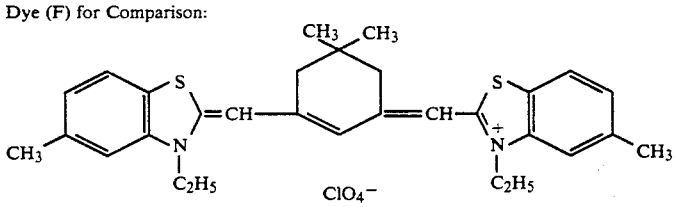

Dye (G) for Comparison

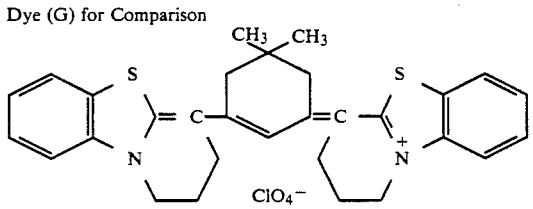

As for the quantity of the coating composition, the emulsion coat was designed so as to have a silver coverage of 0.06 g/m$^2$ and a gelatin coverage of 2.5 g/m$^2$. The emulsion coat was formed simultaneously with an upper layer. An aqueous gelatin solution used for forming the upper layer contained as main ingredients 1.5 g/m$^2$ of gelatin, 0.01 g/m$^2$ of sodium 1,2-bis(2-ethylhexyloxycarbonyl)ethanesulfonate, 0.1 g/m$^2$ of sodium dodecylbenzenesulfonate, 0.011 g/m$^2$ of sodium p-sulfostyrene homopolymer and 0.06 g/m$^2$ of sodium 2-hydroxy-4,6-dichloro-1,3,5-triazine. The Sensitizing Dye (4)-containing sample was called Sample 4-1, the Sensitizing Dye (5)-containing sample was called Sample 4-2, the Sensitizing Dye (18)-containing sample was called Sample 4-3, and the Sensitizing Dye (35)-containing sample was called Sample 4-4.

Separately, the other portion of the emulsion was further parted into subdivisions, and thereto were added at 70° C. Sensitizing Dyes (4), (5), (18) and (35) and Dyes (E), (F), (A) and (G), for comparison respectively, in the same amount of $2.25\times10^{-4}$ mole. After a lapse of 30 minutes, the resulting subdivisions were cooled to The reflection-absorbency spectra and the relative logarithmic spectral sensitivities of the foregoing samples were measured with the same instruments as in Example 1. The obtained reflection-absorbance spectra are shown in FIG. 4-1, FIG. 4-3, FIG. 4-5 and FIG. 4-7, and the obtained relative logarithmic sensitivity curves are shown in FIG. 4-2, FIG. 4-4, FIG. 4-6 and FIG. 4-10.

The samples examined for logarithmic spectral sensitivity curve were each subjected to the following color photographic processing.

| Processing Step | Temperature | Time | Amount* replenished | Tank Volume |
|---|---|---|---|---|
| Color development | 35° C. | 20 sec. | 60 ml | 21 l |
| Bleach-fix | 30-35° C. | 20 sec. | 60 ml | 21 l |
| Rinsing (1) | 30-35° C. | 10 sec. | — | 11 l |
| Rinsing (2) | 30-35° C. | 10 sec. | — | 11 l |
| Rinsing (3) | 30-35° C. | 10 sec. | 120 ml | 11 l |

-continued

| Processing Step | Temperature | Time | Amount* replenished | Tank Volume |
|---|---|---|---|---|
| Drying | 70-80° C. | 20 sec. | | |

*per $m^2$ of light-sensitive material
(The rinsing step was carried out according to 3-stage counter current process in the direction from tank 3 to tank 1)

The composition of each processing solution used was described below.

| | Tank Solution | Replenisher |
|---|---|---|
| Color developer | | |
| Water | 800 ml | 800 ml |
| Ethylenediamine-N,N,N,N-tetramethylenephosphonic acid | 1.5 g | 2.0 g |
| Triethanolamine | 8.0 g | 12.0 g |
| Sodium chloride | 4.9 g | — |
| Potassium bromide | 0.015 g | — |
| Potassium carbonate | 25.0 g | 25.0 g |
| N-Ethyl-N-(3-hydroxypropyl)-3-methyl-p-phenylenediammnium bis(p-toluenesulfonate) | 12.8 g | 19.8 g |
| N,N-Bis(carboxymethyl) hydrazine | 5.5 g | 7.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |
| Bleach-Fix Bath (Tank solution = Replenisher): | | |
| Water | 400 ml | |
| Ammonium thiosulfate (70 g/l) | 100 ml | |
| Sodium sulfite | 17 g | |
| Ammonium ethylenediaminetetra-acetonatoferrate(III) | 55 g | |
| Disodium ethylenediaminetetraacetate | 5 g | |
| Ammonium bromide | 40 g | |
| Water to make | 1,000 ml | |
| pH (25° C.) adjusted to | 6.0 | |

Rinsing Solution (Tank solution=Replenisher):

Ion exchange water (concentrations of calcium and magnesium were each 3 ppm or less).

As can be seen from the experimental results shown in FIGS. 4-1 to 4-8, in the case of silver chloride also, the embodiments according to this invention were able to realize such an absorption spectrum as to be composed of a small absorption due to the molecular-state dye and a predominant absorption due to the J-aggregates, and consequently, to provide the spectral sensitivity distribution originated from the J-aggregates. However, the dyes had a tendency to be hard to form J-aggregates on the silver chloride grains, compared with those on the silver bromide grains used in Example 1. That is, all the known dyes used for comparison did not form the J-aggregates at all in the silver chloride emulsion even when added thereto at 70° C. In contrast thereto, it was observed that the sensitizing dyes of this invention formed the J-aggregates to a slight extent even when added in a conventional manner. Therefore, it can be said that a slight difference in chemical structure affects whether the dyes form J-aggregates or not. However, the spectral sensitivities conferred by the present sensitizing dyes added in the conventional manner were governed by those conferred by the dyes in the molecular state, so that desirable J-band sensitization was not achieved. In addition, the J-aggregates formed were so frail that they disappeared instantly when a known antifoggant was added in order to prevent the generation of fog, for a silver chloride emulsion tends to generate fog. On the other hand, the embodiment according to this invention succeeded in reduction of fog, satisfactory suppression of sensitivities in the M-band region, and realization of J-band sensitization. Moreover, the J-aggregates continued to be present even after the compounds necessary for the production of a photosensitive material, e.g., an antifoggant, were added.

EXAMPLE 5

A 3% water solution of lime-processed gelatin was admixed with successive 3.3 g of sodium chloride and 3.2 ml of a 1% water solution of N,N-dimethylimidazoline-2-thione. To the resulting solution, a water solution containing 0.2 mole of silver nitrate and a water solution containing 15 μg of rhodium trichloride and 0.2 mole of sodium chloride were added at 56° C. with vigorous stirring. Subsequently thereto, a water solution containing 0.780 mole of silver nitrate and a water solution of 0.780 mole of sodium chloride and 4.2 mg of potassium ferricyanide were added at 56° C. with vigorous stirring. After the conclusion of the addition, the reaction mixture was allowed to stand for 5 minutes, and further thereto were added at 40° C. under vigorous stirring both a water solution containing 0.020 mole of silver nitrate and a water solution containing 0.015 mole of potassium bromide, 0.005 mole of sodium chloride and 0.8 mg of potassium hexachloroiridate(IV). Thereafter, a polymeric flocculant was added to sediment the emulsion, followed by desalting and washing treatments.

Then, 90.0 g of lime-processed gelatin was added, and the resulting emulsion was chemically sensitized to an optimal extent by adding thereto triethylthiourea and ripening at 55° C.

All the silver chlorobromide grains in the thus prepared emulsion had the crystal form of cube and an average grain size of 0.52 μm (variation coefficient: 0.08). The term grain size used herein refers to the diameter of the circle having the same area as the projected area of the grain, and the variation coefficient corresponds to the quotient of the standard deviation of grain sizes divided by the average grain size.

Further, the halide composition of the emulsion grains were determined by X-ray diffraction analysis of the silver halide crystals.

Specifically, diffraction angles from the (200) plane were measured closely using monochromatic X-rays of CuK(α) as a radiation source. The diffraction rays from crystals having a uniform halide composition give a single peak, while those from crystals having localized phases differing in composition give several peaks corresponding to their respective compositions. The halogen composition of silver halide constituting the grains can be determined by calculating the lattice constants from the diffraction angles of the measured peaks.

According to the X-ray diffraction analysis performed under the above-described conditions, the silver chlorobromide emulsion prepared in the foregoing manner showed such a diffraction pattern that in addition to the main peak due to 100% silver chloride, there was a broad peak centered at 70 mol. % silver chloride (30 mol. % bromide) and trailing its skirt to about 60 mol. % silver chloride (40 mol. % bromide).

Then, the thus prepared emulsion was used to prepare a multi-layer color photographic paper having the various constitutent layers described below on a paper support laminated by polyethylene on both sides. Coating solutions used therein were prepared in the following manner.

Preparation of Coating Solution for First Layer:

A mixture of 19.1 g of yellow coupler (Ex-Y), 4.4 g of a color image stabilizer (Cpd-1) and 1.4 g of a color image stabilizer (Cpd-7) was dissolved in a mixed solvent consisting of 27.2 ml of ethyl acetate and 8.2 g of a high boiling solvent (Solv-1), and then dispersed in an emulsified condition into 185 ml of a 10% aqueous gelatin solution containing 8 ml of a 10% solution of sodium dodecylbenzenesulfonate. To the silver chlorobromide emulsion prepared in advance, a mixture of sensitizing dyes (Dye-1) and (Dye-2) illustrated below were added at 40° C. After a lapse of 30 minutes, the resulting emulsion was mixed homogeneously with the foregoing emulsified dispersion, and thereto were added other ingredients described below so as to obtain a coating solution for the first layer having the composition described below.

Coating solutions for the second to seventh layers were prepared respectively in the same manner as that for the first layer. In each layer, sodium salt of 2-hydroxy-4,6-dichloro-1,3,5-triazine was used as a hardener.

Spectral sensitizing dyes used for light-sensitive emulsion layers are illustrated below.

First Layer: Yellow Color-Forming Layer:

(Dye-1)

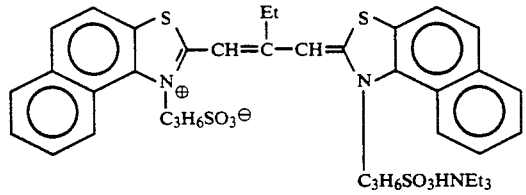

(which was added in an amount of $0.84\times10^{-5}$ mol/mol Ag)

(Dye-2)

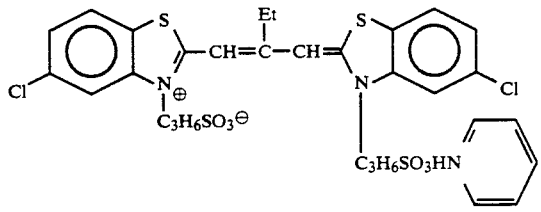

(which was added in an amount of $0.56\times10^{-5}$ mol/mol Ag).

Third Layer: Magenta Color-forming Layer;

Sensitizing dye (2) which was added in an amount of $2.9\times10^{-4}$ mol/mol Ag (specific addition amount: 0.52).

Fifth Layer: Cyan Color-Forming Layer:

(Dye-3)

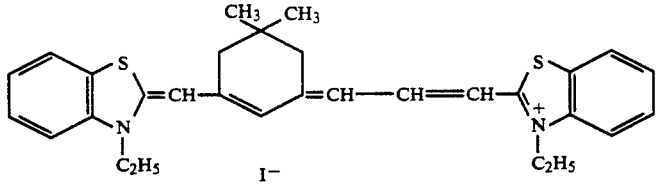

(which was added in an amount of $6.5\times10^{-6}$ mol/mol Ag).

In addition, 1-(5-methylureidophenyl)-5-mercaptotetrzole was added to each color-forming layer in amounts of $6.0\times10^{-4}$ mole per mole of silver halide.

Moreover, for the purpose of prevention of an irradiation phenomenon, disodium 2-[3-(2-hydroxyethylcarbamoyl) -4-{5-[5-hydroxy-3-(2-hydroxyethylcarbamoyl)-1-(2-sulfobenzyl)-5-pyrazolyl]-2,4-pentadienylidene}-5-pyrazolone-1-ylmethyl]benzenesulfonate, tripotassium 4-[3,3-dimethyl -5-sulfo-2-{7-[(3,3-dimethyl-5-sulfo-1-(4-sulfobutyl)indoline-2-ylidene]-1,3,5-heptatrienyl}-3H-1-indolio]butanesulfonate and pentapotassium 4-[3,3-dimethyl -4,6-disulfo-1-(4-sulfobutyl)benzo[e]indoline-2-ylidene]1,3,5-heptatrienyl) -3H-1-benzo[e]indolio]butanesulfonate were added to each emulsion.

The composition of each constituent layer is described below. Each figure on the right side represents a coverage (g/m$^2$) of the ingredient corresponding thereto. As for the silver halide emulsion, the figure represents the coverage based on silver.

Support:

Polyethylene-laminated paper (which contained white pigment ($TiO_2$) and a bluish dye (ultramarine) in the polyethylene on the side of the first layer)

| | |
|---|---|
| First layer (red-sensitive yellow color-forming layer): | |
| Silver chlorobromide emulsion described above | 0.30 |
| Gelatin | 1.86 |
| Yellow coupler (Ex-Y) | 0.82 |
| Color image stabilizer (Cpd-1) | 0.19 |
| Color image stabilizer (Cpd-7) | 0.06 |
| Solvent (Solv-1) | 0.35 |
| Second layer (color stain inhibiting layer): | |
| Gelatin | 0.99 |
| Color stain inhibitor (Cpd-5) | 0.08 |
| Solvent (Solv-1) | 0.16 |
| Solvent (Solv-4) | 0.08 |
| Third layer (infrared-sensitive magenta color-forming layer): | |
| Silver chlorobromide emulsion described above | 0.12 |
| Gelatin | 1.24 |
| Magenta coupler (Ex-M) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer): | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| Fifth layer (infrared-sensitive cyan color-forming layer): | |
| Silver chlorobromide emulsion described | 0.23 |

-continued

| | |
|---|---|
| above | |
| Gelatin | 1.34 |
| Cyan coupler (Ex-C) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth layer (ultraviolet absorbing layer): | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| Seventh layer (protective layer): | |
| Gelatin | 1.33 |
| Modified polyvinyl alcohol (modification degree: 17%) | 0.17 |
| Liquid paraffin | 0.03 |

The thus prepared sample having a multi-layer structure was called Sample 5-1.

In addition, other color photographic papers having a multi-layer structure were prepared in the same manner as described above, except that the emulsion used for the third layer was changed as follows.

That is, in preparing the foregoing silver chlorobromide emulsion, $2.9\times10^{-4}$ mol/mol Ag of the Sensitizing Dye (2) or $1.8\times10^{-5}$ mol/mol Ag of the dye (Dye-4) for comparison which are well-known as an M-band spectral sensitizer, was added at 70° C. with vigorous stirring before the chemical sensitization was achieved to an optimal extent by adding thereto a lime-processed gelatin and triethylthiourea and ripening at 55° C. After a lapse of 30 minutes from the conclusion of the addition, the emulsion was cooled to 55° C., and then chemically sensitized to an optimal extent by the addition of lime-processed gelatin and triethylthiourea and the ripening subsequent thereto. Thereafter, each emulsion thus prepared was mixed homogeneously at 40° C. with the magenta coupler-emulsified dispersion for the third layer which was prepared in advance, thus obtaining a coating composition.

The Sensitizing Dye (2)-containing sample was called Sample 5-2, and the Dye (Dye-4)-containing sample was called Sample 5-3.

Dye (Dye-4) for comparison:

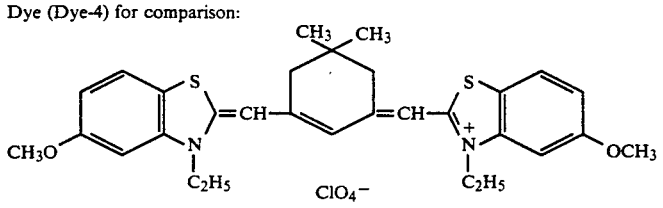

Each of these samples was subjected to scanning exposure using three kinds of semiconductor lasers, namely AlGaInP (oscillation wavelength: about 670 nm), GaAlAs (oscillation wavelength: about 750 nm) and GaAlAs (oscillation wavelength: about 810 nm). In order to perform tonal scanning exposure, such an instrument as to enable the sample set in a rotating polyhedron to move in a direction perpendicular to the scanning direction of the laser beams and the quantity of exposure light to change electrically was used.

After the scanning exposure, each of the foregoing three kinds of samples was subjected to the same color photographic processing as in Example 4. In the exposure with each semiconductor laser, the range of exposure energy wherein no color stain is generated in the formation of its corresponding color, that is to say, the difference between the main sensitivity of the corresponding light-sensitive layer and the sensitivity of another light-sensitive layer, was examined, and expressed in terms of logarithm. The results obtained are shown in Table 3. Additionally, the standard point of the developed color density to determine the sensitivity was fog +0.3.

TABLE 3

| | Sensitivity Difference in Exposure with 670 nm Laser (main color-forming layer: yellow) | | Sensitivity Difference in Exposure with 750 nm Laser (main color-forming layer: magenta) | | Sensitivity Difference in Exposure with 819 nm Laser (main color-forming layer: cyan) | |
|---|---|---|---|---|---|---|
| Sample | to Magenta | to Cyan | to Yellow | to Cyan | to Yellow | to Magenta |
| 5-1 | 1.37 | ≧1.50 | 0.85 | 0.17 | ≧1.50 | ≧1.50 |
| 5-2 | ≧1.50 | ≧1.50 | ≧1.50 | 1.28 | ≧1.50 | ≧1.50 |
| 5-3 | 1.35 | ≧1.50 | ≧1.50 | 1.41 | ≧1.50 | 0.45 |

In order to reproduce the image information with high fidelity, it is desirable that each color-forming layer should have a reproduction range of at least 1.0, preferably at least 1.2, expressed in terms of logarithm, in which no color stain is generated. The dynamic range of the semiconductor lasers used in this invention was 1.5, expressed in terms of logarithm. In sample 5-1, the reproduction range in which no color stain was generated upon exposure to laser beams of 750 nm was very narrow. In particular, cyan-color formation was likely to occur together with the required magenta-color formation because of the small difference in sensitivity at 750 nm between the magenta- and the cyan-forming layers. In sample 5-3 which contained in the magenta-forming layer the Dye (Dye-4) known as an M-band sensitizing dye having the spectral sensitivity maximum at 750 nm, both yellow and magenta reproduction ranges were on a satisfactory level, but the cyan reproduction range was narrow and insufficient. In other words, magenta-color formation was likely to occur together with the required cyan-color formation, resulting in a very unsatisfactory cyan-color reproduction. Indeed such color stains can be reduced by replacing the silver halide emulsion used in the magenta color-forming layer with an emulsion having a lower sensitivity or by replacing the silver halide emulsion used in the cyan color-forming layer with an emulsion having a higher sensitivity. For instance, if the sensitivity of a silver halide emulsion to be used in the magenta color-forming layer is reduced by 0.6–0.7, expressed in terms of logarithm or the sensitivity of a silver halide emulsion to be used in the cyan color-forming layer is increased by the same extent as described above, the difference in sensitivity at 810 nm between the cyan color-forming layer and the magenta color-forming layer can be surely made at least 1.0, expressed in terms of logarithm. In such a case, however, the difference in sensitivity between the magenta color-forming layer and the cyan color-forming layer upon exposure to laser beams of 750 nm will be lowered to about 0.8, though it was 1.4 in Sample 5-3. That is, the magenta reproduction range will become narrow and insufficient.

In contrast to the above-described samples prepared for comparison, Sample 5-2 prepared in accordance with the embodiment of this invention succeeded in gaining sufficient sensitivity differences among the three kinds of color-forming layers upon every exposure. The main reason for this success consists in realization of the art of J-band sensitization narrow in spectral sensitivity distribution. Owing to this art, only the sensitivities at the desired wavelengths were heightened, while those at the unnecessary wavelengths were suppressed to a low extent.

Figures 1, 4:
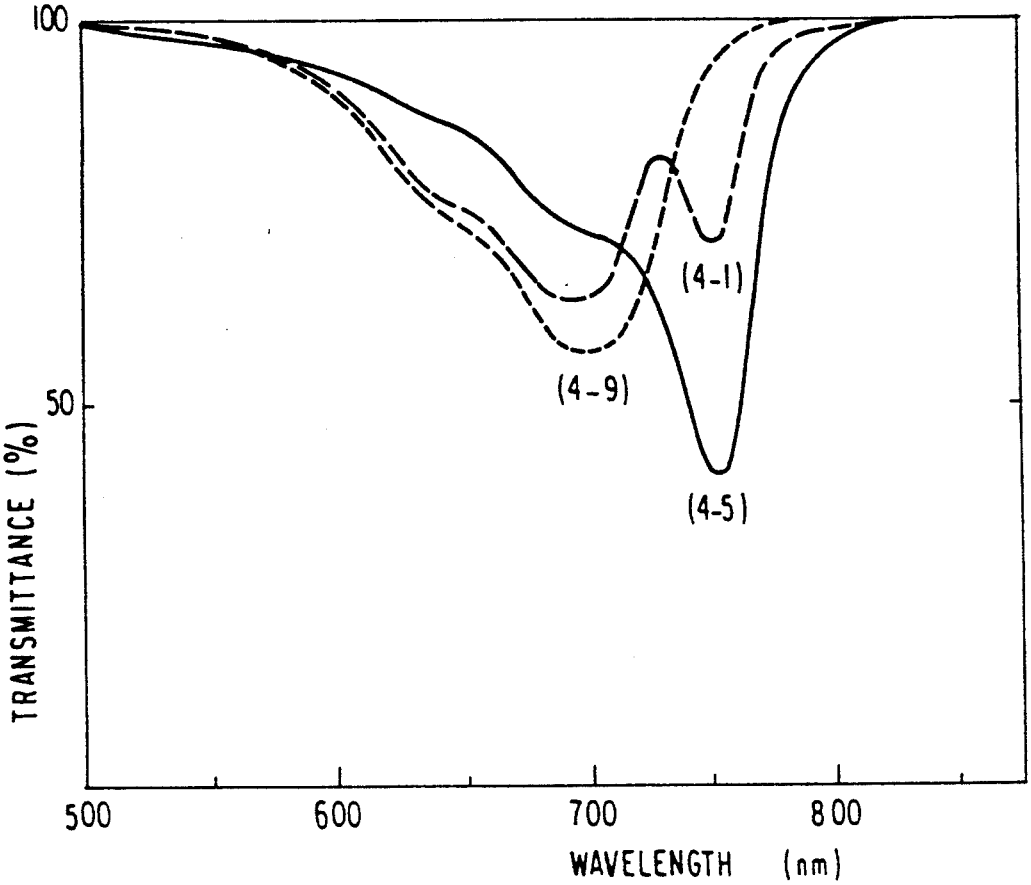
Figures 2, 4:
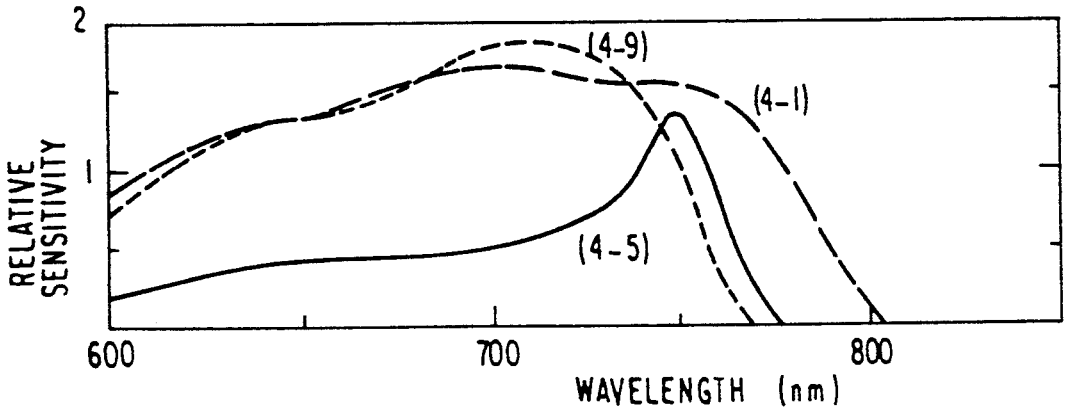
Figures 3, 4:
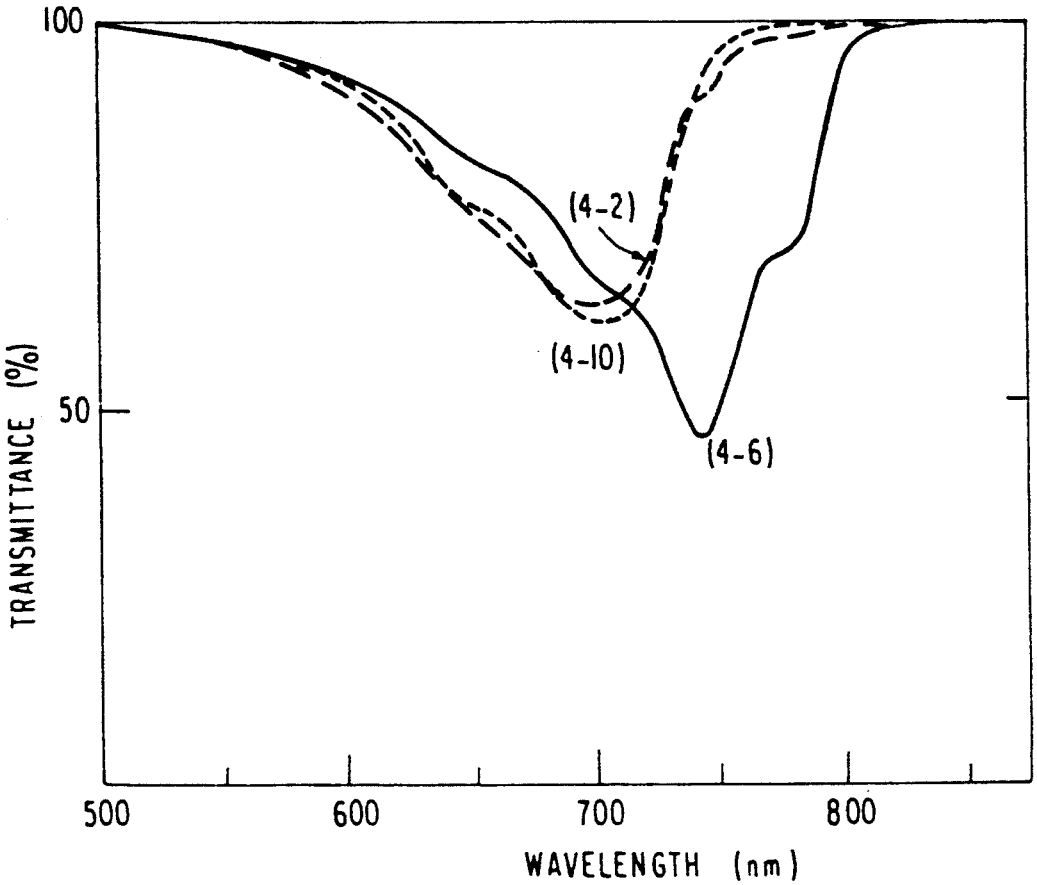
Figure 4:
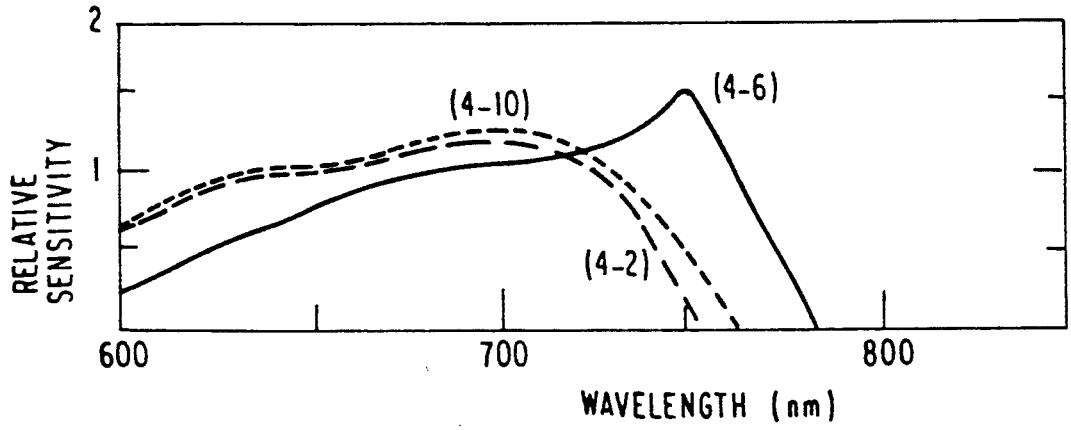
Figures 4, 5:
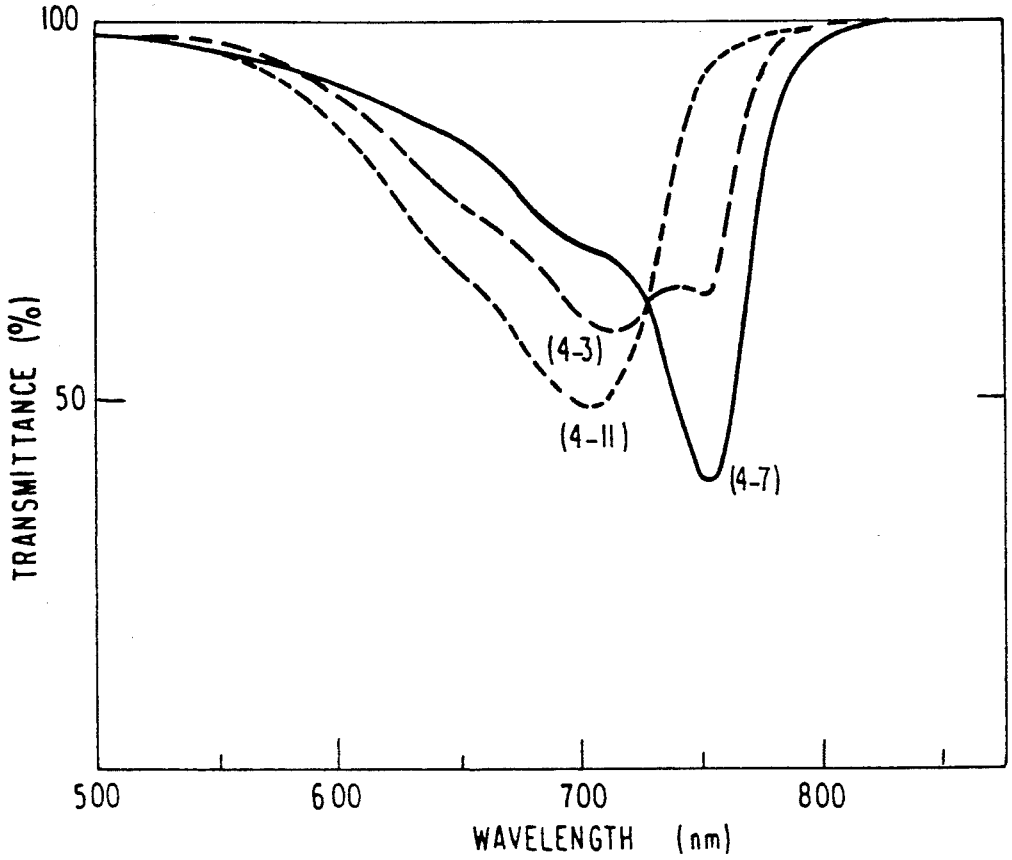
Figures 4, 5, 6:
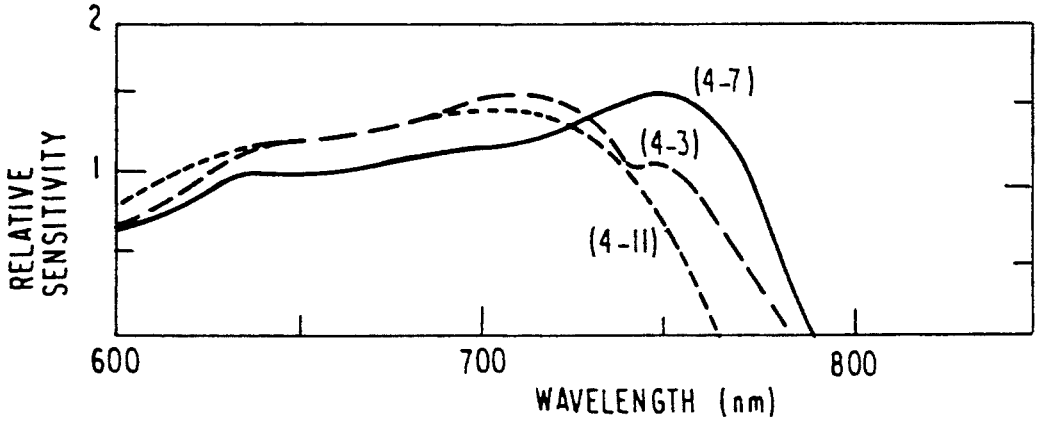
Figures 4, 5, 6, 7:
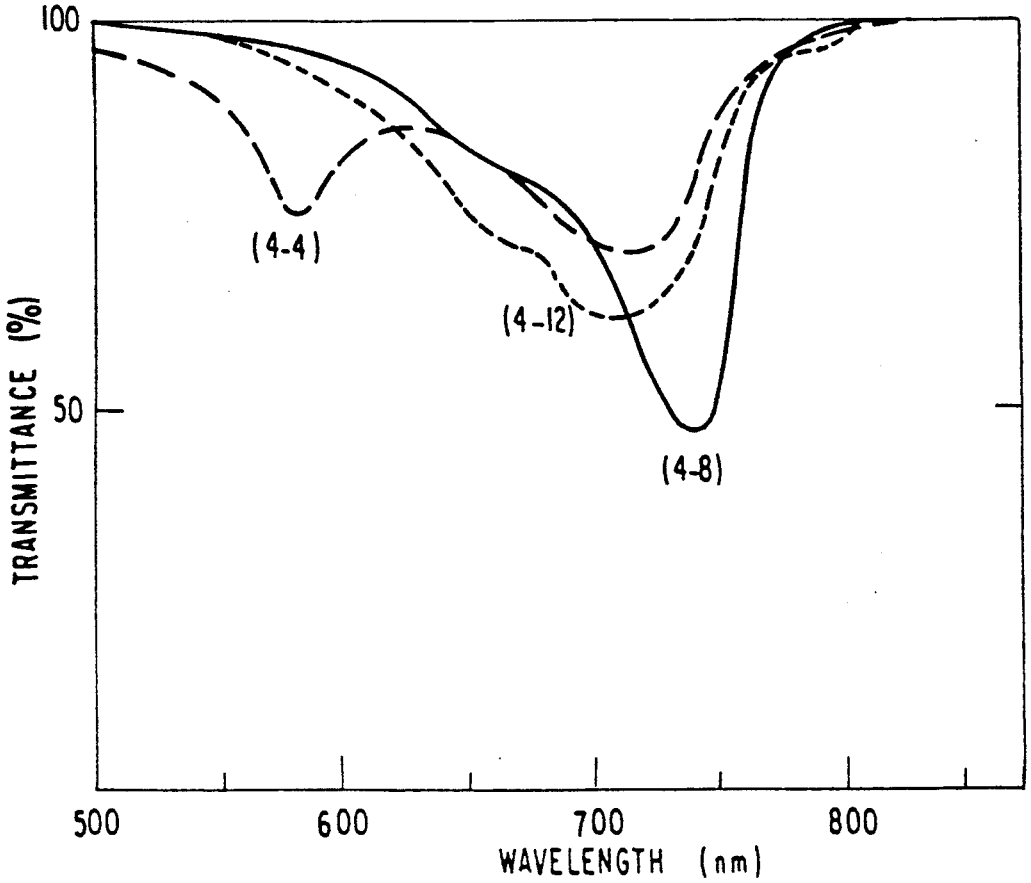
Figures 4, 5, 6, 7, 8:
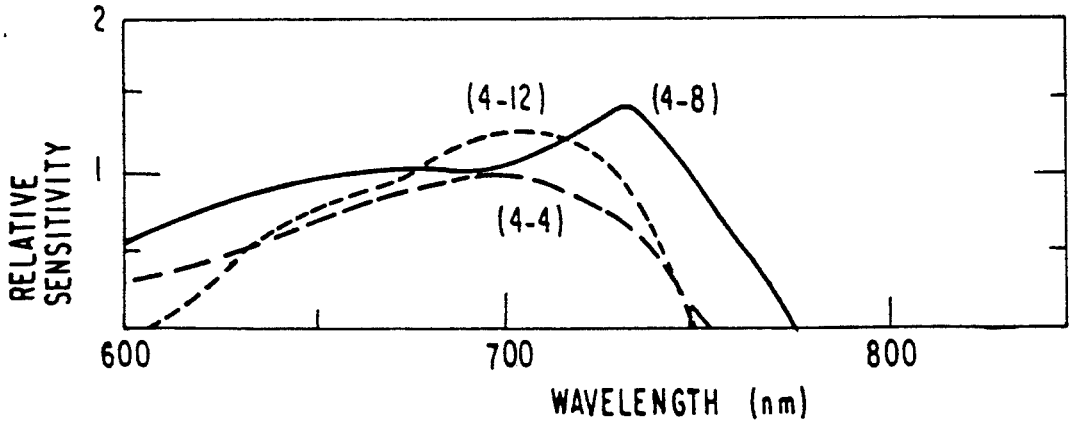
Figures 1, 5:
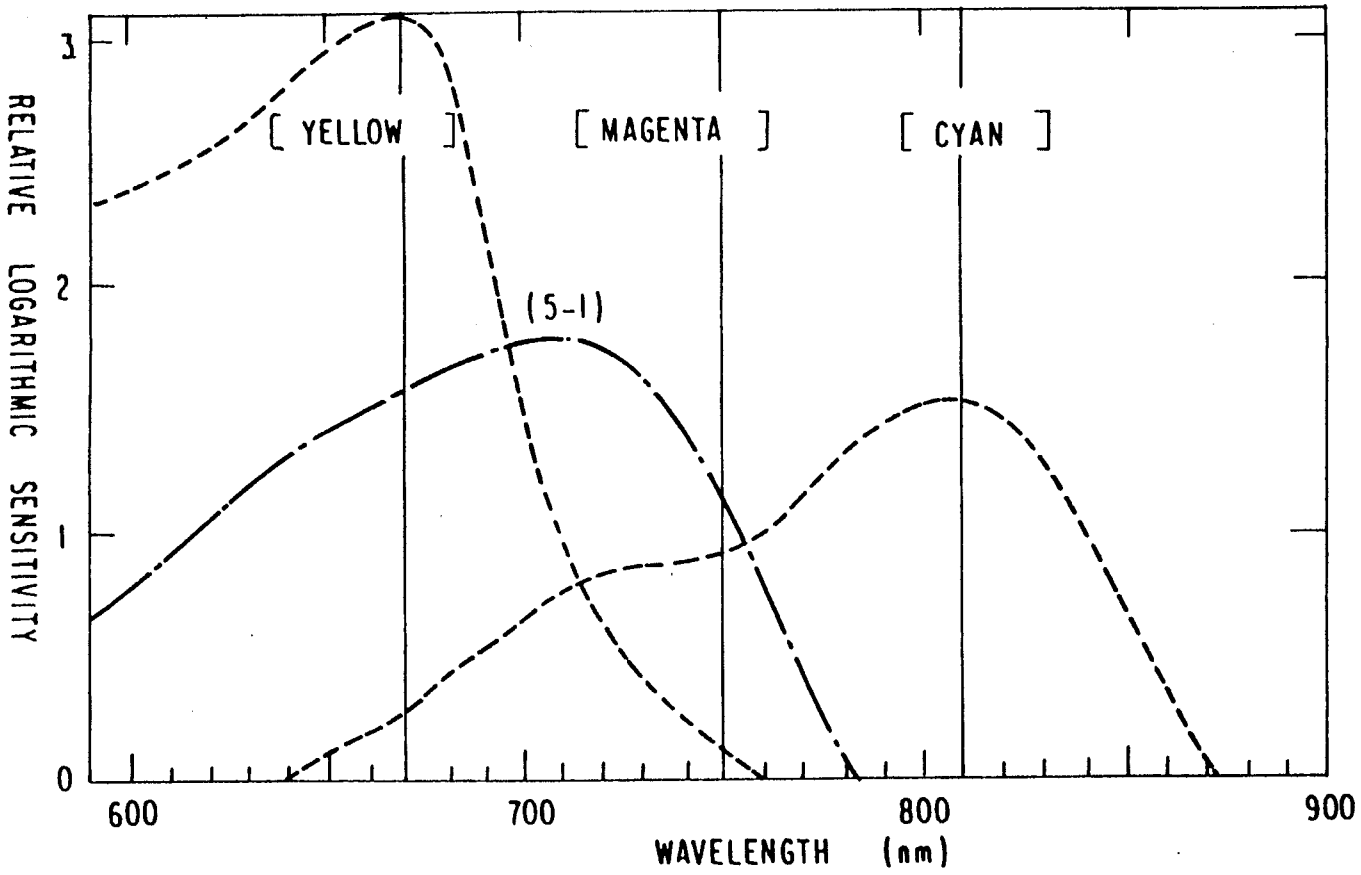
Figures 2, 5:
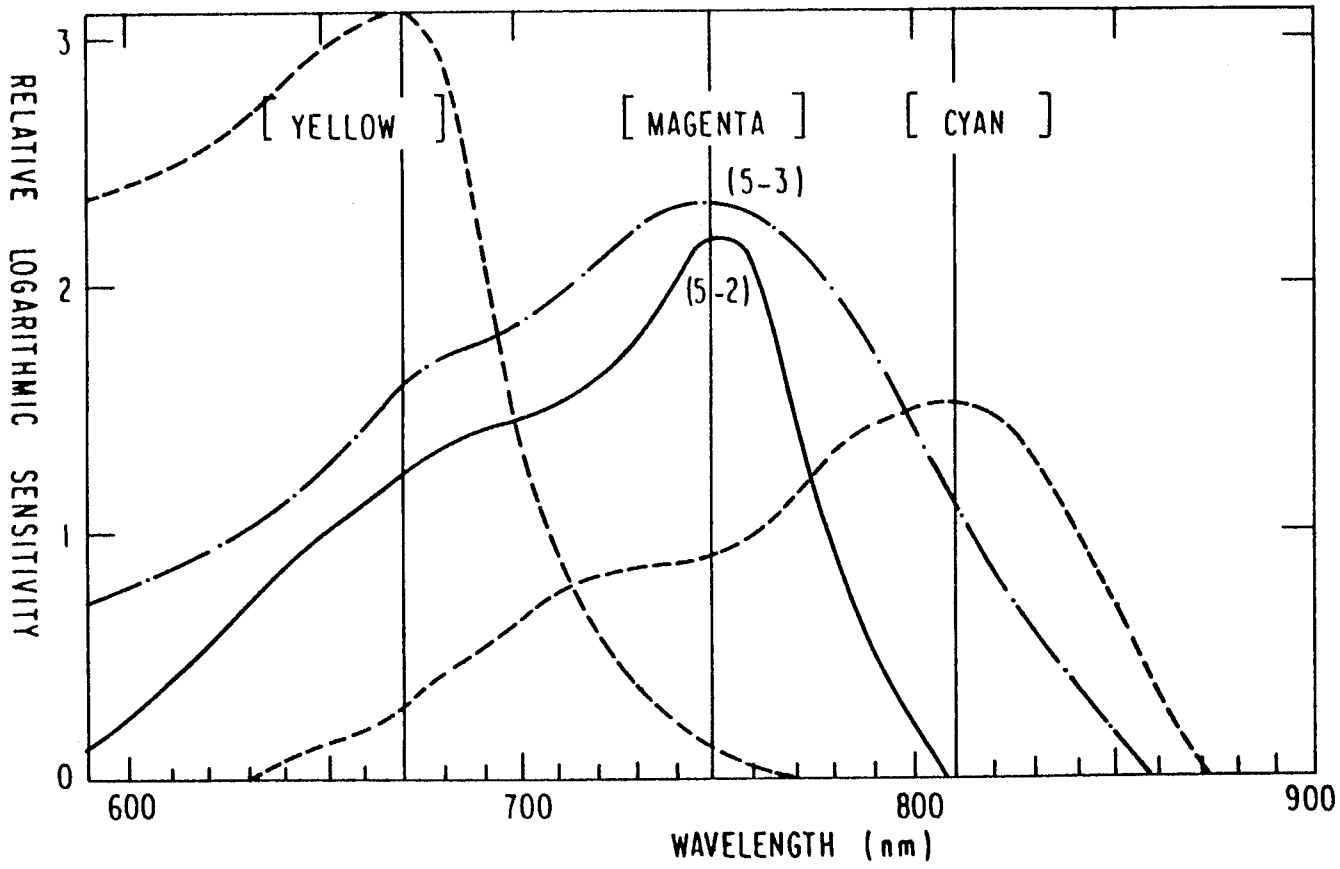

For the purpose of complementing the understanding of the above-described situation, the foregoing samples each were subjected to exposure with the same spectroscope as used in Example 1 in order to obtain a relative logarithmic spectral sensitivity curve, and then to a color photographic processing though the results to be obtained were supposed to differ somewhat from the above-described ones because that exposure was considerably different in illuminance from the scanning exposure using the foregoing semiconductor laser. The relative logarithmic spectral sensitivity curves of the foregoing three kinds of samples are shown in FIG. 5-1 and FIG. 5-2. As can be seen from these figures, the wavelength corresponding to the maximal sensitivity in the yellow color-forming layer of every sample was 670 nm, which is in good agreement with the wavelengths of the laser beams-oscillating device used for the 670 nm exposure. Also, the wavelength corresponding to the maximal sensitivity in the cyan color-forming layer of every sample was 812 nm, which is in fair agreement with the wavelengths of the laser beams-oscillating device used for the 810 nm exposure. However, as for the magenta color-forming layer, both the wavelength corresponding to the maximal sensitivity and the spectral sensitivity curve were different among the three samples, that is to say, they depended on the kind of sensitizing dye used or the conditions under which the sensitizing dye was added.

More specifically, the magenta color-forming layer of Sample 5-1 showed a M-band type broad spectral sensitivity distribution having a sensitivity maximum at 710 nm, that of Sample 5-2 showed a J-band type narrow spectral sensitivity distribution having a sensitivity maximum at 755 nm near to the wavelengths of the laser beams-oscillating device used for 750 nm exposure, and that of Sample 5-3 showed a M-band type broad spectral sensitivity distribution having a sensitivity maximum at 750 nm which is in good agreement with the wavelengths of the laser beams-oscillating device used for 750 nm exposure.

(Ex-Y) Yellow Coupler

1:1 (by mole) mixture of

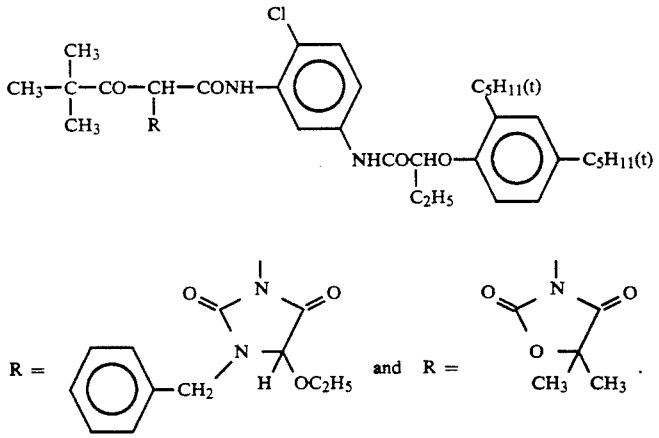

(Ex-M) Magenta Coupler

1:1 (by mole) mixture of

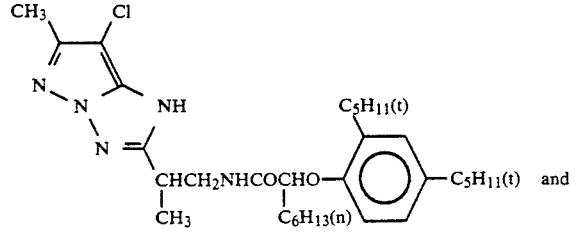

-continued
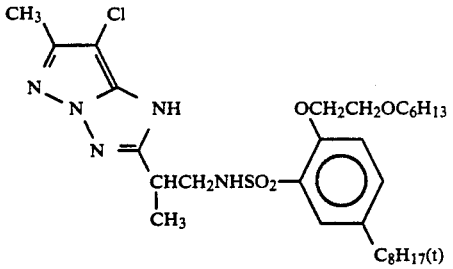
(Ex-C) Cyan Coupler
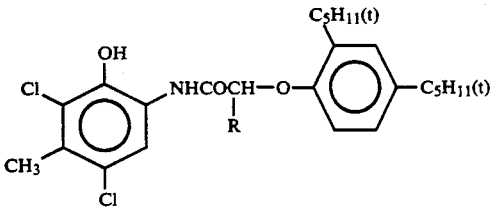
2:4:4 (by mole) mixture of
R = $C_2H_5$, and R = $C_4H_9$, and
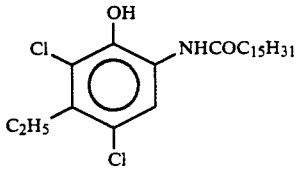
(Cpd-1) Color Image Stabilizer
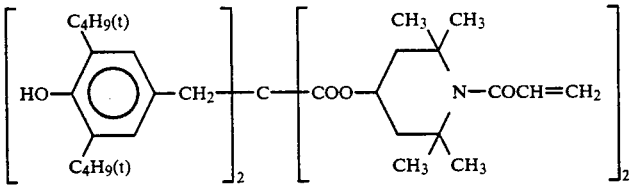
(Cpd-2) Color Image Stabilizer
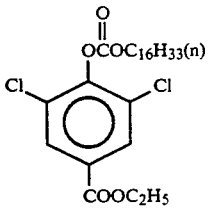
(Cpd-3) Color Image Stabilizer
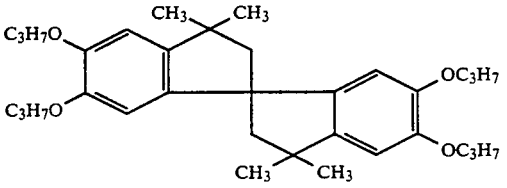
(Cpd-4) Color Image Stabilizer -continued
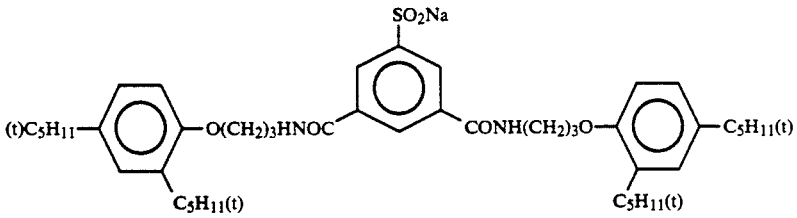
(Cpd-5) Color Stain Inhibitor
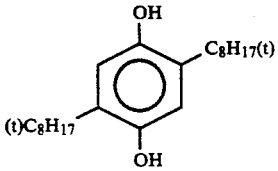
(Cpd-6) Color Image Stabilizer
2:4:4 (by weight) mixture of
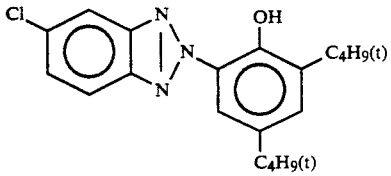
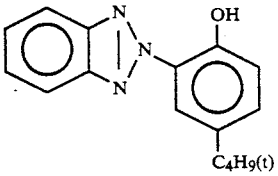
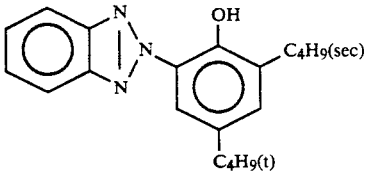
(Cpd-7) Color Image Stabilizer
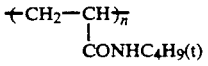
(Molecular weight 60,000)
(Cpd-8) Color Image Stabilizer
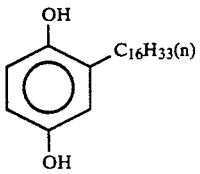
(Cpd-9) Color Image Stabilizer -continued
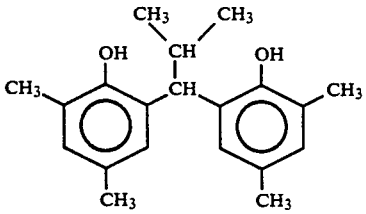
(UV-1) Ultraviolet Absorbent
4:2:4 (by weight) mixture of
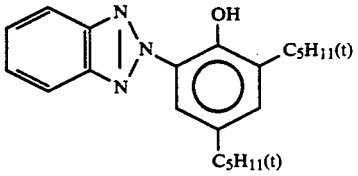
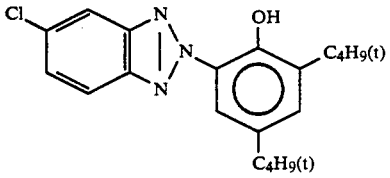
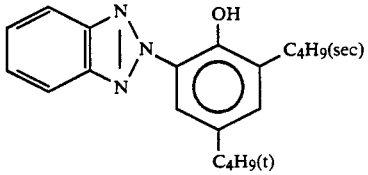
(Solv-1) Solvent
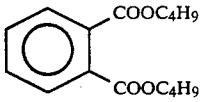
(Solv-2) Solvent
2:1 (by volume) mixture of
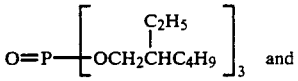
and
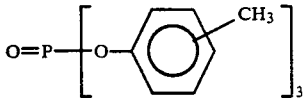
(Solv-4) Solvent
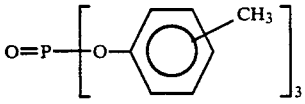
(Solv-5) Solvent
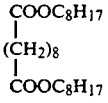

-continued (Solv-6) Solvent

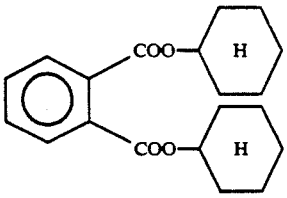

EFFECTS OF THE INVENTION

High spectral sensitivities can be gained with a silver halide photographic emulsion spectrally sensitized in accordance with an embodiment of this invention, more specifically by undergoing J-band sensitization so as to have its spectral sensitivity maximum in the wavelength region of 730–900 nm through the addition of a sensitizing dye represented by the general formula (I) in a particular amount, based on the specific addition amount defined in this specification, in a particular temperature range. In addition, photosensitive materials containing that photographic emulsion, particularly full color photosensitive materials containing said photographic emulsion, feature reduced changes of photographic characteristics, especially sensitivity, during storage prior to exposure.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion which is spectrally sensitized by containing at least one compound represented by the following general formula (I), said compound being added to said emulsion in an amount of from 0.3 to 0.9 based on the specific addition amount: 100 M R/S (wherein M represents the number of moles of the compound added to said emulsion, R is Avogadro's number, and S represents the total surface area (Å$^2$) of the silver halide grains present in said emulsion) at a temperature ranging from 60° C. to 85° C. to cause in said emulsion J-band sensitization so as to confer a spectral sensitivity maximum at a wavelength from 730 nm to 900 nm:

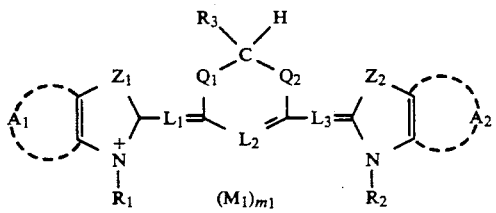

(I)

wherein $Z_1$ and $Z_2$ each represent a sulfur or selenium atom; $Q_1$ and $Q_2$ each represent a methylene group; $R_1$ and $R_2$ each represent an alkyl group; $R_3$ represents an alkyl group, an aryl group or a heterocyclyl group; $L_1$, $L_2$ and $L_3$ each represent a methine group; $A_1$ and $A_2$ each represent atoms completing a benzene ring; $R_1$ and $R_2$ may combine with $L_1$ and $L_3$, respectively, to form a ring; $M_1$ represents a counter ion for charge balance; and $m_1$ represents a numerical value required for neutralization of the electric charge.

2. The silver halide photographic emulsion of claim 1, wherein the addition amount of the compound of general formula (I) is 0.4 to 0.7.

3. The silver halide photographic emulsion of claim 1, wherein the addition temperature is from 65° C. to 75° C.

4. The silver halide photographic emulsion of claim 1, wherein silver halide grains have a localized phase having a bromide content which is higher than that of the surrounding grain and more than 15 mol. %.

5. The silver halide photographic emulsion of claim 4, wherein high bromide content localized phase is formed on the surface of the grain by epitaxial growth.

6. The silver halide photographic emulsion of claim 4, wherein the bromide content of the localized phase is from 20 to 60 mol. %.

7. The silver halide photographic emulsion of claim 4, wherein the bromide content of the localized phase is from 30 to 50 mol. % and the remainder is chloride.

8. A full-color recording material which comprises a support having thereon at least three kinds of silver halide emulsion layer each layers of which contains a yellow color-forming coupler, a magenta color-forming coupler or a cyan color-forming coupler, each layer being different in the wavelengths at which it has sensitivity, and at least one silver halide emulsion layer of which is selectively subjected to spectral sensitization designated so as to corresponds to the light flux of wavelengths longer than 730 nm, wherein said at least one emulsion is a silver halide photographic emulsion which is spectrally sensitized by containing at least one compound represented by the following general formula (I), said compound being added to said emulsion in an amount of from 0.3 to 0.9 based on the specific addition amount: 100·M·R/S (wherein M represents the number of moles of the compound added to said emulsion, R is Avogadro's number, and S represents the total surface area (Å$^2$) of the silver halide grains present in said emulsion) at a temperature ranging from 60° C. to 85° C. to cause in said emulsion J-band sensitization so as to confer a spectral sensitivity maximum at a wavelength from 730 nm to 900 nm:

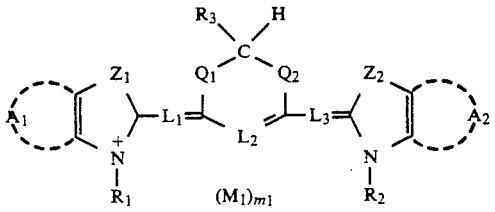

(I)

wherein $Z_1$ and $Z_2$ each represent a sulfur or Selenium and $Q_2$ each represent a methylene group; $R_1$ and $R_2$ each represent an alkyl group; $R_3$ represents an alkyl group, an aryl group or a heterocyclyl group; $L_1$, $L_2$ and $L_3$ each represent a methine group; $A_1$ and $A_2$ each represent atoms completing a benzene ring; $R_1$ and $R_2$ may combine with $L_1$ and $L_3$, respectively, to form a ring; $M_1$ represents a counter ion for charge balance; and $m_1$ represents a numerical value required for neutralization of the electric charge.

9. The full-color recording material of claim 8, wherein the addition amount of the compound of general formula (I) is 0.4 to 0.7.

10. The full-color recording material of claim 8, wherein the addition temperature is from 65° C. to 75° C.

11. The full-color recording material of claim 8, wherein silver halide grains have a localized phase having a bromide content which is higher than that of the surrounding grain and more than 15 mol. %.

12. The full-color recording material of claim 11, wherein high bromide content localized phase is formed on the surface of the grain by epitaxial growth.

13. The full-color recording material of claim 11, wherein the bromide content of the localized phase is from 20 to 60 mol. %.

14. The full-color recording material of claim 11, wherein the bromide content of the localized phase is from 30 to 50 mol. % and the remainder is chloride.

15. The full-color recording material of claim 8, wherein the yellow color-forming coupler-containing layer, the magenta color-forming coupler-containing layer and the cyan color-forming coupler-containing layer have spectral sensitivities corresponding to at least three kinds of the light flux, respectively, which differ in main wavelength from one another.

16. The full-color recording material of claim 15, wherein the respective main sensitivities at wavelengths separate from one another by at least 30 nm.

17. The full-color recording material of claim 15, wherein the respective main sensitivities at wavelengths have sensitivity difference from one another by at least 0.8 LogE (E=light quantity).

* * * * *